US006836629B2

(12) United States Patent
Miyabe et al.

(10) Patent No.: US 6,836,629 B2
(45) Date of Patent: Dec. 28, 2004

(54) DEVELOPING BLADE, PROCESS CARTRIDGE, AND ELECTROPHOTOGRAPHIC IMAGE FORMING APPARATUS

(75) Inventors: Shigeo Miyabe, Shizuoka (JP); Shinjiro Toba, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/023,875

(22) Filed: Dec. 21, 2001

(65) Prior Publication Data

US 2003/0228171 A1 Dec. 11, 2003

(30) Foreign Application Priority Data

Dec. 25, 2000 (JP) ..... 2000-392334

(51) Int. Cl.[7] ..... G03G 21/16; G03G 21/18; G03G 15/08

(52) U.S. Cl. ..... 399/111; 399/113; 399/284

(58) Field of Search ..... 399/113, 119, 399/274, 284, 110, 111

(56) References Cited

U.S. PATENT DOCUMENTS

| | | | | |
|---|---|---|---|---|
| 4,835,565 A | * | 5/1989 | Nagatsuna et al. | 399/119 |
| 4,951,093 A | * | 8/1990 | Ishii et al. | 399/119 |
| 5,331,373 A | | 7/1994 | Nomura et al. | |
| 5,452,056 A | | 9/1995 | Nomura et al. | |
| 5,463,446 A | | 10/1995 | Watanabe et al. | |
| 5,585,889 A | | 12/1996 | Shishido et al. | |
| 5,640,650 A | | 6/1997 | Watanabe et al. | 399/117 |
| 5,812,918 A | * | 9/1998 | Nakaue et al. | 399/284 |
| 5,839,028 A | | 11/1998 | Nomura et al. | 399/109 |
| 5,873,012 A | | 2/1999 | Miyabe et al. | 399/90 |
| 5,878,309 A | | 3/1999 | Nomura et al. | 399/111 |
| 5,878,310 A | | 3/1999 | Noda et al. | 399/117 |
| 5,926,666 A | | 7/1999 | Miura et al. | 399/25 |

(List continued on next page.)

FOREIGN PATENT DOCUMENTS

JP 05107822 A * 4/1993 ..... G03G/15/00

*Primary Examiner*—Susan Lee
(74) *Attorney, Agent, or Firm*—Fitzpatrick, Cella, Harper & Scinto

(57) ABSTRACT

A developing blade for use in a process cartridge regulates the amount of developer on a peripheral surface of a developing roller. The process cartridge includes: an electrophotographic photosensitive drum; a developing roller for developing an electrostatic latent image formed on the electrophotographic photosensitive drum; a developing frame that rotatably supports the developing roller; a drum frame that rotatably supports the electrophotographic photosensitive drum, and that is connected to the developing frame, wherein the developing frame and the drum frame are rockable with respect to each other; and a biasing member for biasing the developing roller toward the electrophotographic photosensitive drum. The developing blade is supported by a supporting member and is attached to the developing frame, and wherein at least one end of the supporting member in a lengthwise direction of the developing roller is provided with an attachment portion to which the biasing member is attached.

12 Claims, 42 Drawing Sheets

U.S. PATENT DOCUMENTS

| | | | | |
|---|---|---|---|---|
| 5,943,529 | A | | 8/1999 | Miyabe et al. ..... 399/111 |
| 5,946,531 | A | | 8/1999 | Miura et al. ..... 399/111 |
| 5,950,047 | A | | 9/1999 | Miyabe et al. ..... 399/111 |
| 5,966,567 | A | | 10/1999 | Matsuzaki et al. ..... 399/111 |
| 6,029,031 | A | | 2/2000 | Yokomori et al. ..... 399/109 |
| 6,064,843 | A | | 5/2000 | Isobe et al. ..... 399/111 |
| 6,072,968 | A | | 6/2000 | Nomura et al. ..... 399/113 |
| 6,128,452 | A | | 10/2000 | Miyabe et al. ..... 399/90 |
| 6,154,623 | A | | 11/2000 | Suzuki et al. ..... 399/111 |
| 6,167,219 | A | | 12/2000 | Miyamoto et al. ..... 399/90 |
| 6,173,140 | B1 | | 1/2001 | Suzuki et al. ..... 399/113 |
| 6,208,818 | B1 | * | 3/2001 | Noda ..... 399/111 |
| 6,215,969 | B1 | | 4/2001 | Nomura et al. ..... 399/111 |
| 6,282,390 | B1 | | 8/2001 | Miyabe et al. ..... 399/111 |
| 6,317,572 | B1 | | 11/2001 | Miyabe et al. ..... 399/111 |
| 6,336,017 | B1 | | 1/2002 | Miyamoto et al. ..... 399/116 |
| 6,351,620 | B1 | | 2/2002 | Miyabe et al. ..... 399/111 |
| 6,442,359 | B1 | * | 8/2002 | Numagami et al. ..... 399/111 |
| 6,542,706 | B2 | * | 4/2003 | Toba et al. ..... 399/111 |
| 2001/0026707 | A1 | * | 10/2001 | Miyabe et al. ..... 399/111 |

* cited by examiner

DEVELOPING BLADE, PROCESS CARTRIDGE, AND ELECTROPHOTOGRAPHIC IMAGE FORMING APPARATUS

BACKGROUND OF THE INVENTION

1. Field of the Invention

The present invention relates to an electrophotographic image forming apparatus, and a process cartridge and a developing blade applied to the apparatus.

Here, the electrophotographic image forming apparatus (hereinafter referred to as the "image forming apparatus") is an apparatus that forms an image on a recording medium using an electrophotographic image forming process. Examples of the image forming apparatus are an electrophotographic copying machine, an electrophotographic printer (for instance, an LED printer, a laser beam printer, and the like), an electrophotographic facsimile apparatus, and an electrophotographic word processor.

Also, the process cartridge may integrally incorporate a charging means, a developing means, or a cleaning means, and an electrophotographic photosensitive member into a cartridge that is detachably mountable to a main body of the image forming apparatus. Alternatively, the process cartridge may integrally incorporate the electrophotographic photosensitive member and at least one of the charging means, the developing means, and the cleaning means into a cartridge that is detachably mountable to the main body of the image forming apparatus. Further alternatively, the process cartridge may integrally incorporate at least the developing means with an electrophotographic photosensitive drum into a cartridge that is detachably mountable to the main body of the image forming apparatus.

2. Description of Related Art

A process cartridge is composed of a cleaning unit and a developing unit. The cleaning unit integrally includes a charging means, a cleaning means, and a photosensitive drum, and the developing unit integrally includes a developing means and toner supplied to the developing means. The cleaning unit and the developing unit are integrally connected to each other using a connecting member, thereby obtaining the process cartridge (see FIG. 33).

In an image forming apparatus employing an electrophotographic method, it becomes necessary to exchange a photosensitive drum, to replenish or exchange developer, and to adjust, clean, or exchange other components (such as a charger and a cleaner container) when the operating time of the image forming apparatus becomes long. In reality, however, such maintenance work is difficult for a person who is not a serviceman having expert knowledge.

As to the aforementioned process cartridge, there is publicly known a construction in which a photosensitive unit, which supports an electrophotographic photosensitive member, a cleaning means, and the like, is connected to a developing unit, which supports a developing means, using a connecting member.

Therefore, the image forming apparatus that forms an image on a recording medium using an electrophotographic image forming process adopts a process cartridge system in which the electrophotographic photosensitive member and a process means acting on this electrophotographic photosensitive member are integrally made into a cartridge which is detachably mountable to the main body of the image forming apparatus. In accordance with this process cartridge system, the image forming apparatus can be personally maintained by a user without relying on a serviceman, so that operability can be greatly improved. Therefore, this process cartridge system can be used in a wide variety of image forming apparatuses.

In the process cartridge, the developing unit is rotatably supported about a rotational axis with respect to the photosensitive unit and is biased toward the photosensitive unit side by the self-weight of the developing unit or a pressurizing member like a spring. That is, a developer bearing member in the developing unit is biased against the electrophotographic photosensitive member in the photosensitive unit through a space maintaining member. With this construction, a constant minute space is always maintained between the electrophotographic photosensitive member and the developer bearing member, whereby fine images can be outputted with stability.

As to the process cartridge, it is desired that the accuracy of mounting positions of parts related to image formation be further improved in order to further improve image quality.

As to the process cartridge, further cost reduction is also desired.

SUMMARY OF THE INVENTION

An object of the invention is to provide a process cartridge capable of maintaining a space between a developing roller and an electrophotographic photosensitive drum always constant with accuracy, an electrophotographic image forming apparatus to which the process cartridge is detachably mountable, and a developing blade for use in the process cartridge.

It is another object of the invention to provide a process cartridge capable of surely biasing a developing roller in a direction in which the developing roller abuts against an electrophotographic photosensitive drum, an electrophotographic image forming apparatus to which the process cartridge is detachably mountable, and a developing blade for use in the process cartridge.

It is still another object of the invention to provide a process cartridge reduced in cost by attaching one end of a biasing member for biasing a developing roller in a direction in which the developing roller abuts against an electrophotographic photosensitive drum to a supporting portion of a developing blade, an electrophotographic image forming apparatus to which the process cartridge is detachably mountable, and the developing blade for use in the process cartridge.

It is still further another object of the invention to provide a process cartridge capable of improving detection of a remaining amount of developer, an electrophotographic image forming apparatus to which the process cartridge is detachably mountable, and a developing blade for use in the process cartridge.

It is still further another object of the invention to provide a process cartridge capable of applying voltage to a supporting portion of a developing blade by using a biasing member for biasing a developing roller in a direction in which the developing roller abuts against an electrophotographic photosensitive drum, an electrophotographic image forming apparatus to which the process cartridge is detachably mountable, and the developing blade for use in the process cartridge.

Also, it is another object of the invention to provide a process cartridge detachably mountable to a main body of an electrophotographic image forming apparatus, the process cartridge comprising: an electrophotographic photosensitive drum; a developing roller for developing an electrostatic latent image formed on the electrophotographic photosensitive drum; a developing blade for regulating an amount of developer on a peripheral surface of the developing roller, the developing blade having a regulating portion for regulating the amount of developer on the peripheral surface of the developing roller and a supporting portion for supporting the regulating portion; a developing frame that rotatably supports the developing roller, the supporting portion of the developing blade being attached to the developing frame; a drum frame that rotatably supports the electrophotographic photosensitive drum and that is connected to the developing frame, wherein the drum frame and the developing frame are connected rockably to each other; and a biasing member for biasing the developing roller toward the electrophotographic photosensitive drum, wherein one end of the biasing member is attached to at least one end of the supporting portion in a longitudinal direction of the developing roller.

Also, it is still another object of the invention to provide an electrophotographic image forming apparatus to which a process cartridge is detachably mountable for forming an image on a recording medium, the electrophotographic image forming apparatus comprising: (i) mounting means for detachably mounting the process cartridge, the process cartridge comprising: an electrophotographic photosensitive drum; a developing roller for developing an electrostatic latent image formed on the electrophotographic photosensitive drum; a developing blade for regulating the amount of developer on a peripheral surface of the developing roller, the developing blade having a regulating portion for regulating an amount of developer on the peripheral surface of the developing roller and a supporting portion for supporting the regulating portion; a developing frame that rotatably supports the developing roller, the supporting portion of the developing blade being attached to the developing frame; a drum frame that rotatably supports the electrophotographic photosensitive drum and that is connected to the developing frame, wherein the drum frame and the developing frame are connected rockably to each other; and a biasing member for biasing the developing roller toward the electrophotographic photosensitive drum, wherein one end of the biasing member is attached to at least one end of the supporting portion in a longitudinal direction of the developer roller; and (ii) transporting means for transporting the recording medium.

Also, it is still another object of the invention to provide a developing blade for use in a process cartridge, the process cartridge comprising: an electrophotographic photosensitive drum; a developing roller for developing an electrostatic latent image formed on the electrophotographic photosensitive drum; a developing frame that rotatably supports the developing roller; a drum frame that rotatably supports the electrophotographic photosensitive drum and that is connected to the developing frame, wherein the drum frame and the developing frame are connected rockably to each other; and a biasing member for biasing the developing roller toward the electrophotographic photosensitive drum, the developing blade comprising: a regulating portion for regulating an amount of developer on a peripheral surface of the developing roller; and a supporting portion for supporting the regulating portion, the supporting portion being to be attached to the developing frame and having an attaching portion to which one end of the biasing member is attached.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiments of the present invention will be described with reference to FIGS. 1 to 9. In this embodiment, the lengthwise direction is a direction that is perpendicular to a direction, in which a recording medium is transported, and is parallel to the plane of the recording medium. Also, the upper surface and the lower surface of a process cartridge respectively refer to the upper surface and the lower surface thereof under a condition where the process cartridge is mounted to the main body of an image forming apparatus.

(Description of Process Cartridge and Main Body of Apparatus)

Figure 1:
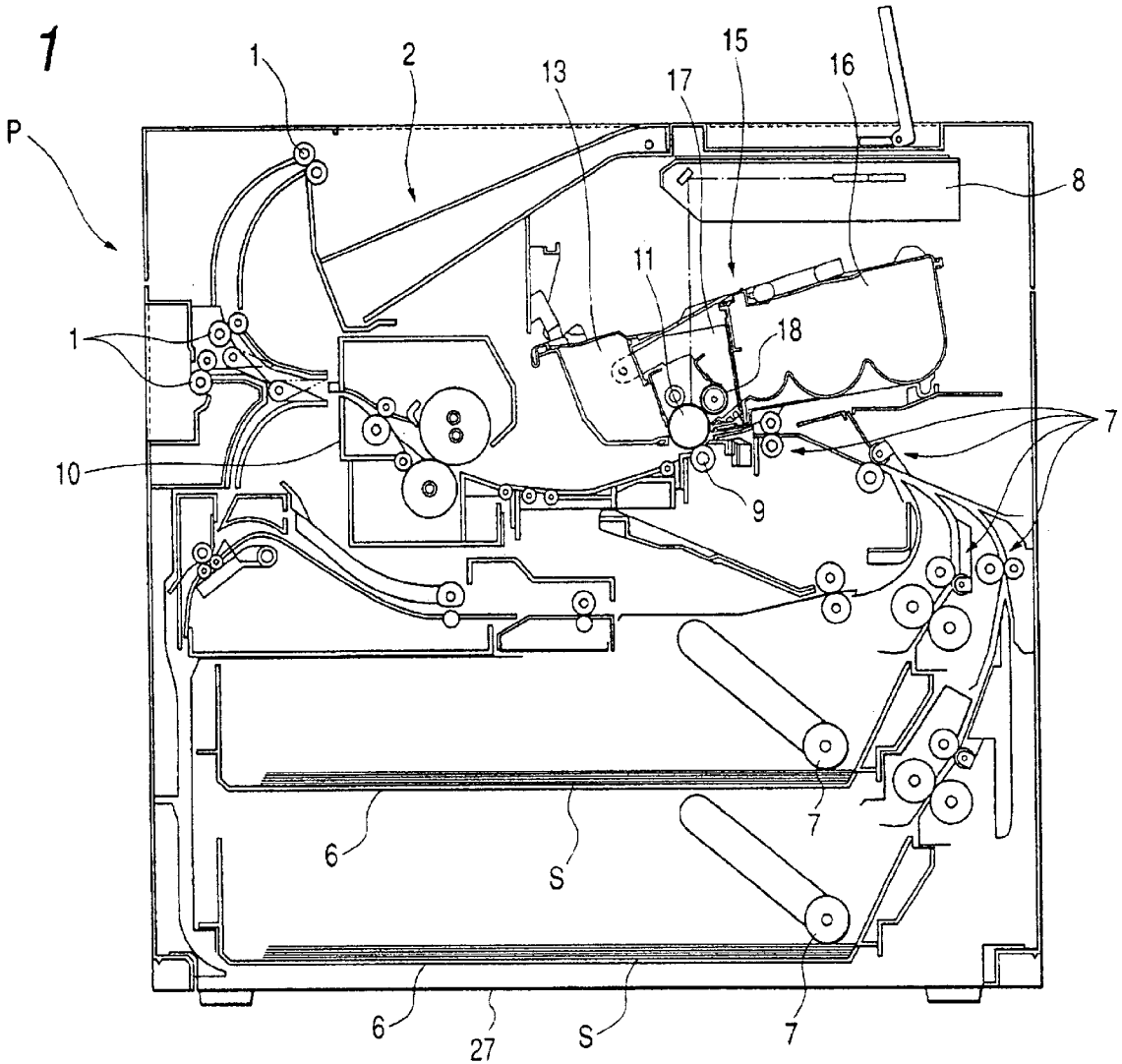
FIG. 1 is a vertical cross-sectional view of an electrophotographic image forming apparatus.
Figure 2:
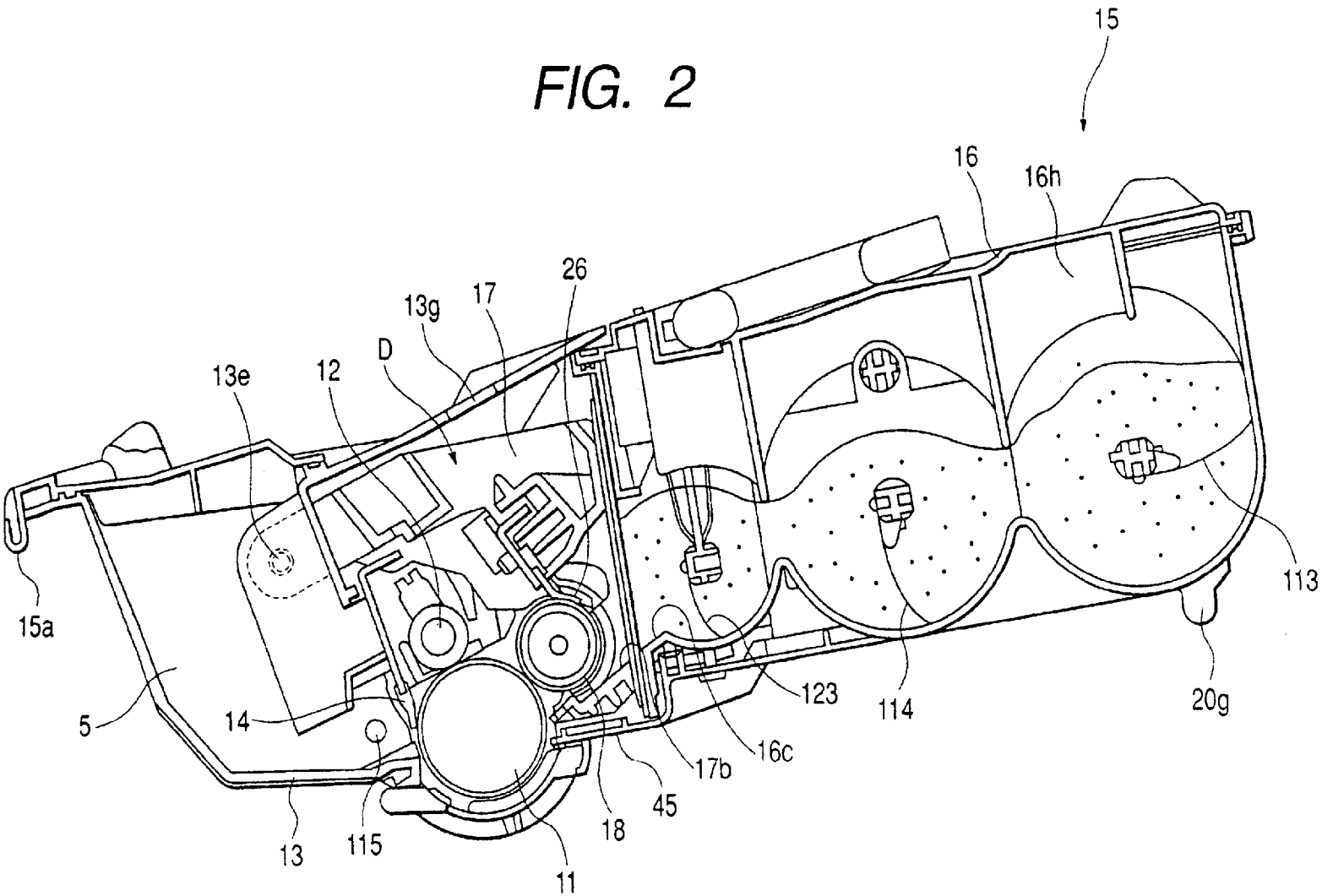
FIG. 2 is a vertical cross-sectional view of a process cartridge.

FIG. 2 is a main cross-sectional view of a process cartridge according to the present invention, while FIG. 1 is a main cross-sectional view of an image forming apparatus P according to the present invention. This process cartridge is provided with an electrophotographic photosensitive member and process means acting on the electrophotographic photosensitive member. Here, for instance, the process means includes a charging means for charging surface of the electrophotographic photosensitive member, a developing means for developing an electrostatic latent image formed on the electrophotographic photosensitive member, and a cleaning means for removing residual developer on the surface of the electrophotographic photosensitive member.

In a process cartridge 15 of this embodiment, as shown in FIG. 2, a charging member 12 functioning as a charging means, a developing roller 18 and a developing blade 26 functioning as developing means, and a cleaning member 14 functioning as a cleaning means are disposed around an electrophotographic photosensitive drum 11. These components are integrally covered with a housing, thereby obtaining the process cartridge 15 that is constructed so as to be freely attached to and detached from the main body 27 of the image forming apparatus (hereinafter referred to as the "apparatus body"). Here, the charging member 12 is a charging roller and includes rubber of a middle resistance provided around its metal core. Also, the cleaning member 14 is obtained by fixing a rubber blade, which contacts the photosensitive drum 11 and scraps off transfer residual toner, to an attachment sheet metal.

This process cartridge 15 is mounted to the image forming apparatus P shown in FIG. 1 and is used to form images. During the image formation, a sheet S functioning as a recording medium is transported by transport rollers 7 from sheet cassettes 6 mounted in a lower portion of the apparatus, and a latent image is formed by selectively exposing the photosensitive drum 11 from an exposing device 8 in synchronism with the transportation of this sheet. Following this, toner contained in a toner container or developer frame 16 is given a frictional electrification charge by the developing blade 26, a thin layer of the toner is borne on the surface of the developing roller 18, and a developing bias is applied to the developing roller 18, thereby supplying the toner in accordance with the latent image. This toner image is transferred onto the sheet S, which functions as a transported recording medium, by the application of a bias voltage to a transfer roller 9. This sheet S is transported to a fixing device 10 to fix the image, and is delivered by sheet delivery rollers 1 to a delivery portion 2 located in the upper part of the apparatus.

Meanwhile, after the transfer, residual toner on the photosensitive drum 11 is removed by the cleaning member 14 and is sent to the back of a removed toner reservoir 5 by a removed toner sending member 115.

(Construction of Frame of Process Cartridge)

Figure 5:
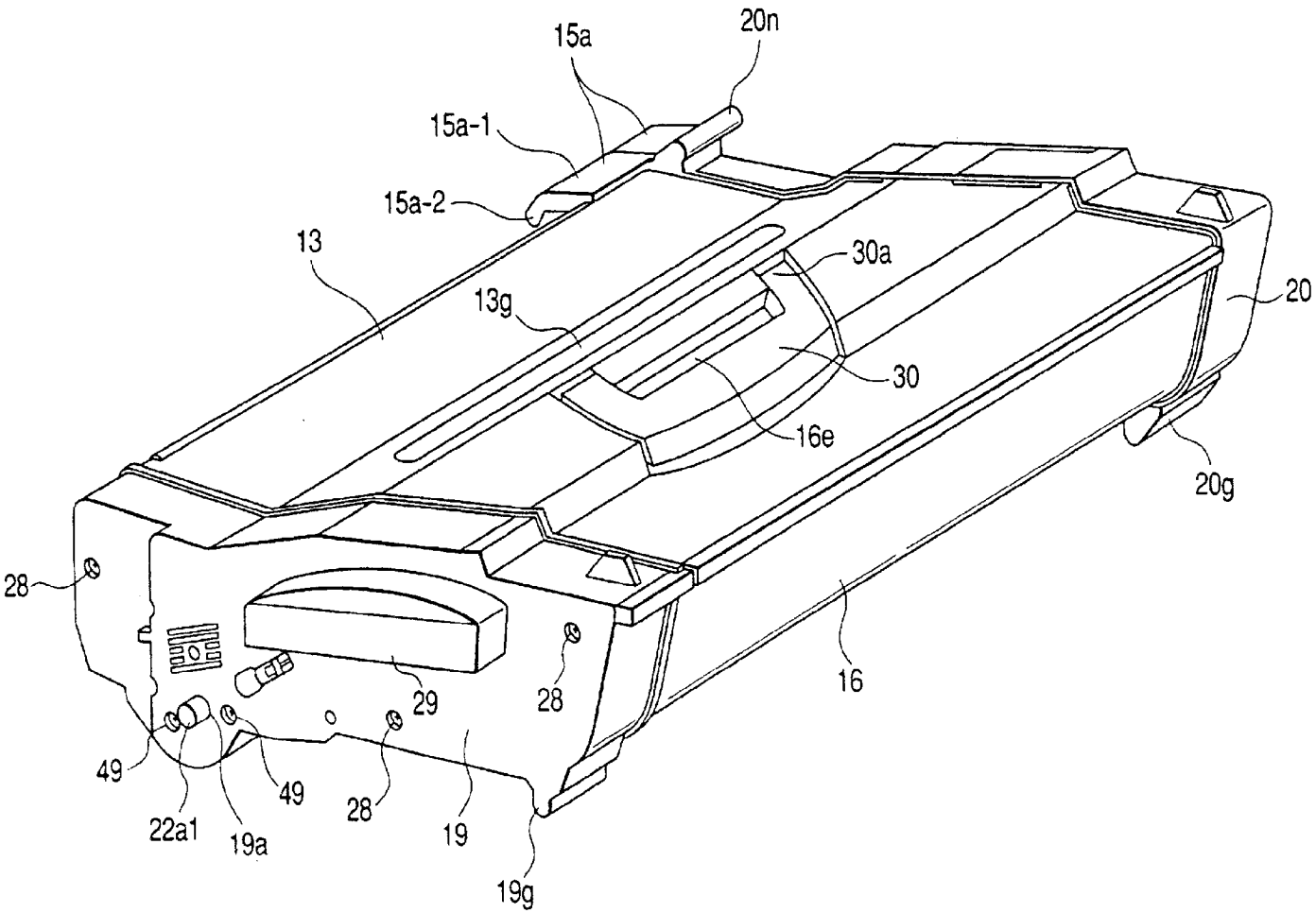
FIG. 5 is a perspective view as viewed from the front upper-right of the process cartridge in a mounting direction.
Figures 6A, 6B:
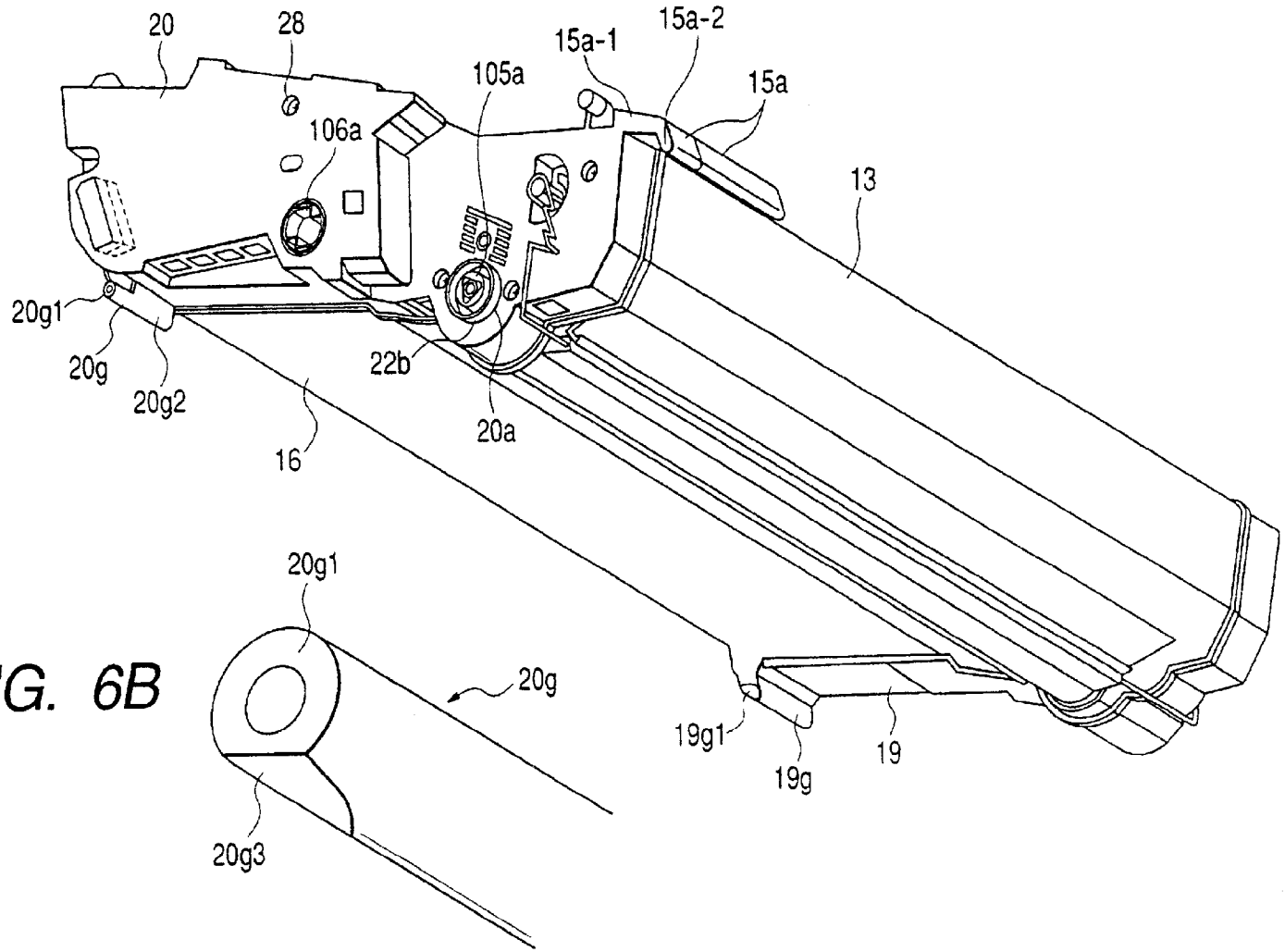
FIG. 6A is a perspective view as viewed from the lower right of the process cartridge in a direction opposite to the mounting direction.
FIG. 6B is an enlarged view showing a protrusion of the second guide portion.
Figure 7:
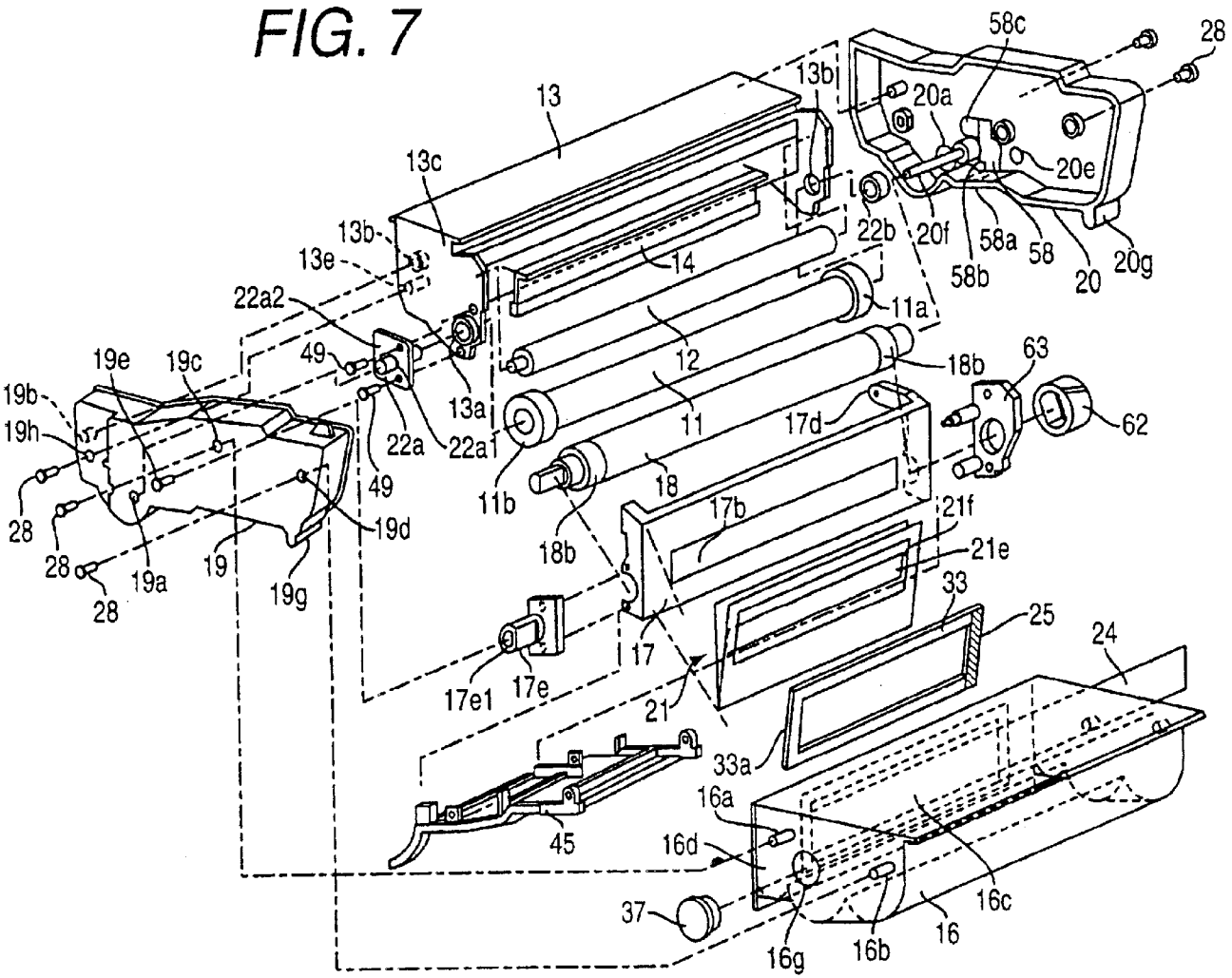
FIG. 7 is a disassembled perspective view of the process cartridge.
Figure 8:
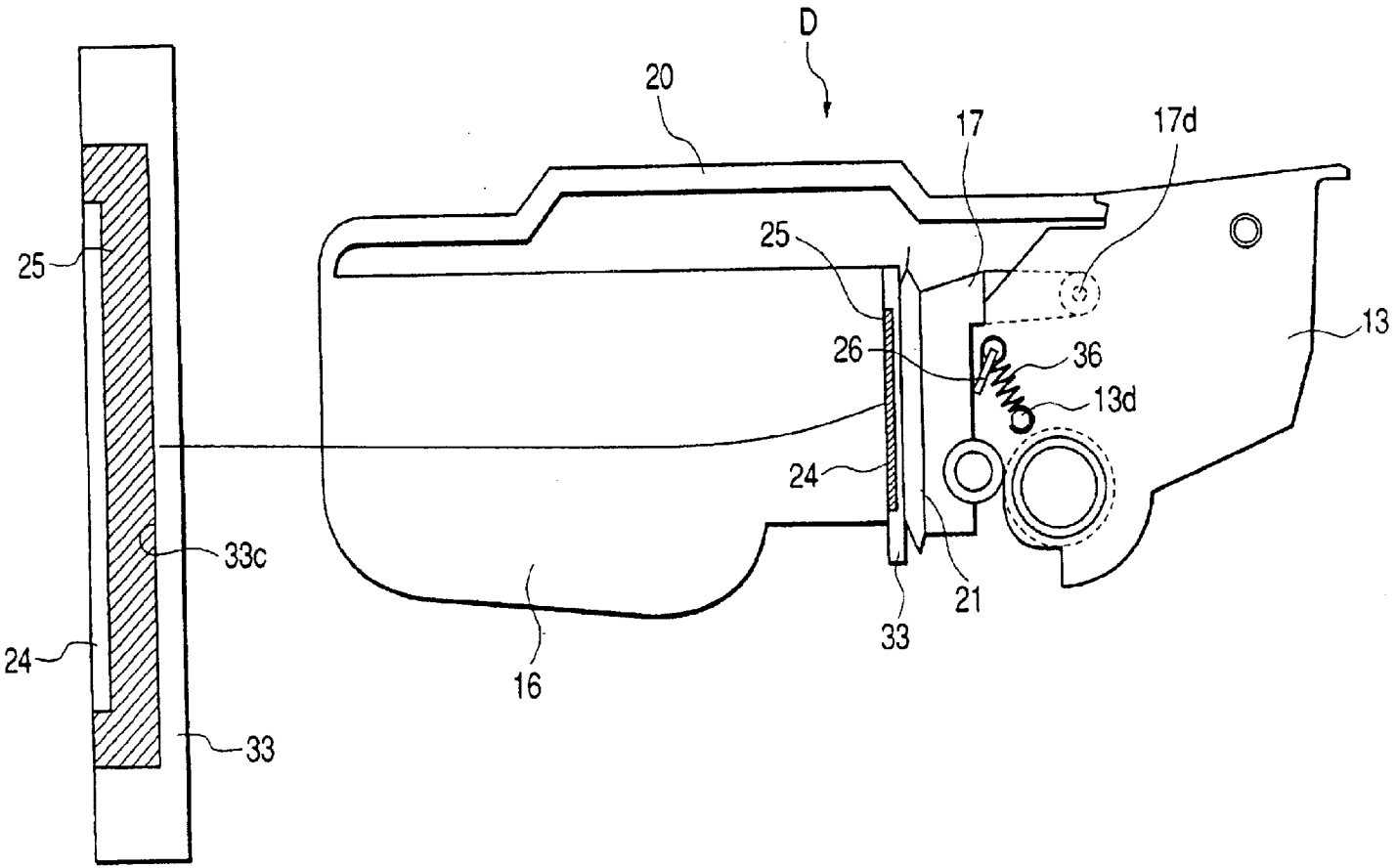
FIG. 8 is a substantially back view of the process cartridge from which a side cover has been detached.

FIGS. 3 to 9, 47, and 48 each show the constructions of frames of the process cartridge. FIG. 7 shows a state before these frames are assembled and FIGS. 3 to 6A each show a state after these frames are assembled. As cartridge frame, the process cartridge 15 includes three frames: a cleaning frame 13 integrally supporting the photosensitive drum 11, the charging member 12, and the cleaning member 14; a developing frame (also called the "developing frame") 17 integrally supporting the developing roller 18 and the developing blade (not shown in FIG. 7, see reference numeral 26 in FIG. 2); and a developer frame 16 comprising a developer container 16*h* that contains developer (hereinafter referred to as the "toner"). Note that the developer frame 16 is provided with a developing under cover 45. Further, to combine these three frames, both end surfaces of the cleaning frame 13 and the developer frame 16 are fixed using end covers 19 and 20 and the developing frame 17 is supported by the cleaning frame 13. Note that the frame supporting the photosensitive drum 11 is also called the "drum frame".

As described above, the process cartridge 15 includes the developing under cover 45. Here, when the process cartridge 15 is mounted to the apparatus main body 27, the developing under cover 45 is disposed at a position below the developing roller 18 and the developing blade 26 that are developing members. Also, this developing under cover 45 functions as a part of the external wall of the process cartridge 15. Further, one lengthwise end of the developing under cover 45 is connected to the rear end cover 19, and also, the other lengthwise end is connected to the front end cover 20.

Figure 3:
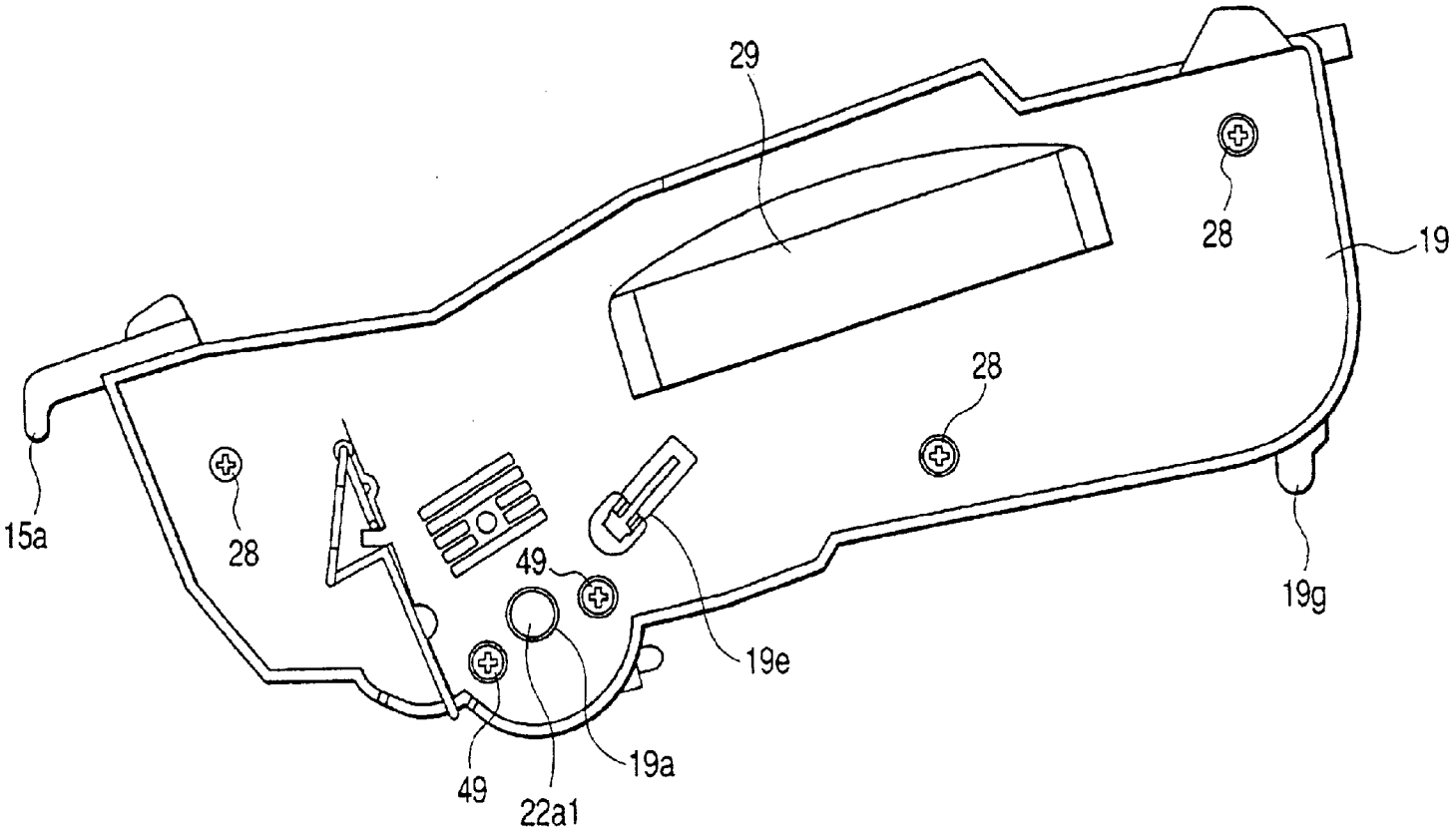
FIG. 3 is a front view of the process cartridge.

The rear end cover 19 includes a second handle 29, as shown in FIG. 3. Here, when the process cartridge is mounted to or detached from the apparatus main body 27, an operator grasps this second handle 29. Then, the process cartridge 15 is mounted to or detached from the apparatus main body 27 along the lengthwise direction of the photosensitive drum 11. Further, during the mounting, it is possible to insert the process cartridge 15 to the back of the apparatus main body 27 and lower the position of the process cartridge 15, thereby placing the process cartridge 15 at a mounting position. During the detachment, it is possible to lift up the process cartridge 15 and pull out the process cartridge 15.

The rear end cover 19 includes a hole portion 19*a*. Also, from the hole portion 19*a*, there protrudes a shaft 22*a*1 that extends outward concentrically with an axis functioning as a bearing of the photosensitive drum 11. Here, the shaft 22*a*1 is a part of a bearing member 22*a*, through which one end of the photosensitive drum 11 is supported by the cleaning frame 13. Also, when the process cartridge 15 is mounted to the apparatus main body 27, the shaft 22*a*1 is positioned in the apparatus main body 27. That is, the process cartridge 15 is inserted to the back of the apparatus main body 27 and the position thereof is lowered, whereby the shaft (positioning member) 22*a*1 that is integrated with the drum axis is fitted in a positioning concave portion (to be described later) of the apparatus main body 27. Also, during the mounting and detachment of the process cartridge 15 to and from the apparatus main body 27, second and third guide portions 20*g* and 19*g*, respectively, are supported by the apparatus main body 27.

Figure 47:
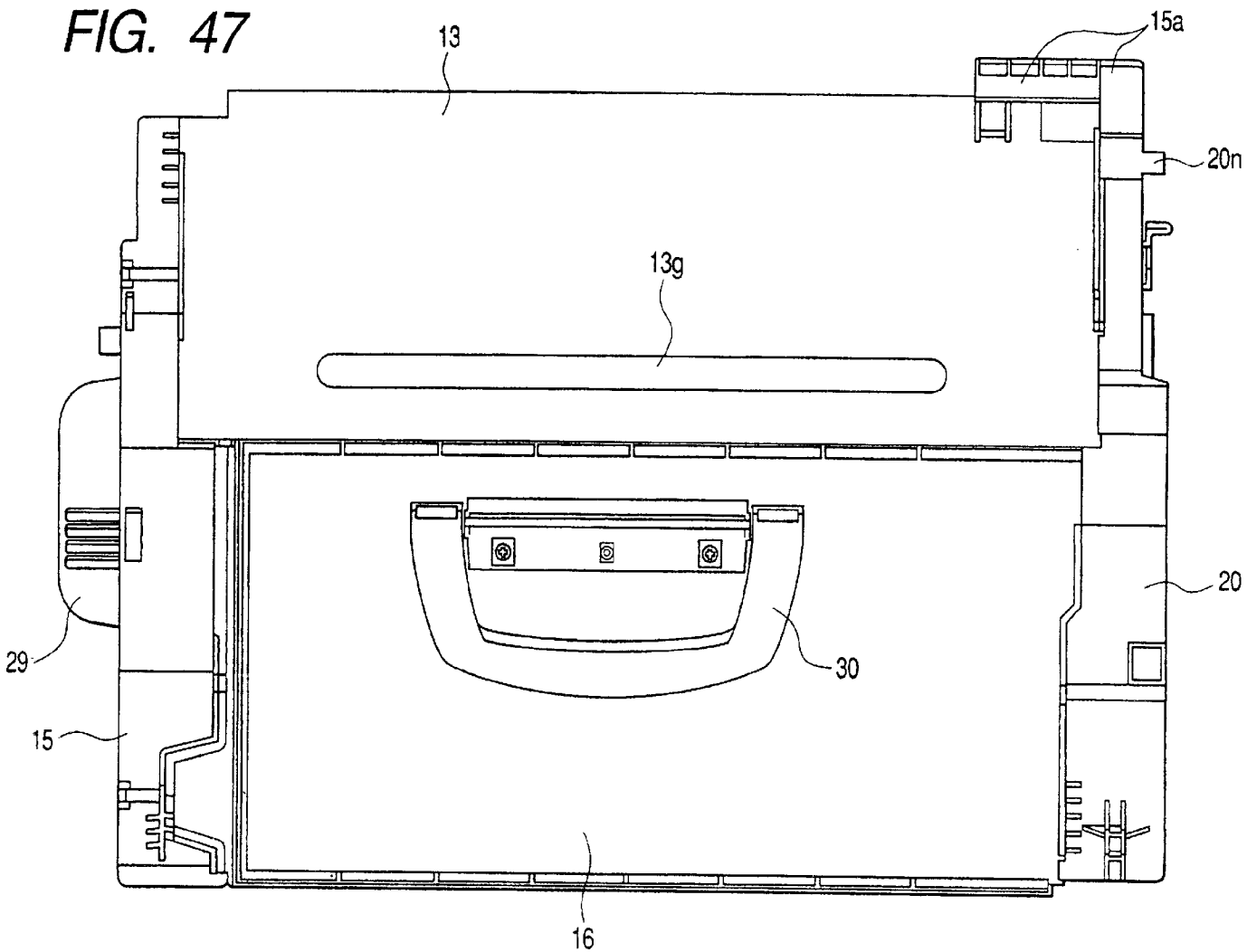
FIG. 47 is a plan view of the process cartridge.
Figure 48:
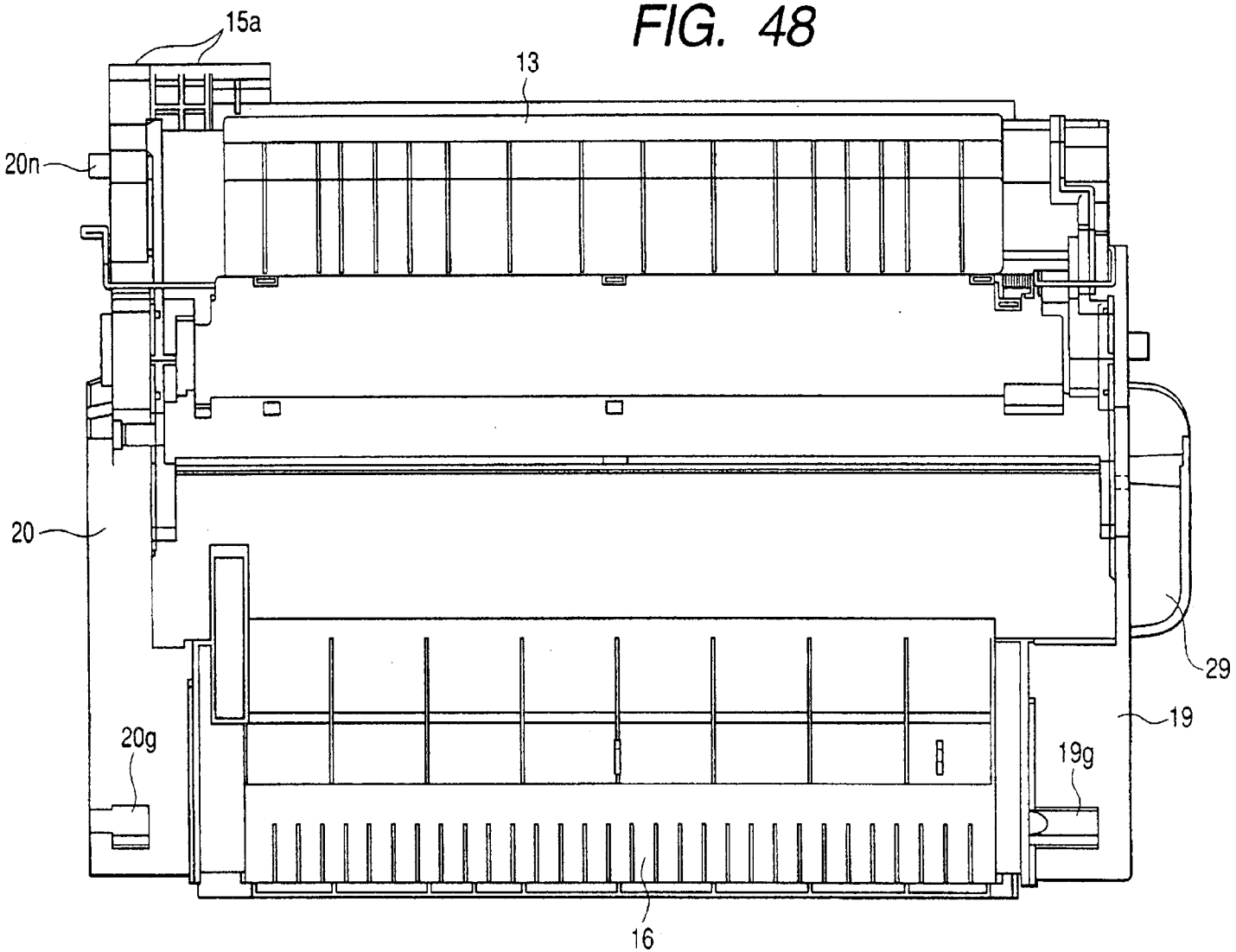
FIG. 48 is a bottom view of the process cartridge.

As shown in FIGS. 5 and 47, there is provided a first handle 30 on the upper surface of the developer frame 16. Here, the upper surface refers to the surface that faces upward when the aforementioned process cartridge 15 is mounted to the apparatus main body 27. Also, to transport the process cartridge 15, an operator grasps the first handle 30. This first handle 30 is contained in a concave portion 16*e* on the upper surface of the developer flame 16 and a base portion 30*a* of the first handle 30 is pivotally attached to the developer frame 16 with pins (not shown) that are parallel in the lengthwise direction. When an operator uses the first handle 30, he/she rotates the first handle 30 about the pins to make it stand.

As shown in FIGS. 2 and 5, the cleaning frame 13 includes an exposure opening 13*g*. Here, when the process cartridge 15 is mounted to the apparatus main body 27, information light to irradiate the photosensitive drum 11 by the exposure device 8 of the apparatus main body 27 passes through the exposure opening 13*g*.

Figure 4:
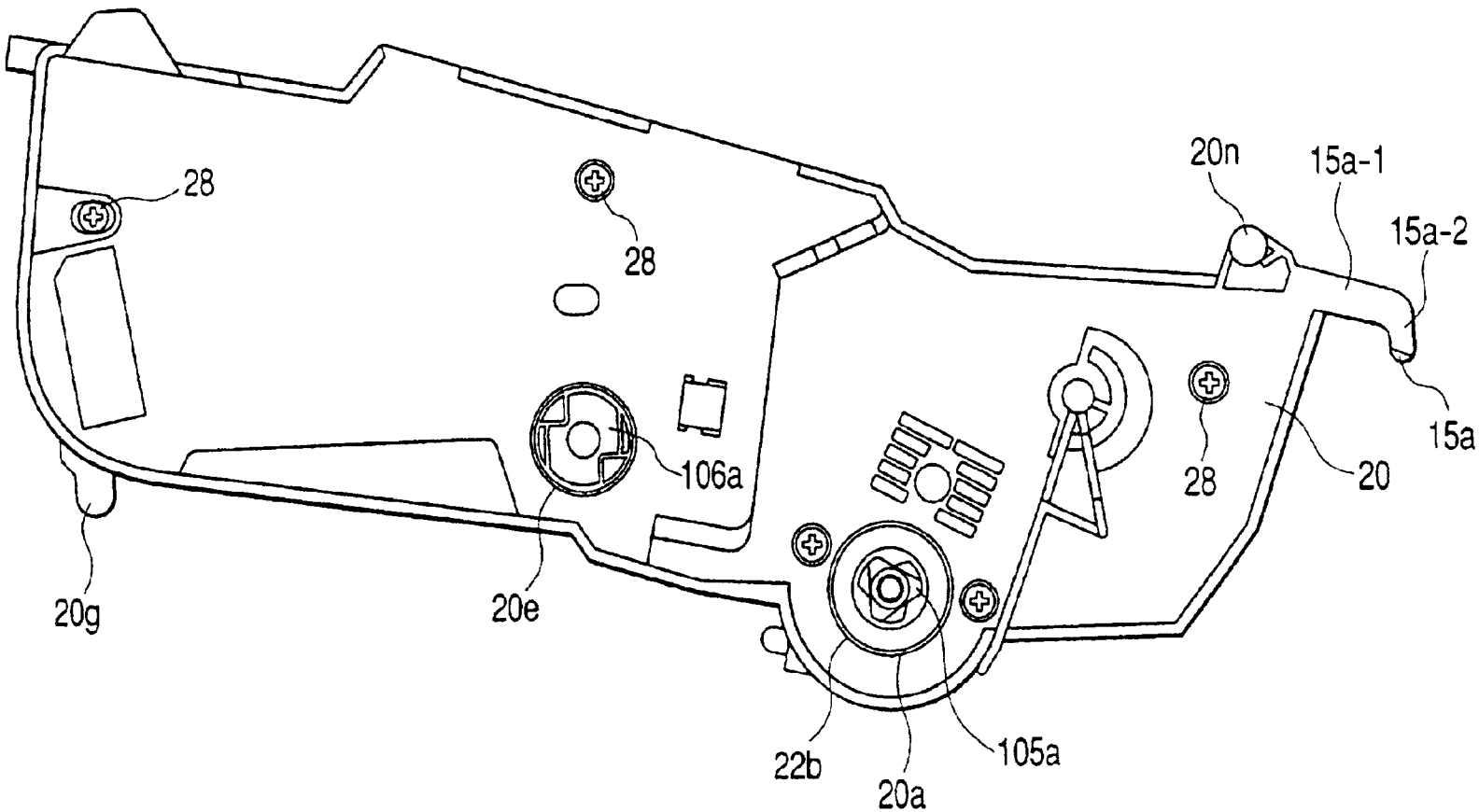
FIG. 4 is a side view of the process cartridge.

As shown in FIGS. 4 and 7, the front end cover 20 includes a first hole portion 20*a* and a second hole portion 20*e*. Also, the first hole portion 20*a* is provided with a first coupling 105*a* functioning as a first driving force receiving portion that receives a driving force to rotate the photosensitive drum 11 from the apparatus main body 27 when the process cartridge 15 is mounted to the apparatus main body 27. This first coupling 105*a* is integrally formed with a flange 11*a* shown in FIG. 7. This flange 11*a* is fixed to one end of the photosensitive drum 11. Also, the second hole portion 20*e* is provided with a second coupling or input coupling 106*a* functioning as a second driving force receiving portion that receives a driving force to rotate agitating members 113, 114, and 123 (see FIG. 2) that are toner supplying members for supplying toner contained in the developer container 16*h* of the developer frame 16 from the apparatus main body 27 when the process cartridge 15 is mounted to the apparatus main body 27. The developing frame 17 will be described in detail later.

The end covers 19 and 20 each have a sufficient size to cover the main cross section (the vertical surface perpendicular to the lengthwise direction of the photosensitive drum) of the process cartridge 15. Also, these end covers are arranged at both lengthwise ends of the process cartridge 15. Further, these end covers each have a sufficient size to cover both of the cleaning frame 13 and the developer frame 16 and are each fixed to both of the cleaning frame 13 and the developer frame 16, thereby integrally combining the cleaning frame 13 and the developer frame 16 with each other.

The hole portions 19*a* and 20*a* of these end covers 19 and 20 shown in FIG. 7 are positioned coaxially with the center of the photosensitive drum of the cleaning frame 13. On the illustrated rear end cover 19 side, as shown in FIG. 7, a bearing member 22*a* is press-fitted in a hole portion 13*a* of the cleaning frame 13. Also, putting through a flange 22*a*2, small screws 49 are screwed into the cleaning frame 13. The bearing member 22*a* is integrally provided with the flange 22*a*2 and a shaft 22*a*1. A tip side of the shaft 22*a*1 press-fitted in the hole portion 13*a* slides into the center hole of a flange 11*b*. This flange 11*b* is put in and fixed to one end of the photosensitive drum 11. When doing so, the rear end cover 19 is positioned through the shaft 22*a*1 protruding outside of the bearing member 22*a*, so that the rear end cover 19 is accurately positioned with respect to the photosensitive drum 11. Also, a positioning portion 19*b* that is a dowel provided at a position that is separated from the photosensitive drum 11 as far as possible is fitted in a positioning portion 13*b* that is a hole provided on a side surface 13*c* of the cleaning frame 13. With this construction, the position of the rear end cover 19 in a rotational direction is determined about the center of the photosensitive drum 11. Then, the rear end cover 19 is fixed to the lengthwise side surface 13*c* of the cleaning frame 13.

Further, the developer frame 16 is provided with cylindrical positioning portions 16*a* and 16*b* that protrude in the lengthwise direction from a lengthwise end surface 16*d* of the developer frame 16. Also, these positioning portions 16*a* and 16*b* are fitted in positioning portions 19*c* and 19*d* that are holes established in the rear end cover 19. With this construction, the developer frame 16 is positioned with respect to the rear end cover 19. Then, the developer frame 16 is fixed to the rear end cover 19. In a similar manner, the front end cover 20 that is the other end cover is positioned and fixed to the developer frame 16 and the cleaning frame 13. The developing frame 17 is positioned by a method to be described later. That is, the perimeter of a bearing member 22*b* press-fitted and fixed to the cleaning frame 13 is fitted in the hole portion 20*a* of the front end cover 20 and the bearing member 22*b* is allowed to partially protrude outward from the front end cover 20. Also, a bearing member 22 (22*a*, 22*b*) contributes to the positioning of the process cartridge 15 in the main body 27 of the image forming apparatus. That is, the bearing member 22 is a positioning portion of the process cartridge 15 and is a circular member.

(Method of Fixing Frame)

The main cartridge frame comprises the cleaning frame 13, the developer frame 16, the developing frame 17, and the end covers 19 and 20.

Prior to fixation of the cartridge frame, the cartridge frame is temporarily assembled. During this temporary assembling, the shaft 22*a*1 protruding from the cleaning frame 13 is fitted in a hole portion 19*a* of the rear end cover 19, the positioning portion (cylindrical dowel) 19*b* of the rear end cover 19 is fitted in the positioning hole 13*b* on the side surface of the cleaning frame 13, and the positioning portions 16*a* and 16*b* on the side surface of the developer frame 16 are fitted in the positioning portions (holes) 19*c* and 19*d* of the rear end cover. On the front end cover 20 side, in a similar manner, fitting between the front end cover 20 and the cleaning frame 13 and between the front end cover 20 and the developer frame 16 is performed. It is possible to perform temporary assembling in this manner, so that it becomes easy to perform handling prior to real assembling (fixing).

The fixation of the aforementioned rear end cover 19 to the cleaning frame 13 and the developer frame 16 is performed by putting small screws 28 through the positioning portions 19*c* and 19*d* and screwing the screws into the positioning portions 16*a* and 16*b*. Also, the small screw 28 is put through a hole 19*h* of the rear end cover 19 and is screwed into a dowel 13*e* of the cleaning frame 13. Note that the positioning portions 19*c* and 19*d* and the hole 19*h* are each a stepped hole whose outer side is a small hole. It is possible to put the small screws 28 through these small holes but the small holes are smaller than the positioning portions 16*a* and 16*b* and the dowel 13*e*. The combining and fixation of the cleaning frame 13 and the developer frame 16 using the front end cover 20 are performed in a similar manner in which the combining and fixation of the cleaning frame 13 and the developer frame 16 using the rear end cover 19 are performed.

Note that a resin bonding may be performed to combine the cleaning frame 13 with the developer frame 16 using the end covers 19 and 20. To perform this resin bonding, resin flow paths are formed along bonding regions, in which the end covers 19 and 20 are bonded to the cleaning frame 13 and the developer frame 16. The bonding regions are formed when these components are formed. Then, a flow path for injecting a resin is provided so as to reach from a gate of a fixture, which is different from a gate of a fixture used to form the end covers 19 and 20, to the formed resin flow paths, and a molten resin is injected and solidified. In this case, the process cartridge 15 is temporarily assembled and contained in the fixture used for the resin bonding.

To supply toner from the developer frame 16 to the developing roller 18, a developer supplying opening portion 16*c* (see FIG. 2) and a developer receiving opening portion 17*b* are respectively provided for the developer frame 16 and the developing frame 17. The developing frame 17 is coupled to the developer frame 16 using a flexible seal 21 (see FIG. 7) functioning as a sealing member, so that the opening portions 17*b* and 16*c* are connected to each other. Also, the developer frame 16 is positioned with respect to the end covers 19 and 20 and the developing frame 17 is positioned with respect to the cleaning frame 13. As a result, it is required that a space is maintained between the developing frame 17 and the developer frame 16 in view of dimensional errors. Then, the cartridge 15 is positioned and mounted in the cartridge mounting portion of the apparatus body 27 on the cleaning frame 13 side.

With this construction, even if the capacity of the developer container 16*h* is increased and the contained quantity of developer is increased in the cartridge 15, a load due to toner is placed on the end covers 19 and 20 and is not placed on the developing roller 18 supported by the developing frame 17. As a result, it becomes possible to obtain stable images without placing an additional load on the photosensitive drum 11.

(Method of Attaching Flexible Seal to Developing Frame and Developer Frame)

This embodiment relates to a construction in which a space between the developing device D and the developer frame 16 is sealed up. With this sealing construction, a flexible seal 21 having a folded shape is laminated as a sealing member. The flexible seal 21 is attached to the developer frame 16 through a place-shaped member 33 functioning as a connecting member. In this case, the flexible seal 21 has a thickness of 1 mm or less, although the thickness may be set to 1 mm or more by selecting a material that does not lose its flexibility in a folded shape.

Figure 10:
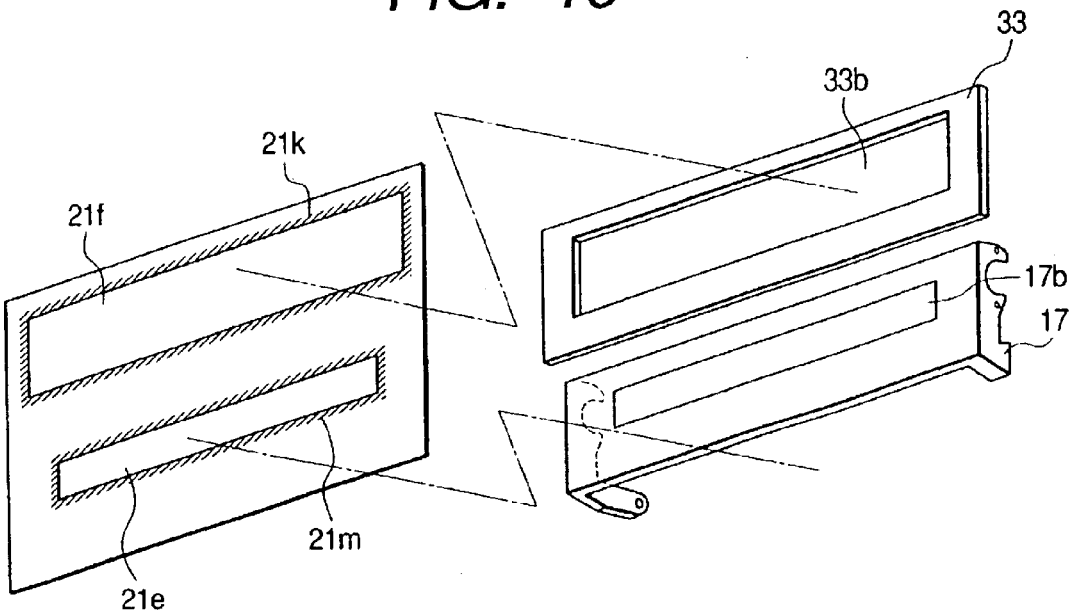
FIG. 10 is a perspective view illustrating a sheet member that seals a space between a toner container and a developing frame.

Next, a method of attaching the flexible seal 21 will be described with reference to FIGS. 10 and 11. As shown in FIG. 10, the flexible seal 21 includes the first opening 21*e* and the second opening 21*f*. The areas of these openings 21*f* and 21*e* are approximately the same as those of a connecting member opening 33*b* of the plate-shaped member 33 and the developer receiving opening portion 17*b* of the developing frame 17 or are the same as or larger than those of the opening 33*b* and the portion 17*b*.

The flexible seal 21 is bonded to the plate-shaped member 33 and the developing frame 17, with the first bonding portion 21*k* and the second bonding portion 21*m* having a closed shape (the diagonally shaded areas in FIG. 10) being placed around the rims of the connecting member opening 33*b* and the developer receiving opening portion 17*b*. As a result, as shown in FIG. 11, the first opening 21*e* of the flexible seal 21 forms a single through hole with the developer receiving opening portion 17*b* of the developing frame 17, and the second opening 21*f* of the flexible seal 21 forms a single through hole with the connecting member opening 33*b* of the plate-shaped member 33.

In this embodiment, the flexible seal 21 is bonded to the developer frame 16, the developing frame 17, and the plate-shaped member 33 by performing thermal welding using a heat seal method, an impulse seal method, or the like. However, there may be alternatively used ultrasonic welding, a gluing agent, or an adhesive tape.

Figure 11:
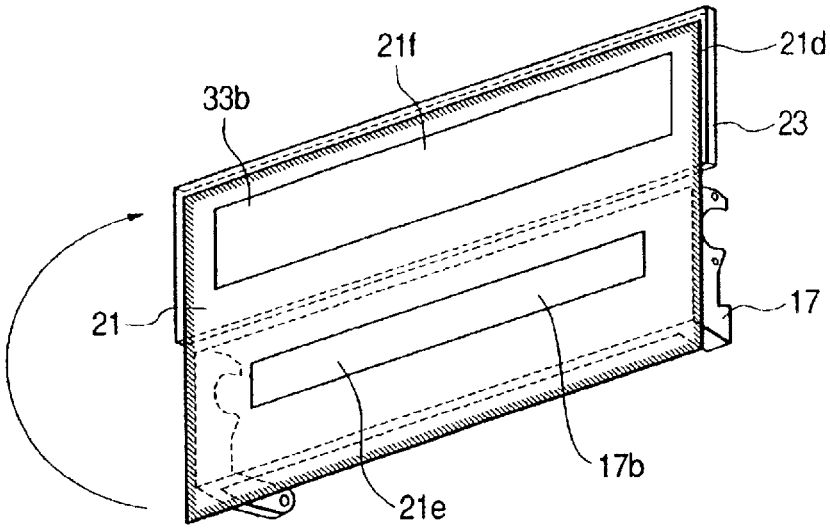
FIG. 11 is another perspective view illustrating the sheet member that seals the space between the toner container and the developing frame.

Next, as shown in FIG. 11, after the flexible seal 21 is stuck onto the developing frame 17 and the plate-shaped member 33, the resulting member is bent in the arrow direction so that the developer receiving opening portion 17*b* and the connecting member opening 33*b* face each other with the flexible seal 21 therebetween. In this manner, a folded shape (bag shape) is formed and end portions 21*d* (diagonally shaded portions) that are the outer rims of surfaces contacting each other after the bending are bonded to each other and are sealed. In this case, a gluing agent, an adhesive tape, ultrasonic welding, or thermal welding, such as a heat seal method or an impule seal method, may be used as a sealing means.

Next, the plate-shaped member 33 is attached to the developer frame 16. When doing so, however, a part of the plate-shaped member 33 is not welded or bonded in order to allow a developer seal 24 to pass therebetween.

In the embodiment, as shown in FIG. 7, there is obtained a construction in which a portion 33*a* is welded and an area, in which a toner sealing member 25 presses the developer seal 24, and which is not welded or bonded. Here, the portion 33*a* includes areas on both lengthwise sides and at one widthwise end of one surface of the plate-shaped member 33.

With this construction, even if the distance between opposing surfaces of the developer flame 16 and the developing frame 17 varies, the flexible seal 21 functioning as a sealing member maintains the folded shape or the bag shape. As a result, it becomes possible to extremely reduce resistance that occurs during displacements. Also, by attaching the flexible seal 21 between the plate-shaped member 33 and the developing frame 17, it becomes possible to place the components so that the developer seal 24 is surrounded by the plate-shaped member 33. Also, it becomes possible to attach the toner sealing member 25 to the plate-shaped member 33 so that a space, through which the developer seal 24 passes, is sealed. As a result, there is prevented the leakage of toner.

Further, when the sheet member and the developer frame are sealed on the same plane, the plate-shaped member makes it possible to simplify the shape of a welding stand necessary for welding, in comparison with a case where the sheet member is directly laminated onto the main body of the developer frame 16.

Further, the plate-shaped member 33 makes it possible to integrate the sheet member with the developing frame 17 as a unit and to attach the sheet member to the developer frame 16 without difficulty.

Next, a method of attaching the flexible seal to the developing frame and the developer frame will be described.

In the embodiment, the flexible seal 21 has a thickness of 0.1 mm or less. When the flexible seal 21 is used, a released paper is removed. This means that the flexible seal 21 is a monolayer sheet member. It is possible to realize a flexible seal with lower rigidity by selecting a monolayer sheet member.

Figure 12:
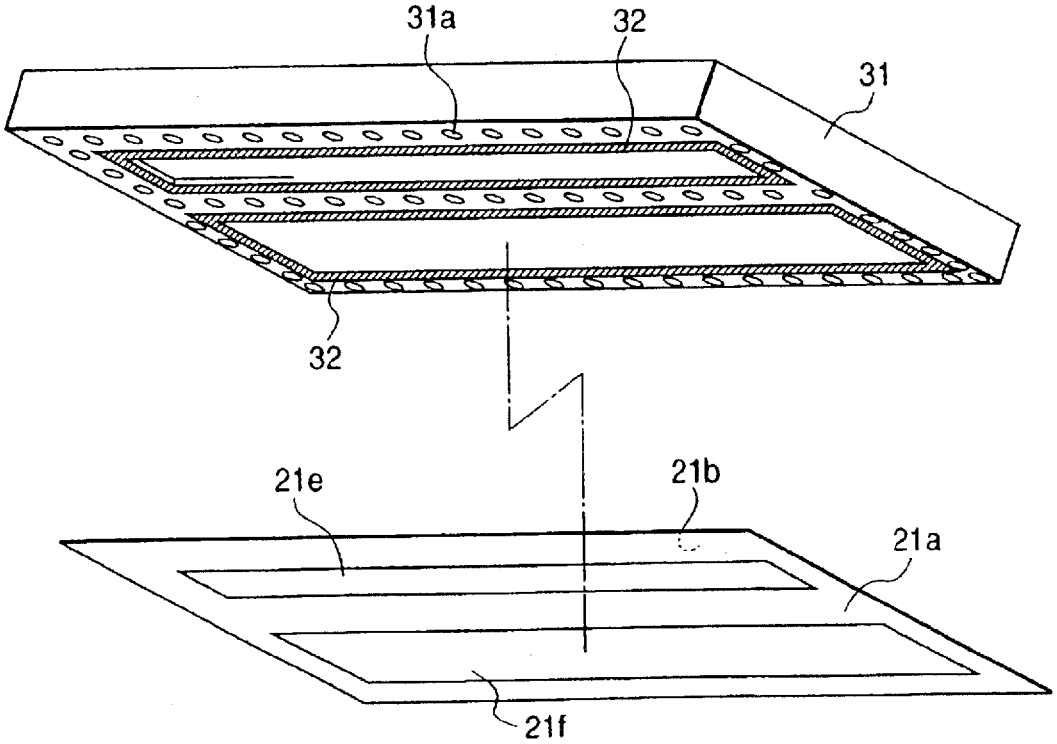
FIG. 12 is a perspective view showing how the sheet member is applied.

As shown in FIG. 12, the flexible seal 21 in this embodiment is composed of a layer 21*a* having flexibility and a released paper 21*b* that is more rigid than the layer 21*a*. The layer 21*a* is made of PET (polyethylene terephthalate), PP (polypropylene), ONy (biaxial oriented nylon), a heat seal member, an esther base resin, ethylene-vinyl acetate (EVA), a polyurethane base resin, a polyester base resin, or an olefin base resin.

Next, a method of forming the folder shape will be described.

Figure 13:
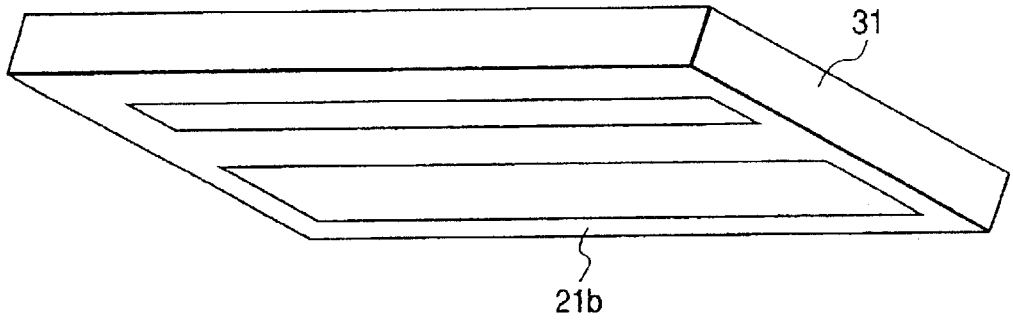
FIG. 13 is another perspective view showing how the sheet member is applied.
Figure 14:
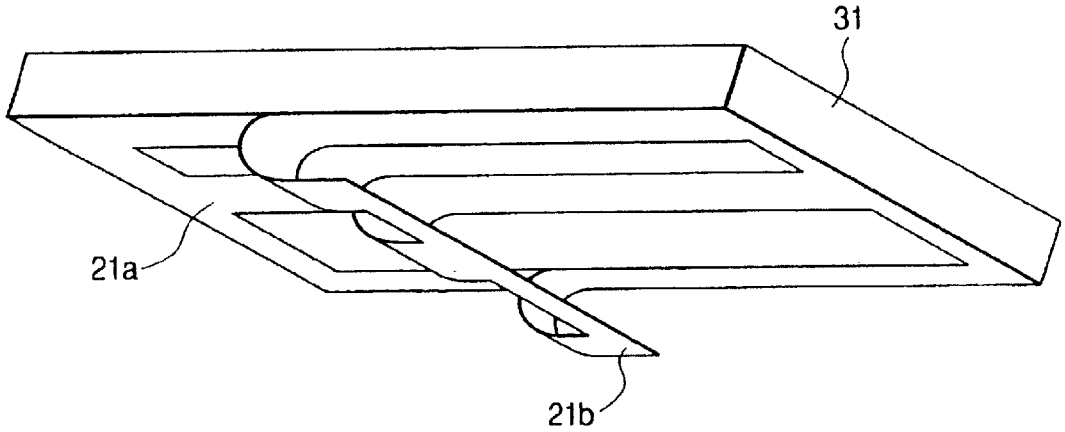
FIG. 14 is still another perspective view showing how the sheet member is applied.

As shown in FIG. 12, orifice holes 31*a* used for sheet member suction are established in an attachment and holding member 31. Also, these orifice holes 31*a* communicate with an unillustrated vacuum pump apparatus. The layer 21*a* of this flexible seal 21 is vacuum-suctioned by the plurality of orifice holes 31*a* and is held by the attachment and holding member 31, as shown in FIG. 13. Note that the surface of the attachment and holding member may be charged. In this case, the sheet member sticks to the attachment and holding member due to static electricity. After the suction, the released paper 21*b* that is the second layer of the flexible seal 21 is peeled off and only the layer 21*a* (flexible seal 21) remains on the attachment and holding member 31, as shown in FIG. 14.

Figure 15:
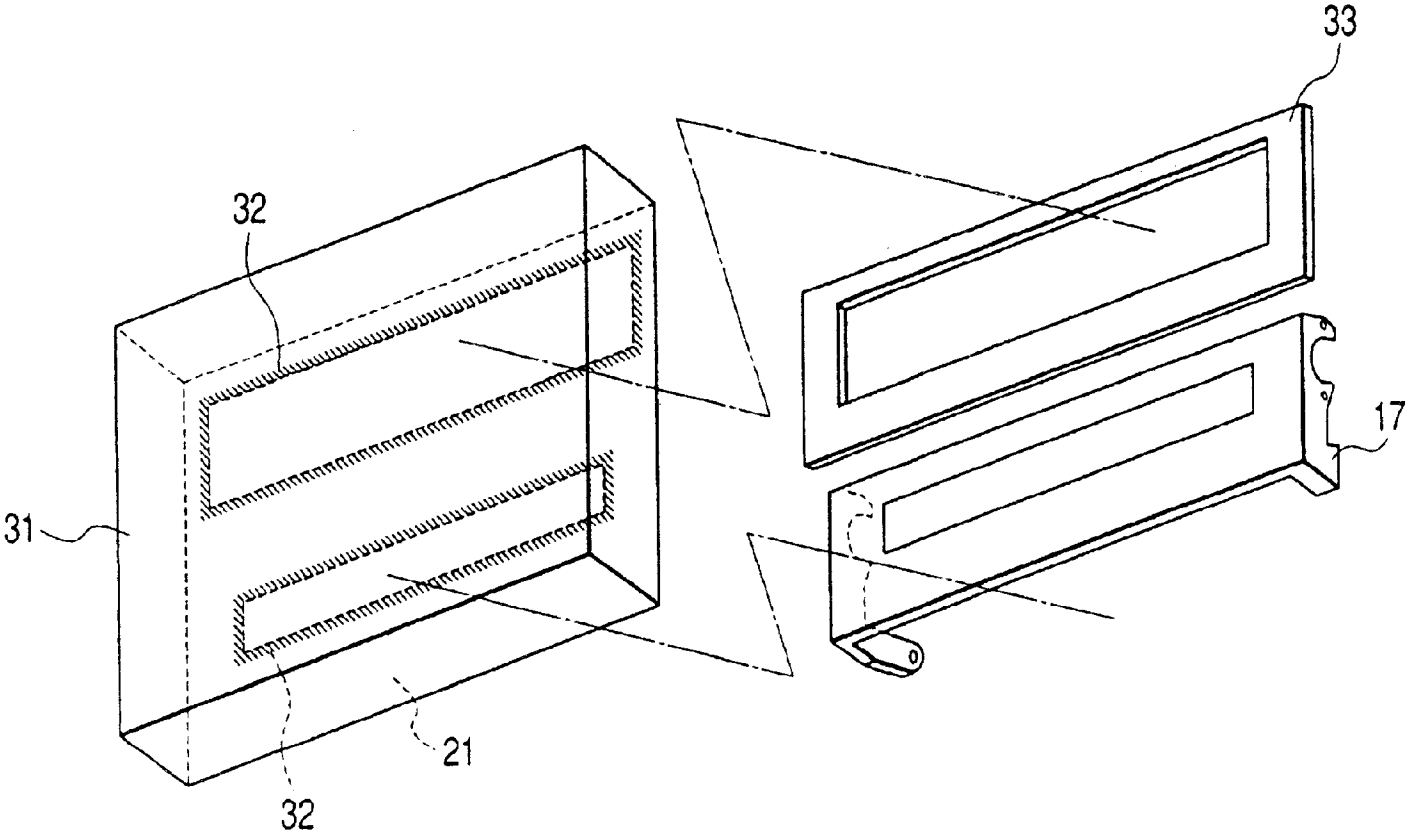
FIG. 15 is also a perspective view showing how the sheet member is applied.

As shown in FIG. 12, the attachment and holding member 31 is provided with heating elements 32 used for the impulse seal method. Next, as shown in FIG. 15, after the flexible seal 21 held by the attachment and holding member 31 is pressed against the plate-shaped member 33 and the developing frame 17, current is instantaneously applied to the heating elements 32, which then generate heat. Following this, the heating elements 32 are immediately cooled. As a result, the flexible seat 21 is welded to the plate-shaped member 33 and the developing frame 17. Following this, the vacuum suction is stopped, the attachment and holding member 31 is lifted up and is separated from the flexible seal 21 welded to the developing frame 17 and the plate-shaped member 33. Note that the plate-shaped member 33 functions as a part of the developer frame 16. That is, the connecting member opening 33*b* of the plate-shaped member 33 is substantially an opening portion of the developer frame 16.

Note that the welding of this flexible seal 21 to the plate-shaped member 33 and the developing frame 17 is performed so that this seal is bonded in areas having a closed shape in the vicinity of the connecting member opening 33*b* and the developer receiving opening portion 17*b*.

Next, as shown in FIG. 11, after being stuck on the developing frame 17 and the plate-shaped member 33, the flexible seal 21 is bent in the arrow direction so that the first opening 21*e* and the second opening 21*f* face each other. In this manner, there is formed the folded shape (bag shape). Then, end portions 21*d* (diagonally shaded portions) of surfaces, which contact each other after the bending, are bonded to each other and sealed. One fold is formed for this folded shape. However, a plurality of folds may be formed to obtain an accordion-like folded shape.

In this embodiment, an ester base seal film is used as the layer 21*a* of the sheet member. However, a hot-melt sheet, such as an EVA (ethylene-vinyl acetate copolymer) sheet, may be instead used.

Also, in this embodiment, the flexible seal 21 is composed of the monolayer 21*a*, so that there is a danger that the flexible seal 21 is welded to heating areas in the case of a heat seal method with which heat is generated at all times. However, a desired attachment operation becomes possible by performing the welding with an impulse seal method with which it is possible to perform heating, cooling, and holding in a short time.

Further, as another embodiment, there may be instead used an ultrasonic welding method with which heat is instantaneously generated, a gluing agent that is not accompanied by heat generation, an adhesive tape, and the like.

The assembling is performed in this manner, so that even if the flexible seal is very thin and therefore it is difficult to stick the flexible seal without creases, the shape of the flexible seal is stabilized by removing the peeling sheet after suction. Therefore, it becomes possible to perform welding at desired positions.

Also, as still another embodiment, even if a sheet member composed of a plurality of layers is used instead of the aforementioned flexible seal, it is possible to apply the aforementioned attachment method.

Next, the plate-shaped member 33 is attached to the developer frame 16. When doing so, a part of an attachment portion is not welded or bonded in order to allow the developer seal 24 to pass therebetween.

In the embodiment, as shown in FIG. 7, there is obtained a construction in which the portion 33*a* is welded and an area, in which the toner sealing member 25 presses the developer seal 24, is not welded or bonded.

Here, the toner sealing member 25 is an elastic member, such as felt, and is provided at one lengthwise end of the plate-shaped member 33 so that the toner sealing member 25 is long and narrow in the widthwise direction. A concave portion 33*c* is established on a plate surface of the plate-shaped member 33 and the toner sealing member 25 is stuck on the bottom surface of the concave portion 33*c* (see FIG. 8).

With this construction, even if the distance between opposing surfaces of the developer flame 16 and the developing frame 17 varies, the flexible seal 21 maintains the folded shape or the bag shape. Also, the flexible seal 21 is composed of a thin flexible seat, so that it becomes possible to extremely reduce resistance occurring during displacements of the developing frame 17.

(Another Embodiment of Seal Member Sealing Between Developer Frame and Toner Container Frame)

Figure 16:
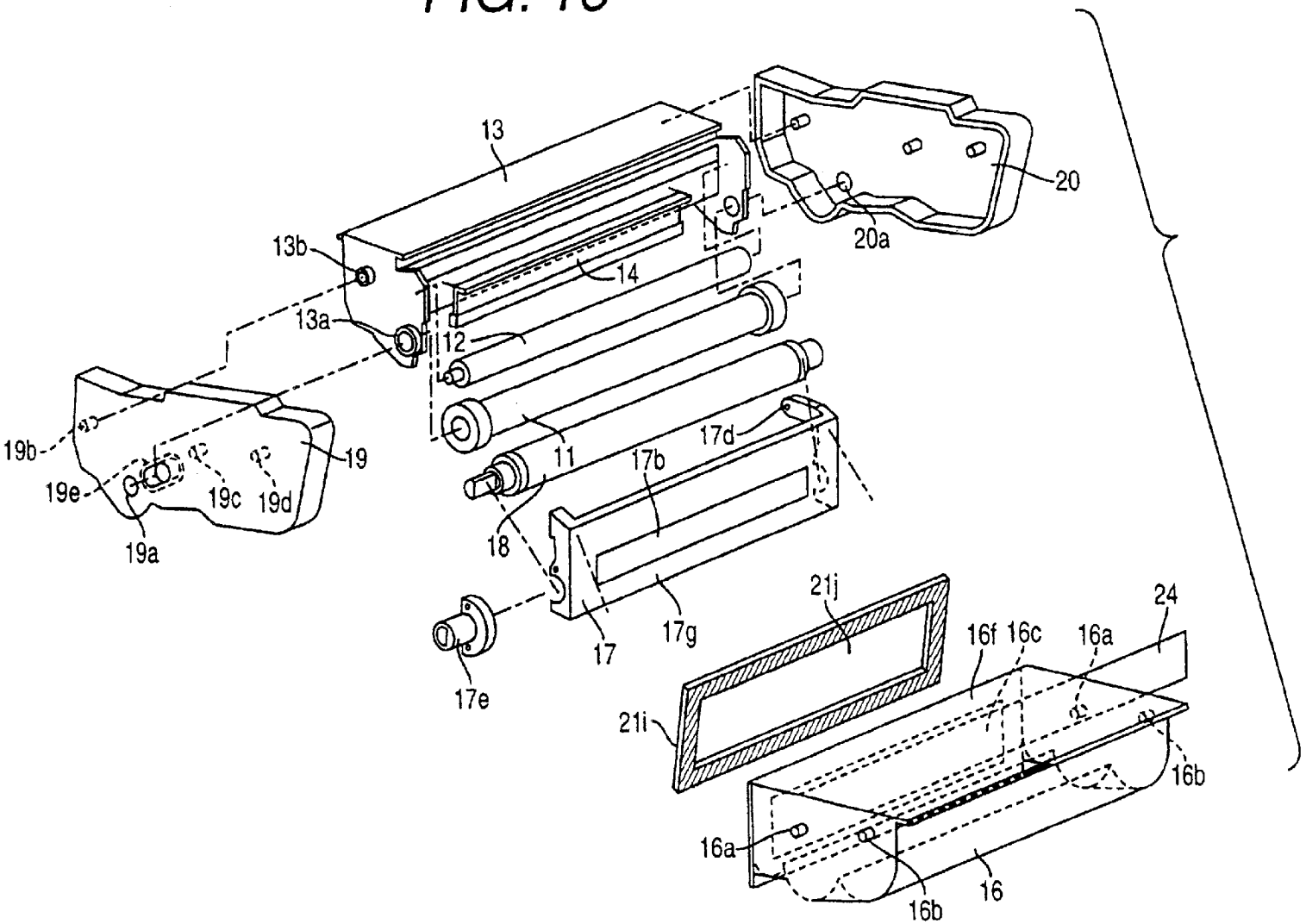
FIG. 16 is a disassembled perspective view of the process cartridge provided with a sheet member according to another embodiment that seals the space between the toner container and the developing frame.

FIG. 16 is a disassembled perspective view illustrating another embodiment of this seal member. In FIG. 16, FIG. 7 is simplified and a seal member differing from that shown in FIG. 7 is illustrated.

Figure 17:
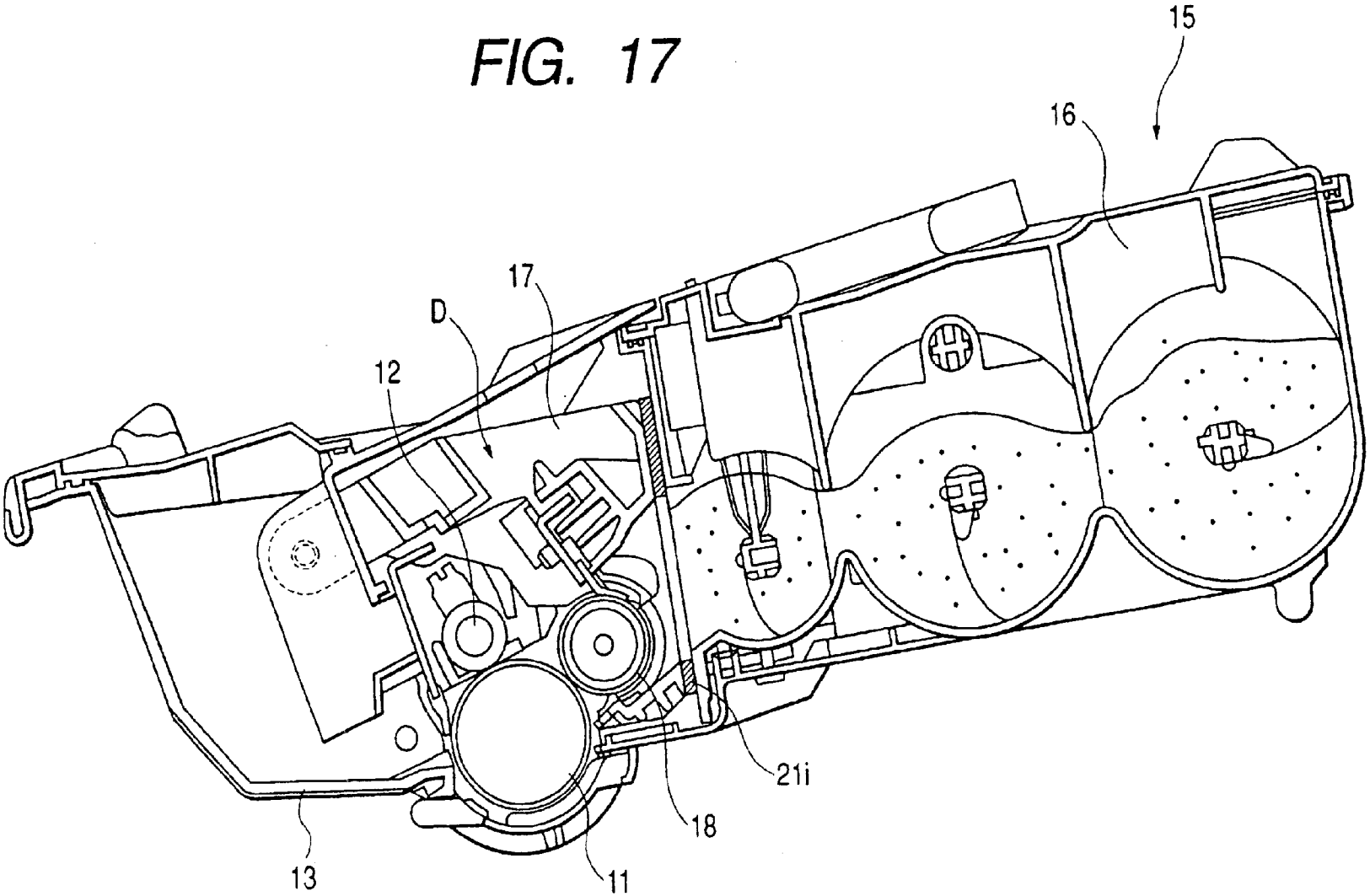
FIG. 17 is a vertical cross-sectional view of the process cartridge provided with the sheet member according to the other embodiment that seals the space between the toner container and the developing frame.

FIG. 17 is a vertical cross-sectional view of the process cartridge.

A sheet member 21*i* is made of synthetic resin foam that is a flexible material, such as urethane foam, low hardness rubber, or silicon. The sheet member 21*i* has a plate shape and includes an opening portion 21*j*. When the sheet member 21*i* is attached, this opening portion 21*j* coincides with each of the developer receiving opening portion 17*b* of the developing frame 17 and the developer supplying opening portion 16*c* of the developer frame 16. The opening portion 21*j* of the sheet member 21*i* is approximately equal to the opening portions 17*b* and 16*c*. The sheet member 21*i* is stuck on at least one of the opposing surfaces of the developing frame 17 and the developer frame 16. Note that the sheet member 21*i* is not stuck to the developer frame 16 in an area through which the developer seal 24 is pulled to the outside.

Under an assembled condition, the thickness of this sheet member 21*i* is greater than a distance between an opposing surface 17*g*, which opposes the developer frame 16 and exists around the developer receiving opening portion 17*b* of the developing frame 17, and an opposing surface 16*f*, which opposes the opposing surface 17*g* and exists around the developer supplying opening portion 16*c* of the developer frame 16.

Accordingly, in the cartridge 15 assembled in the manner shown in FIG. 17, the sheet member 21*i* is pinched by the opposing surface 17*g* of the developing frame 17 and the opposing surface 16*f* of the developer frame 16. The reaction force generated by the pinching of this sheet member 21*i* acts as a pressurizing force with which a spacer roller 18*b* (FIG. 7) of the developing roller 18 is pressed against the photosensitive drum 11. Therefore, it is preferable that the spring force of the sheet member 21*i* is reduced as small as possible.

With this sheet member 21*i*, it becomes possible to eliminate the plate-shaped member 33 described in the aforementioned embodiment and therefore it becomes easy to assemble the components.

(Developer Seal)

After the developer supplying opening portion 16*c* of the developer frame 16 is sealed, the developer seal 24 is bent so as to overlap the sealed part, thereby obtaining a part of the developer seal 24 that protrudes to the outside on a side opposite to the bending position, as shown in FIG. 7. Before the developer seal 24 is attached, the agitating member 113, 114, and 123 are mounted. After the developer seal is attached, toner is loaded into the developer frame 16 through a toner loading opening 16*g*. After the toner loading, a toner cap 37 is press-fitted in the toner loading opening 16*g* and is fixed therein.

To summarize the description of the seal member, the developing frame 17 and the developer frame 16 are combined with each other by the flexible seal 21. Also, the flexible seal 21 is stuck onto the developing frame 17 and the plate-shaped member 33.

The flexible seal 21 has a first opening 21*f* and a second opening 21*e* as through holes. One of the through holes opposes the developer supplying opening portion 16*c* established in the developer frame 16 through the connecting member opening 33*b* of the plate-shaped member 33. Also, the other of the through holes opposes the developer receiving opening portion 17*b* established in the developing frame 17. Here, the developer supplying opening portion 16*c* is used to supply toner contained in the developer container 16*h* of the developer frame 16 toward a position at which the developing roller 18 that is a developing member is provided. Also, the developer receiving opening portion 17*b* is used to receive toner passing through the developer supplying opening portion 16*c*. Further, an area surrounding one of the through openings of the flexible seal member 21 is stuck onto the plate-shaped member 33. Also, an area surrounding the other of the through openings is stuck onto the developer frame 17. Here, the second opening 21*e* that is the one of the through holes opposes the developer receiving opening portion 17*b* of the developing frame 17, while the first opening 21*f* that is the other of the through holes opposes the developer supplying opening portion 16*c* of the developer frame 16 through the connecting member opening 33*b* of the plate-shaped member 33.

The flexible seal 21 has a bag shape. The first opening 21*f* and the second opening 21*e* are respectively provided on one surface and the other surface of the bag that face each other. The first opening 21*f* provided on the one surface opposes the developer supplying opening portion 16*c* provided for the developer frame 16 through the connecting member opening 33*b* of the plate-shaped member 33. Also, the second opening 21*e* provided on the other surface opposes the developer receiving opening portion 17*b* provided for the developing frame 17. Here, the developer supplying opening portion 16*b* is used to supply the toner contained in the developer frame 16 having the developer container 16*h* toward a position at which the developing roller 18 is provided. Also, the developer receiving opening portion 17*b* is used to receive the toner passing through the developer supplying opening portion 16*c*. The area surrounding the first opening 21*f* provided on the one surface of the flexible seal 21 is stuck onto the plate-shaped member 33 provided as a part of the developer frame 16. Also, the area surrounding the second opening 21*e* provided on the other surface is stuck on the developing frame 17.

The flexible seal 21 has at least one fold between the surfaces stuck onto the developing frame 17 and the developer frame 16. Also, the flexible seal 21 has a folded shape where one end is stuck onto the plate-shaped member 33 provided as a part of the developer frame 16 and the other end is stuck onto the developing frame 17.

The flexible seal 21 is formed using an elastic member or a heat seal member.

In contrast to the aforementioned embodiment, the material of the flat-shaped flexible sheet member 21*i* of the other embodiment of the flexible seal is urethane foam, low hardness rubber, silicon, or the like.

(Construction of Developing Device)

A tension coil spring 36 is provided to produce tension between the developing frame 17 and the cleaning frame (also called drum frame) 13. In this example, this construction is further developed.

Figure 18:
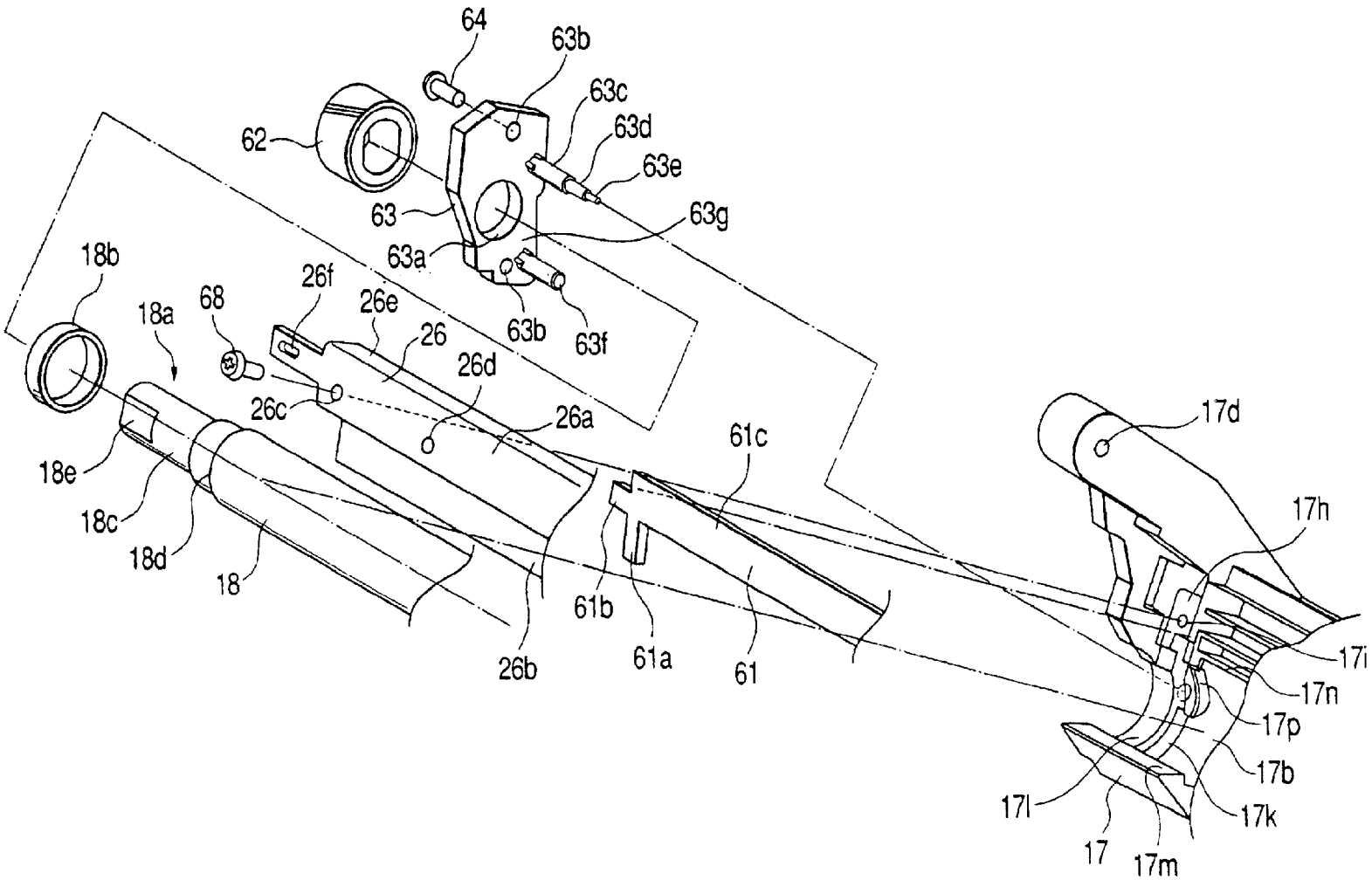
FIG. 18 is a disassembled perspective view of a developing device illustrating a construction of the connection between developing frame and a cleaning container.
Figure 19:
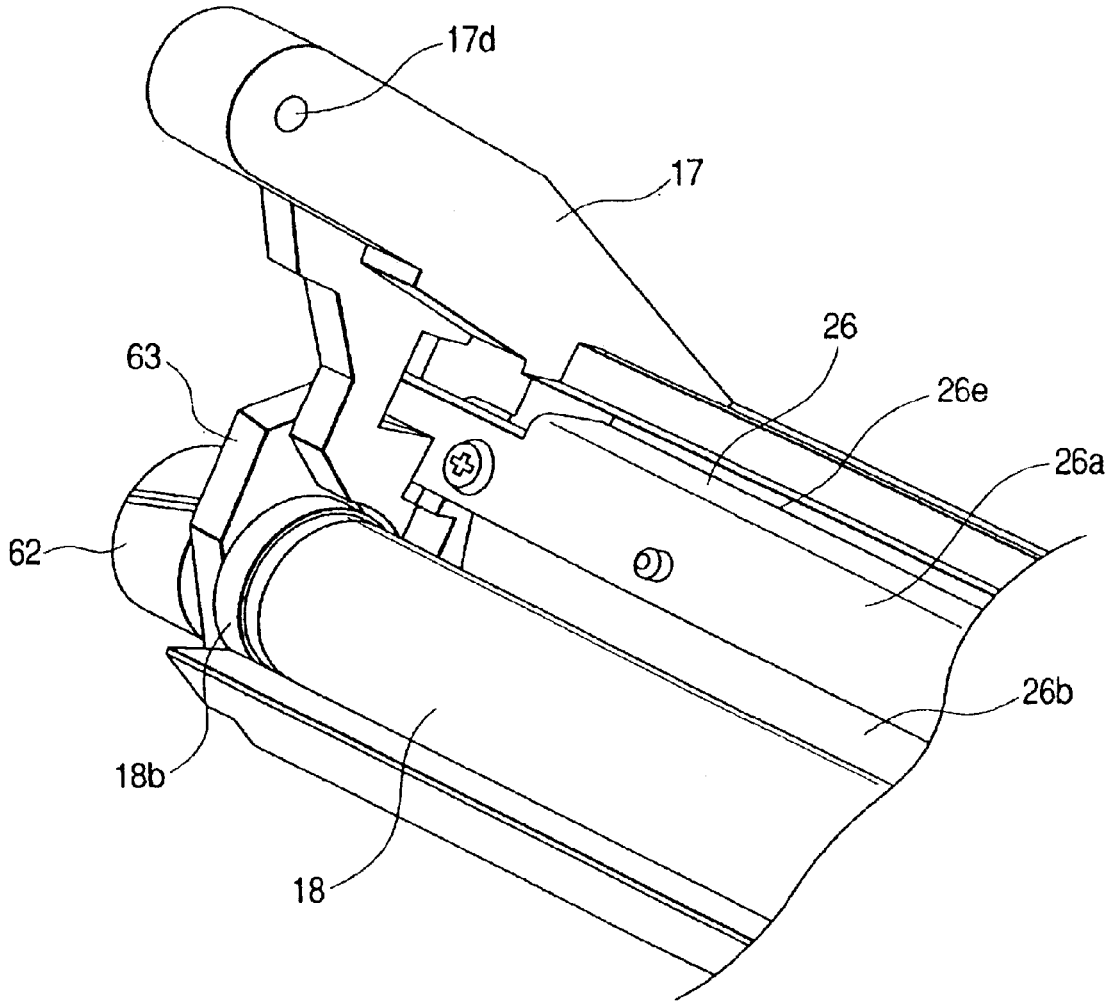
FIG. 19 is a partial perspective view of the developing device.

Next, the construction of the developing device will be described with reference to FIGS. 18 and 19. FIG. 18 is a perspective view showing a state before each component of the developing device is assembled, while FIG. 19 is a perspective view showing a state after each component of the developing device is assembled. In the developing frame 17, there are assembled the developing roller 18, the developing blade 26, and the like as construction elements related to image formation. Note that the description in this embodiment is limited to the front end cover 20 side that is the other side. The rear end cover 19 side that is the one side has the same construction. However, on the rear end cover 19 side, a sheet metal 26*a* does not protrude outside of the developing frame 17.

The developing blade 26 is obtained by fixing urethane rubber 26*b* to the sheet metal 26*a* having a thickness of around 1 to 2 mm using a hot melt sheet, a double-faced adhesive tape, or the like. This urethane rubber 26*b* contacts the generatrix of the developing roller 18, thereby regulating the amount of toner on the perimeter of the developing roller 18. The sheet metal 26*a* is a fixing member (supporting member) that integrally includes the urethane rubber 26*b* and is fixed to the developing frame 17. Also, the sheet metal 26*a* is a metal plate. The metal plate may be replaced with another material so long as the material has conductivity. Note that there is a case where silicon rubber is used as the developing blade 26. As shown in FIG. 18, an internal thread 17*i* is formed in a blade stand plane 17*h* that is provided for the developing frame 17 and functions as a blade attachment member. Also, a positioning dowel (not shown) is provided at an approximately center position. The dowel (not shown) of the developing frame 17 is fitted in a fitting hole 26*d* provided for the sheet metal 26*a*. Then, a small screw 68 is put through a screw hole 26*c* formed in the sheet metal 26*a* and is screwed into the internal thread 17*i*, thereby fixing the sheet metal 26*a* to the plane 17*h*. In this manner, the tip of the urethane rubber 26*b* is positioned, the abutting pressure given by the urethane rubber 26*b* to the developing roller 18 is determined, the distance from the tip of the urethane rubber 26*b* to the position, at which the urethane rubber 26*b* is made to abut against the developing frame 17, is determined, and developing conditions are determined. Also, one end of the sheet metal 26*a* of the developing blade 26 is formed as a bent portion 26*e* that is bent into an approximately 90° angle. With this construction, the hardness of the sheet metal is increased, so that the urethane rubber 26*b* is made to evenly abut against the developing roller 18 in the lengthwise direction. Also, the length of the sheet metal 26*a* is determined so that the end portions thereof protrude from the developing frame 17. In the protruding portions, there are formed attachment holes 26*f* to which pressuring springs to be described later are attached.

It should be noted here that an elastic seal member 61, such as Moltopren having an approximately U-shape, is stuck on the developing frame 17 along the upper lengthwise direction (a first straight line portion 17*n*) and the widthwise direction (a second straight line portion 17*p*) of the developer receiving opening portion 17*b*. In this manner, there is prevented the leakage of toner to the outside. A first straight line portion 61*c* and a second straight line portion 61*a* of the elastic seal member 61 are brought into contact with the first straight line portion 17*n* and the second straight line portion 17*p* of the developing frame 17 and are stuck thereto. This elastic seal member 61 is pinched between the developing frame 17 and the developing blade 26 to be depressed, thereby preventing the leakage of toner to the outside. Further, this elastic seal member 61 includes an ear portion 61*b* protruding from a lengthwise end portion by several millimeters. This ear portion 61*b* is used to position a magnetic seal that is not shown in the drawing.

Also, a magnetic seal (not shown) is attached to a groove 17*k* provided between both lengthwise ends of the developer receiving opening portion 17*b* along a circular arc surface 17*l* that extends along the developing roller 18. With the magnetic force, there is prevented the leakage of toner from the developing roller 18.

Further, a thin elastic seal member (not shown) that contacts the generatrix of the developing roller 18 is stuck onto a lower jaw portion 17*m*.

The developing roller 18 is a cylindrical member made of a metallic material, such as aluminum or a stainless steel. The outside diameter thereof is around 16 to 20 mm and the material thickness thereof is around 0.5 to 1 mm. Also, in order to increase the chargeability of developer, the surface thereof is subjected to carbon coating, blasting, or the like. In this embodiment, only the carbon coating is performed.

Figure 20:
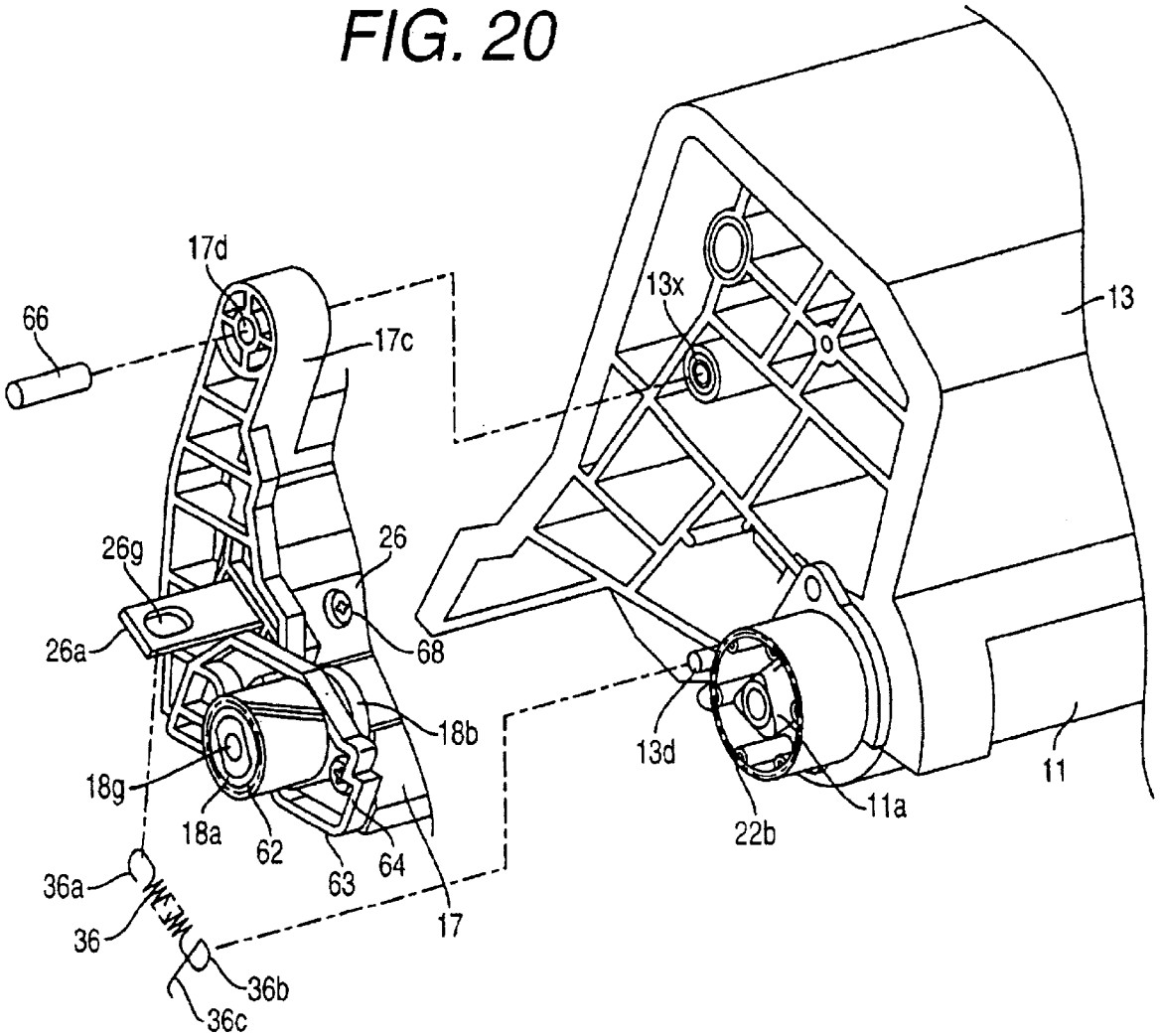
FIG. 20 is a disassembled perspective view showing the construction of the connection between the developing device and a cleaning frame.

Also, sleeve flanges 18*a* that are stepped cyclindrical members made of a metallic material, such as aluminum or a stainless steel, are press-fitted in both end portions of the developing roller 18 (only one end portion is illustrated). Each sleeve flange 18*a* is coaxial with the developing roller 18 and is provided with a first cylindrical portion 18*d* having a large outside diameter and a second cylindrical portion 18*c* having a diameter that is smaller than that of the first cylindrical portion 18*d*. This first cylindrical portion 18*d* is provided with the ring-shaped distance regulating member (called the "spacer roller") 18*b* that regulates the opposing distance (hereinafter, the "SD gap") between the developing roller 18 and the photosensitive drum 11. This spacer roller 18*b* is made of an insulating material, such as polyacetal. The outside diameter of this spacer roller 18*b* is larger than the diameter of the developing roller 18, with the difference between them being equal to twice the SD gap. Also, the second cylindrical portion 18*c* is provided with a developing bearing 63 for rotatably supporting the developing roller 18 and positioning on the developing frame 17 (FIG. 20 is an especially magnified perspective view taken from the opposite side). Also, a two-surface width portion 18*e* is formed at the tip of the second cylindrical portion 18*c* and a developing roller gear 62 made of a synthetic resin is unrotatably fitted around this cylindrical portion 18*c*. This developing roller gear 62 receives a driving force from a helical drum gear (not shown) provided in an end portion of the photosensitive drum 11 and rotatably drives the developing roller 18. Also, a thrust in the axial direction thereof is twisted and is directed toward the center portion of the developing roller 18. Also, a roller-shaped magnet (not shown in FIG. 18, to be described later) for having toner adhere on the peripheral surface of the developing roller 18 is contained in the developing roller 18.

The developing bearing 63 is composed of a member made of a resin having an improved sliding property and has a flat shape with a thickness of around 2 to 5 mm. A cylindrical bearing portion 63*a* is formed at approximately the center of a plane portion 63*g*. The bearing portion 63*a* has an inside diameter of 8 to 15 mm. This bearing portion 63*a* is fitted around the second cylindrical portion 18*c* of the sleeve flange 18*a* to allow the developing roller 18 to rotatably slide. Also, on the plane portion 63*g*, dowels 63*c*, 63*d*, and 63*e* used for positioning on the developing frame 17 are formed substantially parallel to the bearing portion

63*a*. With this construction, positioning on the developing frame 17 is performed. Among these dowels, the dowels 63*d* and 63*e* that are coaxial with the dowel 63*c* and exist at the tip of the dowel 63*c* are used to position a magnetic seal. Also, on the plane portion 63*g*, there are established screw holes 63*b* for fixing the developing bearing 63 to the developing frame 17 using small screws 64 or the like. The dowel 63*c* of the developing bearing 63 is fitted in an unillustrated fitting hole on one lengthwise end surface of the developing frame 17. Also, the dowel 63*f* is fitted in an unillustrated fitting long hole and the plane portion 63*g* of the developing bearing 63 contacts the aforementioned end surface of the developing frame 17. Then, the small screws 64 are put through the screw holes 63*b* established in the developing bearing 63 and are screwed into internal threads established in the aforementioned end surface of the developing frame 17. Thus, the developing bearing 63 is fixed to the developing frame 17. As a result, the developing blade 26 and the developing roller 18, which are fixed to the developing frame 17, are positioned with reliability and therefore stable images are outputted.

In some cases, a relatively high-priced material having a superior sliding characteristic is used to form the bearing portion 63*a* of the developing bearing 63 that has been described above, thereby allowing the sleeve flange 18*a*of the developing roller 18 to rotatably slide (for instance, a bearing member made of a polyphenylene sulfide PPS base material or a polyamide PA base material is used). Therefore, if only a sliding portion is separated from a housing as a bearing bush, it becomes possible to reduce the volume of the component made of a high-priced material and to form the housing using a relative-low-priced material, such as shock resistant polystyrene HIPS.

Also, a magnet (not shown) for having toner adhere on the peripheral surface of the developing roller 18 is provided inside of the developing roller 18.

The driving side of the developing roller has been described above. The non-driving side thereof will be described later.

(Construction for Supporting Developing Device)

Figure 21:
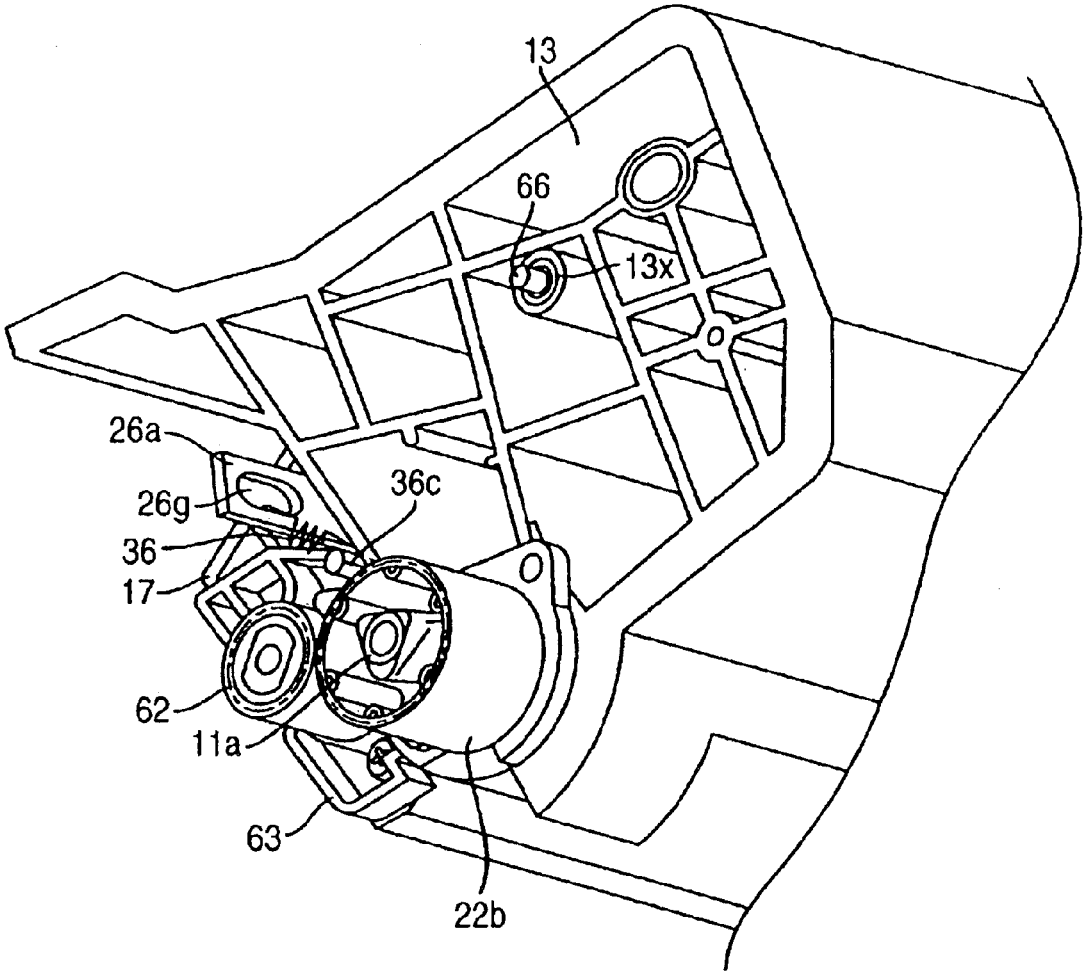
FIG. 21 is a perspective view showing the connection between the developing device and the cleaning frame.
Figure 22:
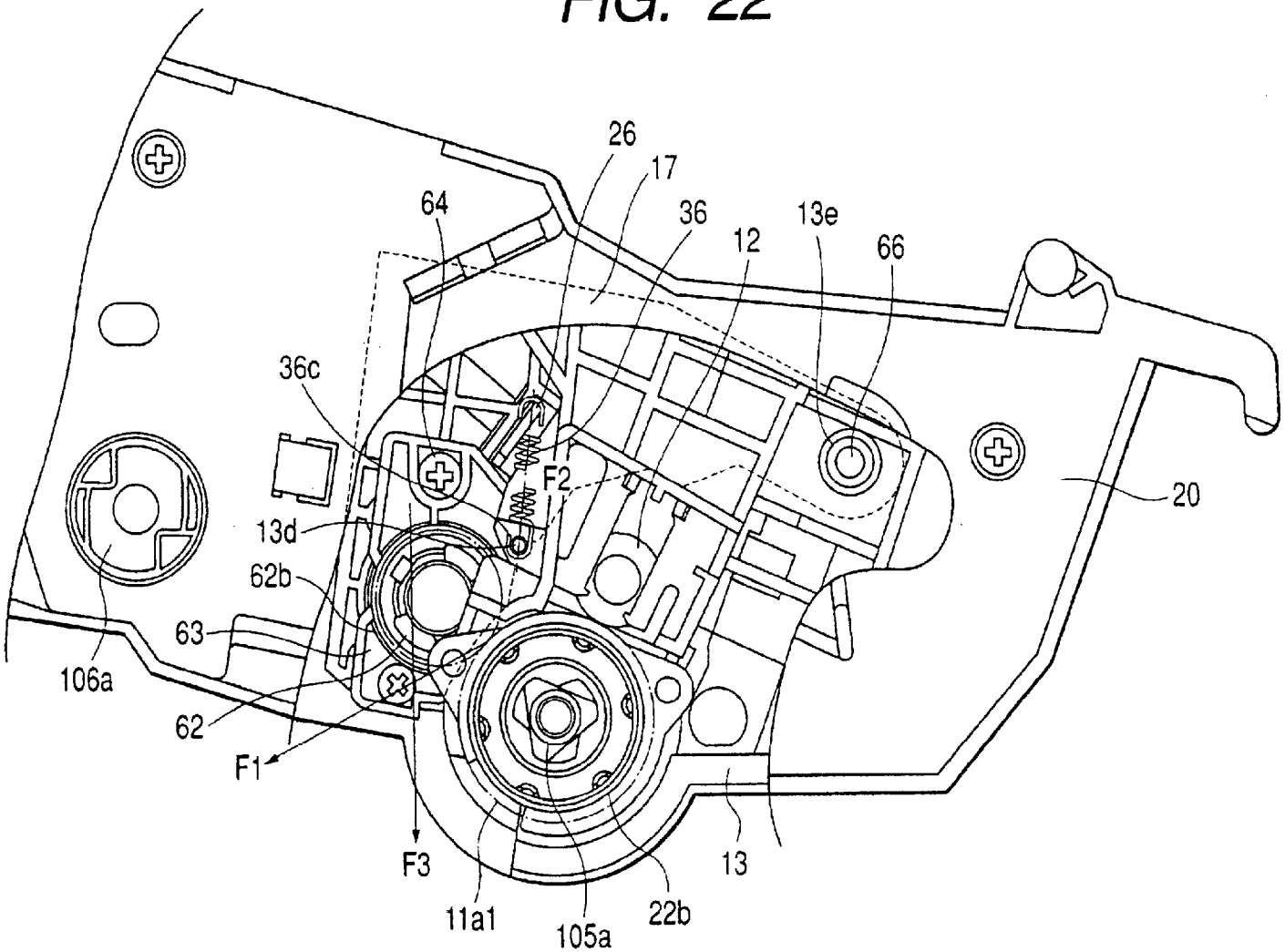
FIG. 22 is a back view showing a connecting portion of the developing device and the cleaning frame.
Figure 23:
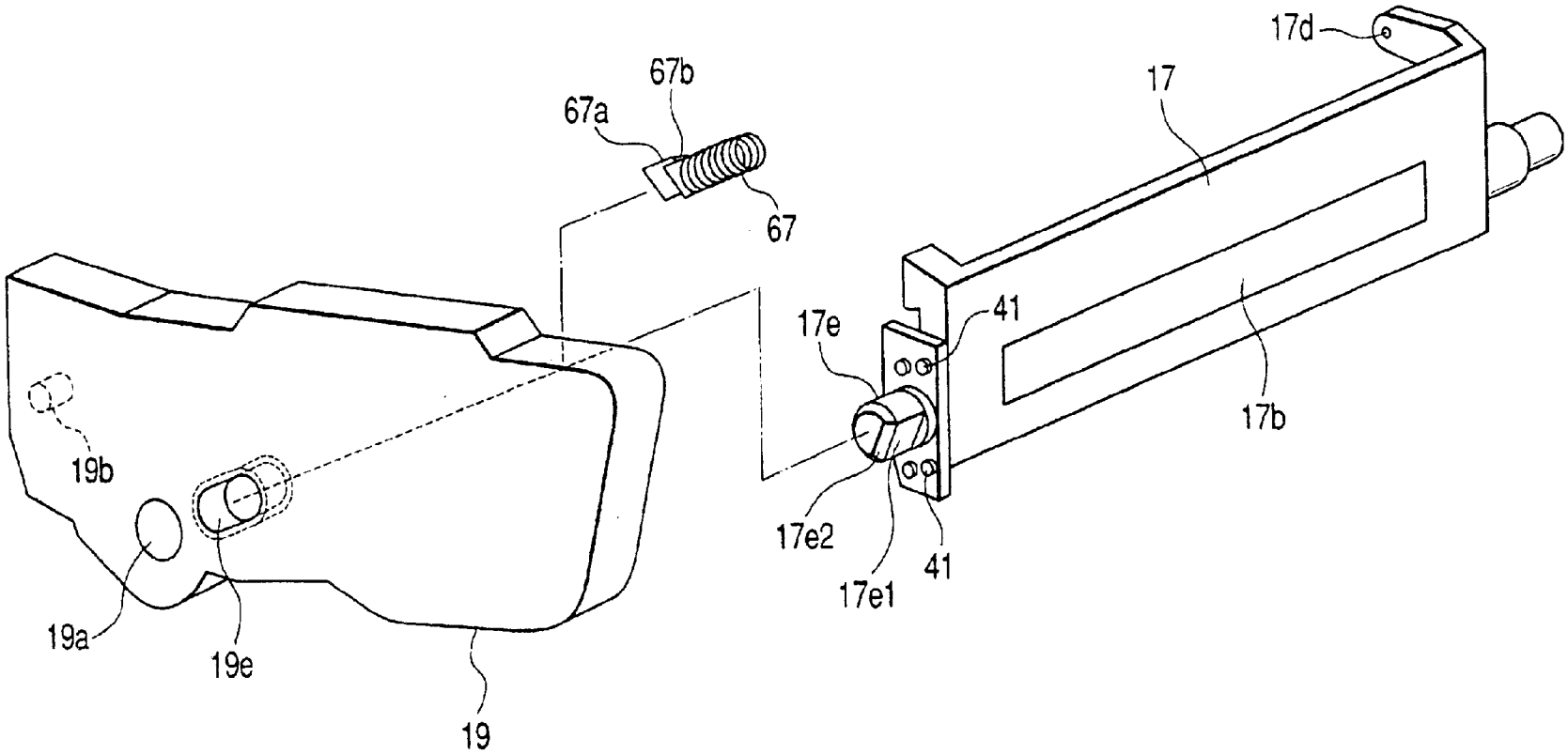
FIG. 23 is a disassembled perspective view showing a relation between the developing frame and a side cover.

Next, the construction for supporting the developing device will be described with reference to FIGS. 7, 20, 21, 22, and 23. FIG. 20 is a perspective view (on the driving side) showing a state before the developing device is supported by the cleaning frame 13. FIG. 21 is a perspective view (on the driving side) showing a state after the developing device is supported by the cleaning frame 13. FIG. 22 is a side view showing a state where FIG. 4 is partially enlarged and the end cover is removed. FIG. 23 is a perspective view showing a state before the developing frame and the end cover on the non-driving side are assembled.

As described above, in order to output optimal images, it is required that the developing roller 18 and the photosensitive drum 11 maintain an optimal SD gap (a space between the photosensitive drum 11 and the developing roller 18). To do so, in this embodiment, the developing roller 18 is pressed against the photosensitive drum 11 with an optimal pressurizing force (hereinafter referred to as the "D pressurizing"), thereby maintaining the SD gap (see FIG. 2). In this case, the optimal D pressurizing is in a range of about 500 g to 2000 g on each of the driving side and the non-driving side. In the case of the D pressurizing below this range, the SD gap is widened due to vibrations and the like, which leads to image defects like white patches. In the case of the D pressurizing above this range, the spacer roller 18*b* is depressed by the D pressurizing (pressurizing force between the spacer roller 18*b* and the photosensitive drum 11), which leads to a state where the SD gap is narrowed. Also, loads are placed on the inner radius and the perimeter of the spacer roller 18*b* due to the D pressurizing, so that there occur shaving and the like due to wear. As a result, there is a danger that an optimal SD gap cannot be maintained. In this embodiment, a stable SD gap is maintained with the construction to be described below. The supporting of the developing device (method of maintaining the SD gap) on each of the driving side and the non-driving side will be described below.

As shown in FIGS. 20, 21, and 22, on the driving side, the developing frame 17 (developing device including the developing roller, the developing blade, and the like) is disposed so that a suspending hole 17*d* established in the tip of an arm portion 17*c* of the developing frame 17 is placed coaxially with a supporting hole 13*x* of the cleaning frame 13. Then, a parallel pin 66 is put through both of the suspended hole 17*d* and the supporting hole 13*x*, and thus functions as the rotational center of sliding. In this manner, the developing frame 17 is slidably supported so that the center of the developing roller is directed toward the center of the photosensitive drum. Under this condition, as shown in FIG. 22, the pressurizing force given by the developing roller 18 to the photosensitive drum 11 on the driving side is generated by three forces: a mesh force F1 of a gear portion 11*a*1 arranged on the flange 11*a* of the photosensitive drum 11 and a gear portion 62*b* of the developing roller gear 62 (gear loads on a line of action passing through a mesh pitch point), a spring force F2 generated by an extension coil spring 36 hooked between the cleaning frame 13 and the developing device, and the self weight F3 of the developing device passing through the center of gravity of the developing device. That is, in FIG. 22, all of the three forces are set so that a moment is generated in a counterclockwise direction about the parallel pin (sliding center) 66 and the developing roller 18 is pressurized against the photosensitive drum 11. During this setting, the position of the sliding center is set so that a small angle of around 5° is formed between the mesh force F1 and a line connecting a point, at which the photosensitive drum 11 contacts the spacer roller 18*b*, and the sliding center (66). This setting prevents a situation where the variation of the mesh force F1 due to variation of a torque significantly changes the D pressurizing. Also, the self weight F3 remains stable because there is obtained a construction in which a load due to developer is not placed on the developing device D, as described above. Also, as will be described later, the spring force F2 is also disposed and supported without losses, so that the D pressurizing D1 on the driving side takes a stable numerical value.

That is, as shown in FIG. 20, the extension coil spring 36 provided as a biasing member functions as an extension spring whose line diameter is around 0.5 to 1 mm. Both the end portions thereof are provided with hook portions 36*a* and 36*b* that function as attachment portions to the device. Also, the extension coil spring 36 is made of a material having spring property, such as SUS, a music wire, or phosphor bronze. The hook portion 36*a* on one end of this spring member is hooked on a hole portion 26*g* formed in a sheet metal 26*a* of the developing blade 26, while the hook portion 36*b* on the other end is hooked on a shaft-shaped spring peg 13*d* provided for the cleaning frame 13. Here, one end portion of the sheet metal 26*a* protrudes from the end surface on one end of the developing frame 17. Also, the hole portion 26*g* of the developing blade 26 is disposed at a position protruding outward from the developing frame 17, has a width of around 2 to 5 mm, and has a length of around 4 to 8 mm. Also, the spring peg 13*d* of the cleaning frame 13 is disposed in the vicinity of the photosensitive drum 11, has a diameter of around 2 to 5 mm, and is integrated with the cleaning frame 13. Also, the positions of both the hole portion 26*g* and the spring peg 13*d* are set so that there is formed a substantially right angle between a line connecting the hole portion 26*g* of the blade sheet metal 26*a* to the spring peg 13*d* of the cleaning frame 13 and a line connecting the hole portion 26*g* to the sliding center (66). Also, the extension coil spring 36 is hooked on the developing blade 26. As a result, as to only the developing frame 17, it is not required to provide spring attachment portions, such as an axis, that protrude from the frame. This makes it possible to simplify the form of the lengthwise end surface of the developing frame 17. Also, it becomes easy to install attachment jigs and assembling easiness is improved when the aforementioned flexible seal 21 is attached to the developing frame 17. Also, the extension coil spring 36 is attached to the developing blade 26, which means that this spring is attached to a metal having a high elastic modulus. Therefore, situations that lead to losses of the D pressurizing (for instance, a situation where the spring peg portion is deformed due to a spring force) are prevented. Also, in the case where attachment portions, such as dowels, are directly provided for the developing frame 17, it is required to increase a size in order to prevent losses of the D pressurizing due to deformation. However, no dowels are provided, so that there is achieved space saving.

It should be noted here that there are cases where a detection means is provided to detect the residual quantity of developer. Various methods may be used to achieve the detection means. For instance, there may be used a method with which the residual quantity of developer is measured by measuring the electrostatic capacity between the developing roller and an antenna member disposed in the vicinity of the developing roller. In this case, it is required that the sheet plate (supporting member) of the developing blade that is a conductive member has the same potential as the developing roller. A voltage application path will be described. As shown in FIG. 7, a contact sheet metal 58 (developing contact portion) is supported by the end cover 20. Electricity is supplied to an outer contact portion 58*a* of this contact sheet metal 58 from an unillustrated contact portion (main body side developing contact portion) of the apparatus main body. A surface of the outer contact 58*a* which contacts the contact portion of the main body is exposed on the center undersurface of the end cover 20. Further, a contact portion 58*b* of the contact sheet metal 58 is electrically connected to a contact axis 20*f* supported by the end cover 20 by insert formation or the like. Then, the tip of the contact axis 20*f* is inserted into an inner radius portion 18*g* of the developing roller shown in FIG. 20 and is electrically connected to an unillustrated contact portion supported by the developing roller. With this construction, a voltage is applied to the developing roller 18. Also, at the same time, the contact sheet metal 58 includes a plate spring portion 58*c* and this plate spring portion 58*c* contacts the tip portion of a straight line portion 36*c* of the illustrated extension coil spring 36 functioning as an biasing member. As described above, this spring 36 is made of a metal and the hook portion 36*a* contacts the sheet metal 26*a* of the developing blade 26. This makes it possible to supply a high voltage and to obtain a potential that is the same as a potential of the developing roller 18. In more detail, electrical power supply is performed using a member on which the spring 36 pressurizing the developing roller 18 against the photosensitive drum 11 acts. This means that the same component is given two functions of developer regulation and electrical power supply. With this construction, the number of parts is reduced, so that it becomes possible to achieve cost reduction and space saving.

As described above, the pressurizing spring that pressurizes the developing roller against the photosensitive drum is attached to the attachment portion provided for the sheet metal of the developing blade. Therefore, it becomes possible to perform the pressurizing action between the photosensitive drum and the developing roller without causing losses due to the deformation of frames. Consequently, a predetermined pressurizing force is uniformly generated and the space between the photosensitive drum and the developing roller remains constant. As a result, it becomes possible to obtain stable images.

Also, the pressurizing spring doubles as an electrical power supplying member to the developing blade sheet metal. This reduces the number of parts and therefore there are achieved cost reduction and space saving. Also, the developing blade sheet metal functions as a spring peg for the pressurizing spring, so that a situation is prevented in which the pressurizing spring is hooked on a frame made of a resin and spring peg portions are deformed.

Further, as shown in FIG. 23, on the non-driving side of the developing frame 17, there is obtained a construction in which an engagement member 17*e* is formed as a protruding portion on a lengthwise center axial line of the developing roller 18 and the engagement member 17*e* is pressurized toward the center of the photosensitive drum 11. This engagement member 17*e* integrally includes a non-driving-side bearing member that supports the developing roller 18.

Figure 9:
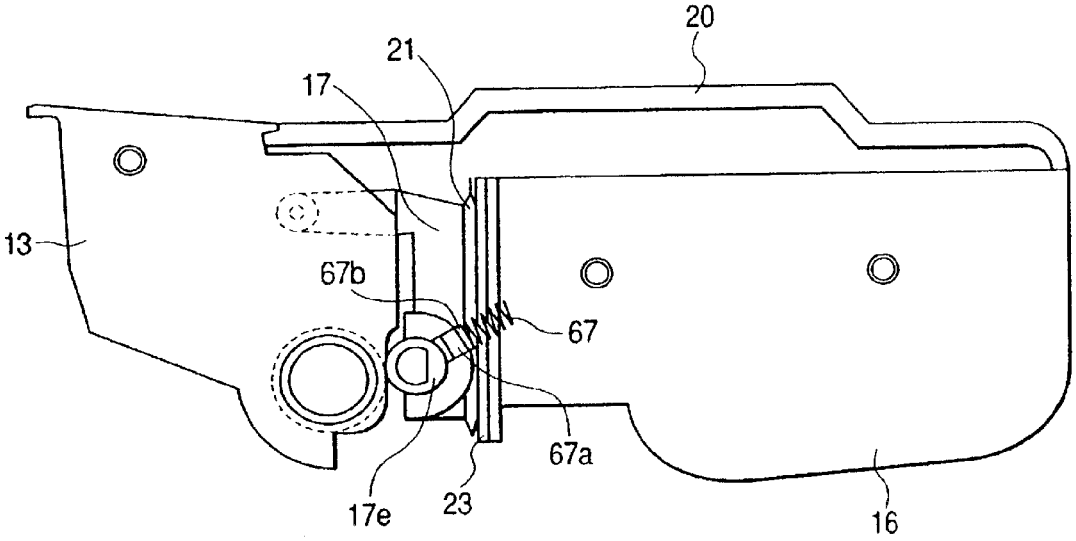
FIG. 9 is a substantially side view of the process cartridge from which a side cover has been detached.

Next, the construction of the D pressurizing on the non-driving side will be described. As shown in FIGS. 9 and 23, on the non-driving side of the developing frame 17, the engagement member 17*c* is fixed on the lengthwise center axial line of the developing roller 18. Then, there is obtained a construction in which the engagement member 17*e* is pressurized toward the photosensitive drum 11. The engagement member 17*e* is fixed to the developing frame 17 using small screws 41. As shown in FIG. 23, the engagement member 17*e* is inserted into a groove 19*e* provided for the rear end cover 19 (in this embodiment, an elongated hole having a straight line shape that is substantially parallel to a direction toward the center of the photosensitive drum) and is constructed so as to be movable toward the center of the photosensitive drum. Also, within the groove 19*e*, an elastic member 67 is disposed on an opposite side to the photosensitive drum 11 so that the engagement member 17*e* is sandwiched therebetween. This elastic member 67 pressurizes the engagement member 17*e* through a pressing member 67*a*. The elastic member 67 is a coil-shaped compression spring whose line diameter is around 0.5 to 1 mm. The spring force of the spring directly functions as a pressurizing force D2 given by the developing roller 18 to the photosensitive drum 11 on the non-driving side. This means that the pressurizing force D2 is determined only by the spring force and therefore a stable pressurizing force is obtainable. The groove 19*e* also plays a role in positioning the developing roller 18 by regulating the moving direction thereof. This groove 19*e* is a concave portion when viewed from the inside of the rear end cover 19 and the width of this groove 19*e* on the outer side is narrow, thereby preventing the pressing member 67*a* from going out of the groove 19*e*.

A flat surface 67*b* of the pressing member 67*a* contacts the elastic member 67. The flat surface 67*b* is perpendicular to the pressurizing direction of the elastic member 67. A flat surface that is parallel to the flat surface 67*b* is formed on a side of the pressing member 67*a* opposite to the flat surface 67*b* and contacts a flat portion 17*e*1 of the engagement member 17*e*. This flat portion 17*e*1 is a pressed portion that is pressed by the elastic member 67.

(Description of Coupling Member)

Here, coupling shapes will be described with reference to FIGS. 24 to 26.

Figure 24:
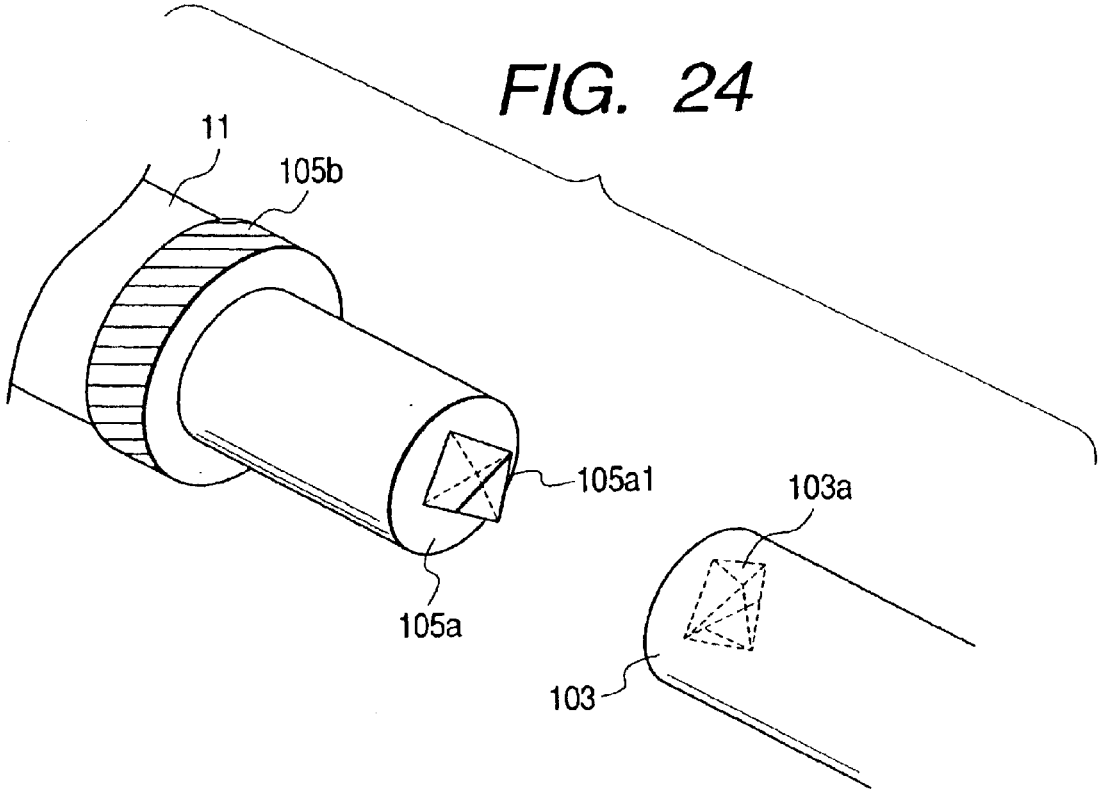
FIG. 24 is a perspective view showing the coupling for driving a photosensitive drum.

In FIG. 24, the first coupling 105*a* that is a driving force receiving member of the process cartridge 15 includes a substantially triangular convex portion 105*a*1. In more detail, this convex portion 105*a*1 is a triangle prism that is twisted in the rotational direction of an axis. Also, a main body first coupling 103 that is a driving force transmitting member of the apparatus main body includes a concave portion 103*a* that is engaged with the convex portion 105*a*1 and has a substantially triangular cross section that is twisted in the axial direction. With this construction, when the first coupling 105*a* and the main body first coupling 103 are engaged with each other and are rotated, each vertex of the convex portion 105*a*1 is made to evenly abut against the inside surface of the concave portion 103*a*, so that matching is established between the axial centers and a driving force is transmitted.

As described above, the first coupling 105*a* and the main body first coupling 103 are respectively a convex portion and a concave portion of a twisted triangle prism. When these couplings are engaged and rotated, a thrust in the axial direction is generated and the couplings pull each other.

Figure 25:
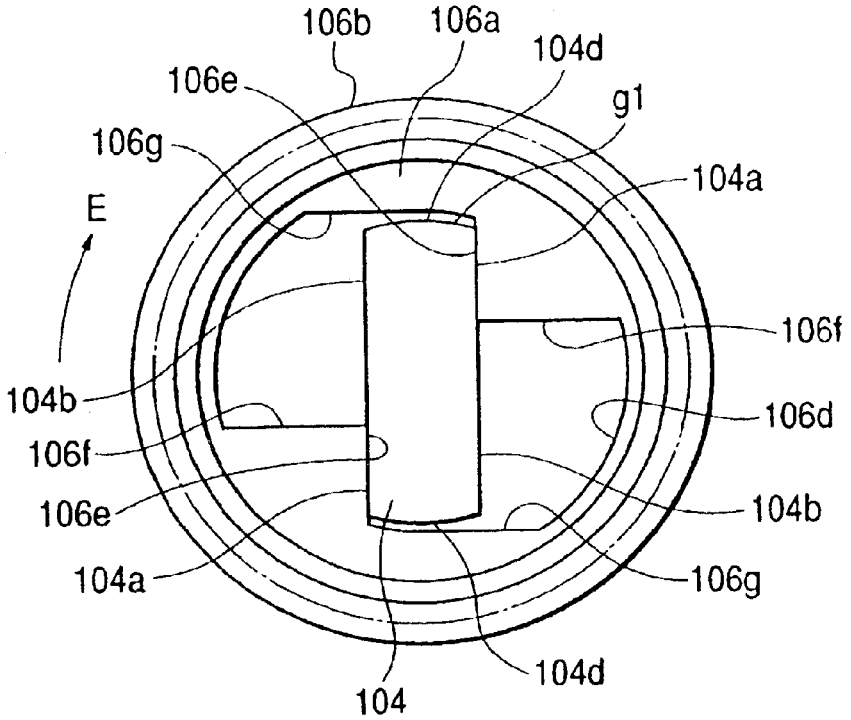
FIG. 25 is a back view showing the coupling for driving an agitating member.
Figure 26:
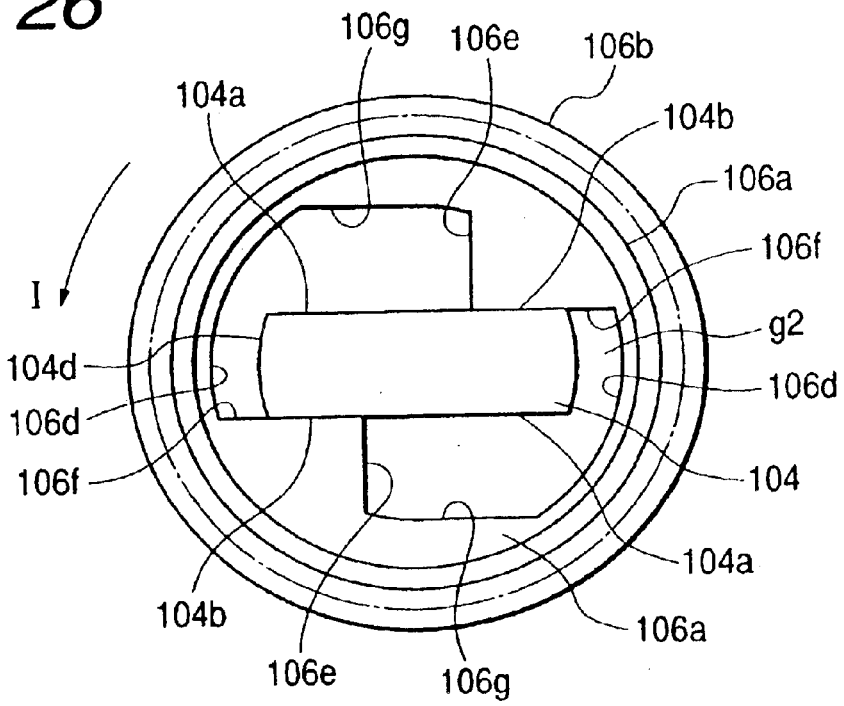
FIG. 26 is another back view showing the coupling for driving the agitating member.

In FIGS. 25 and 26, a main body second coupling 104 or the image forming apparatus includes a two-surface width portion formed by shaving two surfaces of a cylinder and includes abutment portions 104*a* and 104*b*. One pair of the abutment portions 104*a* and 104*b* exists on each surface of the two-surface width portion, with the abutment portion 104*a* being arranged on one side of the surface and the abutment portion 104*b* being arranged on the other side of the surface. Also, each surface of the two-surface width portion on one side includes one of the abutment portions 104*a* and 104*b*. The second coupling 106*a* within the process cartridge 15 has a construction in which triangular ribs are provided for a circular concave portion 106*d* at two positions by equally dividing the circumference of a circle. These triangular ribs each include flat abutment portions 106*e* and 106*f* arranged perpendicular to each other.

Then, as shown in FIG. 25, when the main body second coupling 104 is rotated through an unillustrated toner seal automatic unsealing mechanism in the direction E in which the developer seal 24 is unsealed, the abutment portions 106*e* of the second coupling 106*a*, which are triangular rib abutment portions, are made to abut against the abutment portions 104*a* of the main body second coupling 104, thereby transmitting a driving force.

At this time, there is also obtained a shape in which the diameter of the circular concave portion 106*d* is changed so that a space g1 in the diameter direction between the perimeter 104*d* of the main body second coupling 104 and the concave portion 106*d* of the second coupling 106*a* becomes small. Therefore, the concave portion 106*d* includes flat surfaces 106*g* that each extend substantially parallel to a surface 106*f* from a point midway through a circular arc.

It should be noted here that the perimeter 104*d* of the main body second coupling 104 is a circular arc and exists on a circle whose center coincides with the rotational center of the main body second coupling 104. Also, there is obtained a construction described below. After the driving for unsealing the developer seal 24 is finished, the main body second coupling 104 is rotated backward in the I direction, as shown in FIG. 26. As a result, the abutment portion 106*f* of the second coupling 106*a* is made to abut against the abutment portion 104*b* of the main body second coupling 104, the second coupling 106*a* is driven, and a driving force is transmitted to the toner agitating members 113, 114, and 123 and the like. There is also obtained a construction in which during this operation, a space g2 is maintained between the main body second coupling 104 and the second coupling 106*a* in a radius direction with respect to the rotational axis. In this embodiment, the space g2 is set at around 2 mm.

With this construction, it becomes possible that the rotational center is determined between the main body second coupling 104 and the second coupling 106*a* without rotationally driving the photosensitive drum 11 when the developer seal 24 is unsealed. Also, after the developer seal 24 is unsealed, that is, when an image is formed, the first coupling 105*a* provided for the photosensitive drum 11 and the main body first coupling 103 function as the rotational center, and the second coupling 106*a* and the main body second coupling 104 for transmitting a driving force to the toner agitating members 113, 114, and 123 and the like transmit the driving force. When doing so, even if these coupling 106*a* and 104 are eccentrically positioned, alignment is not performed and the driving force is transmitted under the eccentric condition. This achieves a construction in which the matching between the axial centers of the main body first coupling 103 and the first coupling 105*a* is not hindered.

(Description of Driving System)

Figure 27:
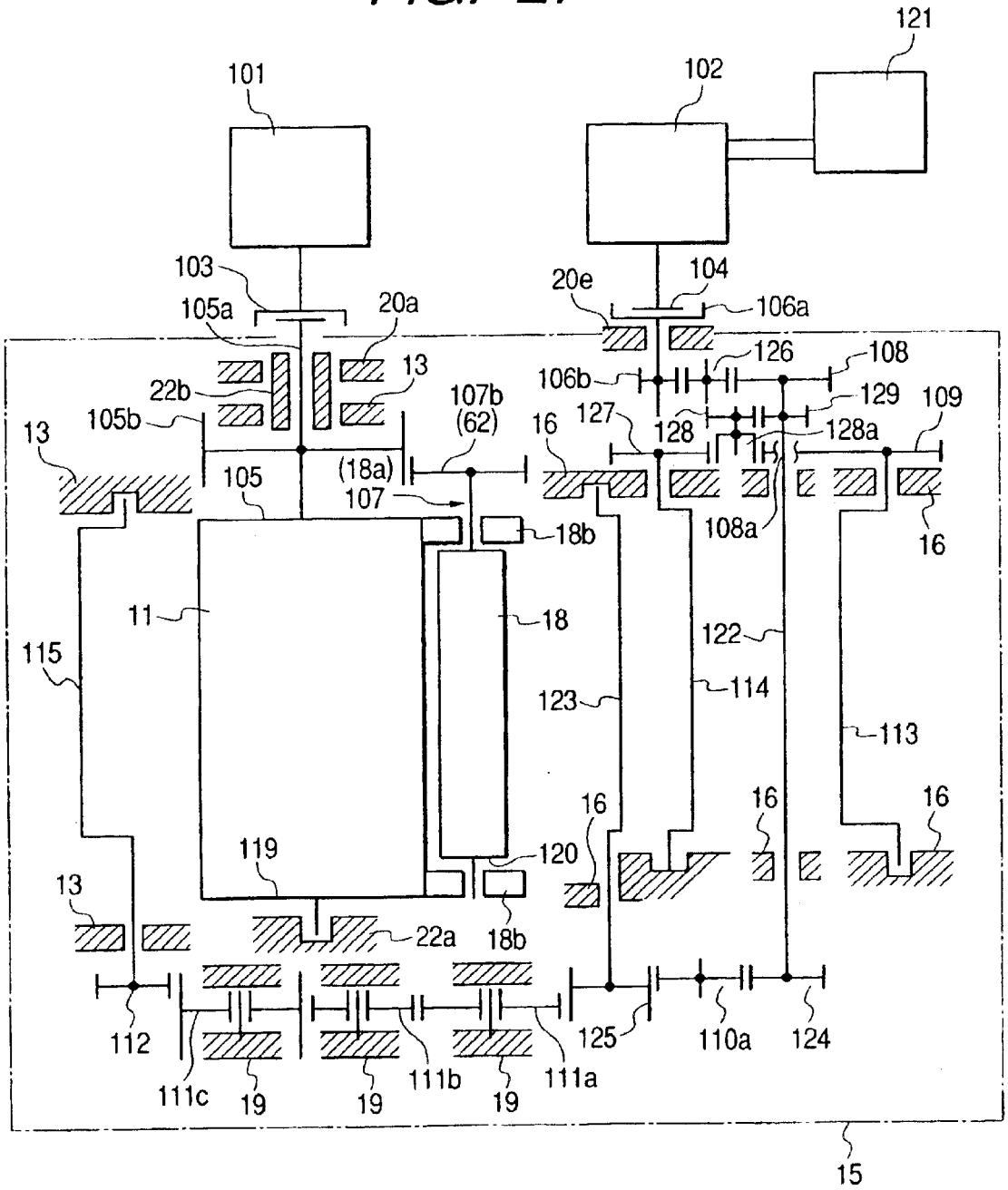
FIG. 27 is a schematic system diagram of a driving system of the process cartridge.

FIG. 27 is a system diagram of the driving system in this embodiment. Note that reference symbols used in this system diagram are used as reference symbols assigned specifically for the system diagram and a developing sleeve gear 107*b* corresponds to the developing roller gear 62 (see FIGS. 7 and 20) in a concrete construction.

Under a condition where the process cartridge 15 is set in the apparatus main body 27, driving sources 101 and 102 for the process cartridge 15, such as motors, provided on the apparatus main body 27 side are coupled to the couplings 105*a* and 106*a* that integrally rotate with input gears 105*b* and 106*b* on the process cartridge side through the couplings 103 and 104. The coupling 106*a* is supported by a bearing 20*e*. The coupling 105*a* and the gear 105*b* are formed as one component or are integrally formed to obtain a gear flange 105, and are supported by the cleaning frame 13 through a bearing member 22*b*. Also, for instance, in a construction in which the driving source 102 uses a motor that is different from that of the drum driving source 101 and the rotational speeds of the motors can be changed with a control device 121, it becomes possible to change the driving speed of a toner agitating system in synchronism with the coupling 104 and the input coupling 106*a* on the process cartridge side.

The control device 121 makes it possible to turn ON/OFF the driving of the driving source 102 or to change a driving speed in accordance with conditions, such as the number of sheets to be processed by the process cartridge 15, the toner quantity in the process cartridge 15, and an agitating driving torque of the process cartridge 15.

Also, in the apparatus main body 27 whose printing speed is high, a setting is made by changing the driving speed of the driving source 102. Thus, there is obtained a construction in which the agitating speed is not changed and remains constant even if the speeds of the photosensitive drum 11 and the developing roller 18 are accelerated. Here, the driving source 102 may use the same driving motor as the driving source 101 through a variable speed device. In this case, it is possible to set optimal agitating motion by changing a speed in accordance with specifications of the apparatus main body 27.

The driving system on the process cartridge side will be described.

Gear flanges 105 and 107 (gear flange 105 also being a drum flange) that are obtained by integrally forming gears 105*b* and 107*b* with flanges are respectively fixed to one end of the photosensitive drum 11 and the developing roller 18, respectively, that are directly related to the development of electrostatic latent images. Also, bearing flanges 119 and 120 are fixed to the other ends thereof. In this manner, units are formed from these components. The gear 105*b* meshes with the sleeve gear 107*b*.

When the coupling 103 is rotated by the driving source 101 on the apparatus main body 27 side, the photosensitive drum 1 and the developing roller 18 are rotated. The photosensitive drum unit is rotatably supported by bearing members 22*a* and 22*b*. Also, as to the developing roller 18, the spacer roller 18*b* having the same center as the developing roller 18 but having a larger outside diameter than the developing roller 18 is brought into pressure contact with the photosensitive drum 11. As a result, the developing roller 18 rotates while maintaining an optimal gap with the surface of the photosensitive drum 11. The bearing members 22*a* and 22*b* are holes that are directly established in the cleaning frame 13 of the process cartridge 15 or members fixed to this frame (see FIG. 7). Journal portions of the flanges 105 and 119 are fitted in the bearing members 22*a* and 22*b*.

To drive the agitating system, gears are coupled so that a driving force is transmitted to the agitating members 113 and 114 as follows. First, the driving force is transmitted to an idler input gear 108 through an idler gear 126 that meshes with an input gear 106*b*. Then, the driving force is transmitted to an idler gear 129 fixed to a shaft 108*a* fixed to the idler input gear 108, and is further transmitted to an idler gear 128 that meshes with the idler gear 129. Finally, the driving force is transmitted to agitating input gears 109 and 127 that mesh with a small gear 128*a* of the idler gear 128 that is a two-stepped gear. Note that there is no problem even if the axis of the input gear 106*b* and the axis of the agitating member 114 do not exist on a straight line, so that it is possible to select the position of the input gear 106*b* to be in a wide area. Here, each gear in the process cartridge 15 is rotatably supported by the frame of the process cartridge 15.

Also, the shaft 108*a* of the idler input gear 108 is integrated with a driving transmission rod 122 or is coupled thereto on a straight line. The driving transmission rod 122 is coupled to an idler input gear 124 on the lengthwise opposite side and transmits the driving force to the agitating member 123 through an agitating gear 125 that meshes with an idler gear 110*a*. Here, each of the driving transmission rod 122 and the agitating members 113, 114, and 123 are rotatably supported by the developer frame 16.

Consequently, when the input gear 106*b* is rotated, the agitating members 114, 113, and 123 and the transmission rod 122 rotate in an interlocking manner because the journal portion of each of these components is rotatably supported by a bearing portion provided for the developer frame 16.

As to the coupling 103, as shown in FIG. 24, the convex portion 105*a*1 that is a twisted triangle prism on the drum flange 105 side is engaged with the twisted concave portion 103*a* on the apparatus main body 27 side during driving. Therefore, the convex portion 105*a*1 and the concave portion 103*a* pull each other and are aligned, which determines the positions of the apparatus main body 27 and the process cartridge 15. During this operation, the convex portion of the coupling 104 is engaged with the concave portion of the input coupling 106*a*. However, a fitting space is maintained to allow eccentricity to a degree, so that there is no effect on the positioning of the first coupling 105*a* on the drum flange side (see FIGS. 25 and 26). Further, as a detent means of the process cartridge 15, a protrusion (to be described later) of the second guide portion 20*g* of the front end cover 20 is positioned in the apparatus main body 27. That is, there is obtained a rough coupling construction described below. On the driving input side on which there are performed the development and formation of latent images that affect images, positioning in the apparatus main body 27 is performed by an aligning action of the couplings. However, on the driving unit side of the agitating system, only the transmission of a driving force is performed.

Further, in the cleaning frame 13 that also functions as the removed toner reservoir 5, there is contained an impeller-shaped removed toner sending member 115 that transports removed toner removed from the photosensitive drum 11. This removed toner sending member 115 is rotatably pivoted by bearing portions provided for the cleaning frame 13. A removed toner sending portion input gear 112 is fixed to one end of the removed toner sending member 115. This removed toner sending portion input gear 112 meshes with the idler output gear 124 through idler gears 111*c*, 111*b*, 111*a*, 125, and 110*a*. As to the transmission rod 122, the idler input gear 108 is fixed to one end thereof and the idler output gear 124 is fixed to the non-driving side that is the opposite side. The axis of each of the idler gears 111*a*, 111*b*, and 111*c* is rotatably supported by bearing portions of the rear end cover 19. Here, when the driving transmission rod 122 rotates, the removed toner sending member 115 also rotates in an interlocking manner. Note that each bearing portion supporting the idler gears 111*a*, 111*b*, and 111*c* is a fixation axis that is integrally formed with the rear end cover 19.

Also, the idler gear 111*c* may be a two-stepped step gear. In this case, a large gear meshes with the idler gear 111*b* and a small gear meshes with the removed toner sending portion input gear 112.

As described above, each moving portion in the process cartridge 15 is constructed so that a driving train including the photosensitive drum 11 and the developing roller 18 and a driving train for agitating toner and sending removed toner are separately driven by the driving sources on the apparatus main body 27 side.

Also, the removed toner sending member 115 may be driven by a transmission construction on an opposite side to the input portion of the agitating member 113 or 114 of the toner container 16. Further, the removed toner sending member 115 may be driven by receiving inputs from any one of the input gear 106*b*, and input agitating gears 109 and 127, and idler input gear 108 and idler gear 128 of the agitating portion through a gear train.

(Construction of Cooling Air Trunk)

Figure 28:
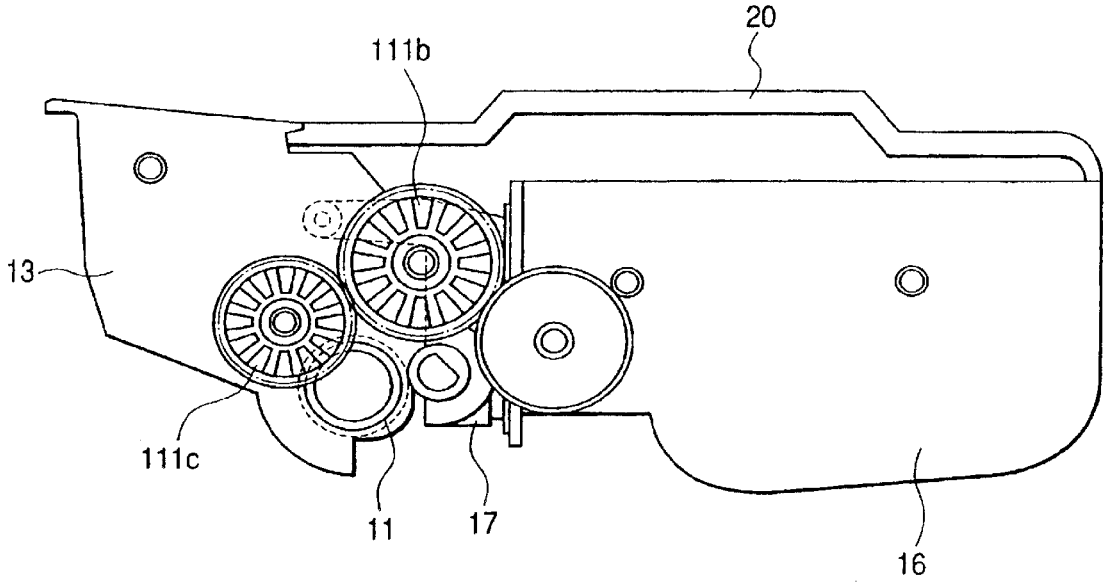
FIG. 28 is a schematic side view showing a cooling means of the process cartridge.
Figure 29:
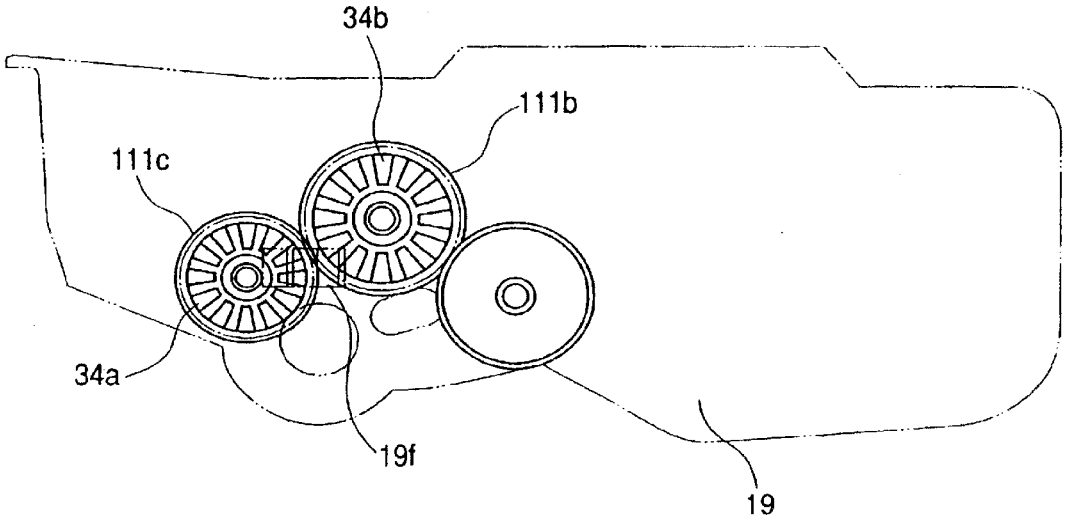
FIG. 29 is another schematic side view showing the cooling means of the process cartridge.

FIGS. 28 and 29 are each a schematic diagram of a gear train disposed on the periphery of the photosensitive drum. FIG. 28 is a side view taken by detaching a side cover, while FIG. 29 is a side view showing the side cover using virtual lines. In the cleaning frame 13, there is provided the removed toner sending member 115 that transports removed and collected toner toward the back of the removed toner reservoir 5. There may be cases where the speed of the removed toner sending member 115 needs to be significantly decelerated in the case where the removed toner sending member 115 receives a driving force from the photosensitive drum 11. However, if the removed toner sending member 115 receives a driving force from the toner agitating member 114 in the developer frame 16, a significant deceleration becomes unnecessary and it becomes easy to obtain an appropriate rotational speed. In this case, the gears 111*b* and 111*c* are disposed in the vicinity of the photosensitive drum 11 outside of the developer frame 16 and the developing frame 17 (see FIG. 28).

In the embodiment, to prevent a temperature increase in the vicinity of the photosensitive drum, an air trunk 19*f* (see FIG. 29) is provided for the rear end cover 19 in the vicinity of the photosensitive drum. Because the gears 111*b* and 111*c* in the gear train block the air trunk 19*f* used to cool the inside, the gears 111*b* and 111*c* are provided with slits 34*a* and 34*b* so that blades of an axial fan are formed. With this construction, suction and exhaustion are willingly performed through the air trunk 19*f*.

Figure 30:
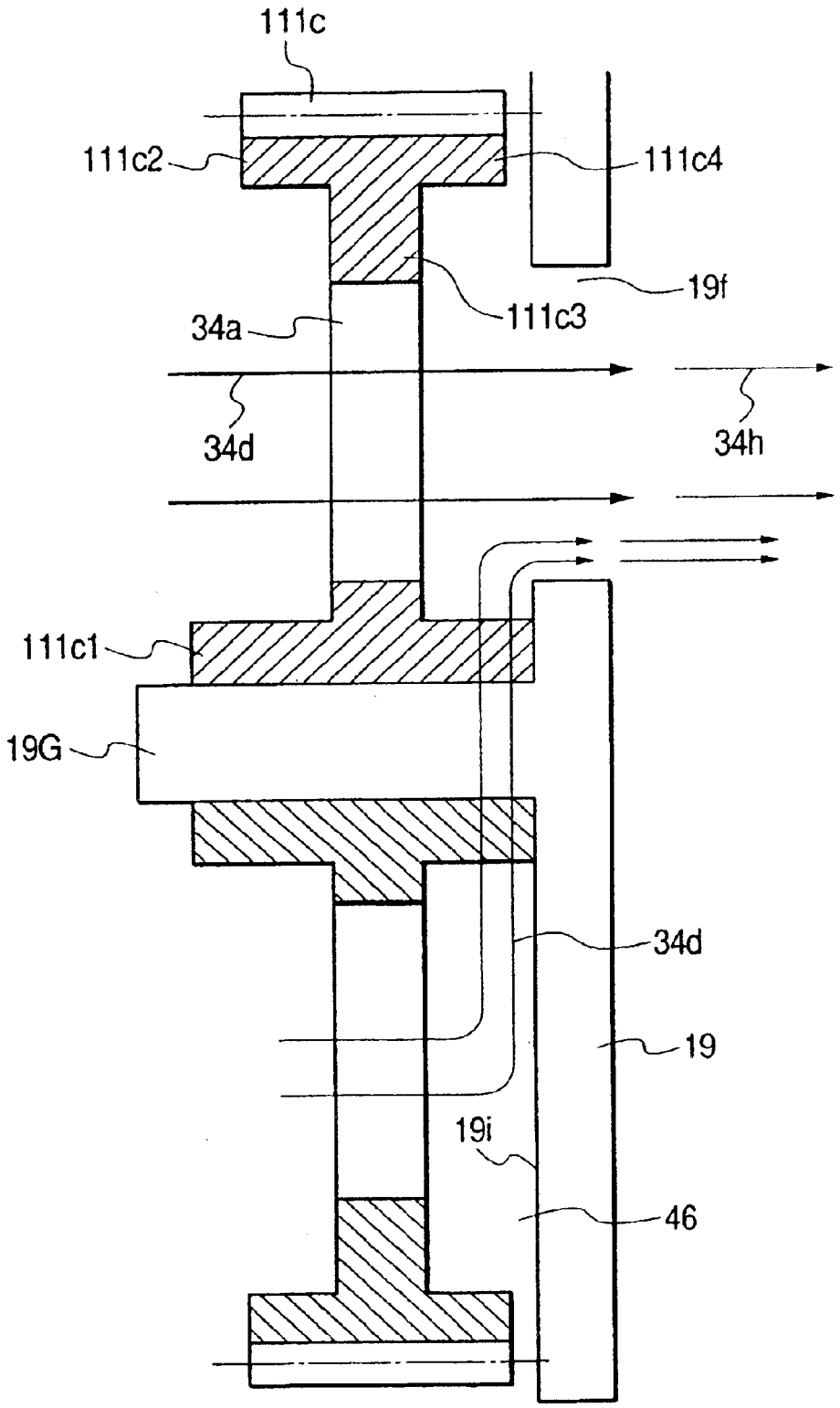
FIG. 30 is a cross sectional view taken along the line XXX—XXX in FIG. 31.
Figure 31:
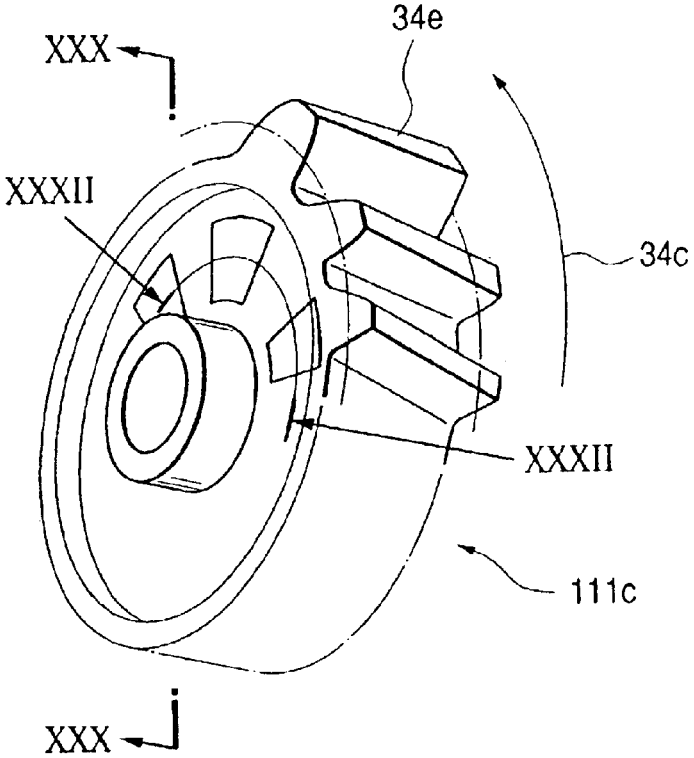
FIG. 31 is perspective view of a gear with an impeller.
Figure 32:
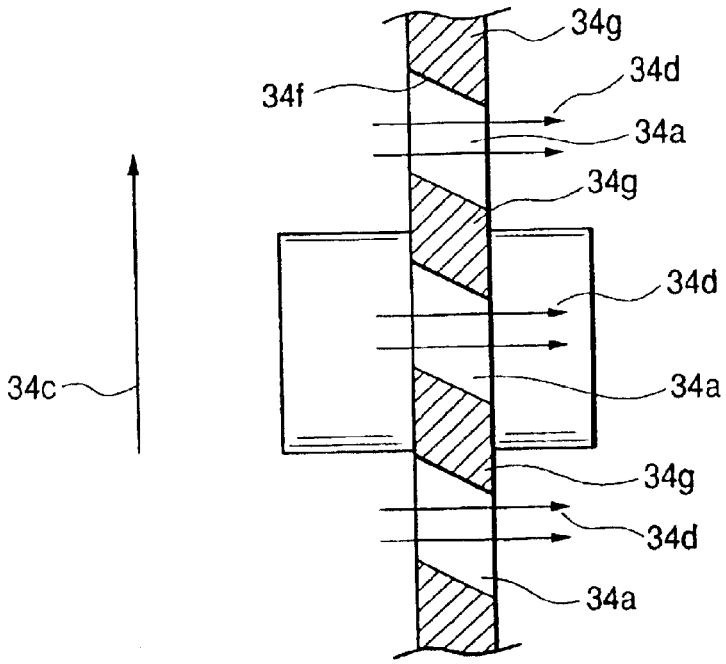
FIG. 32 is a cross sectional view taken along the line XXXII—XXXII in FIG. 31.
Figure 33:
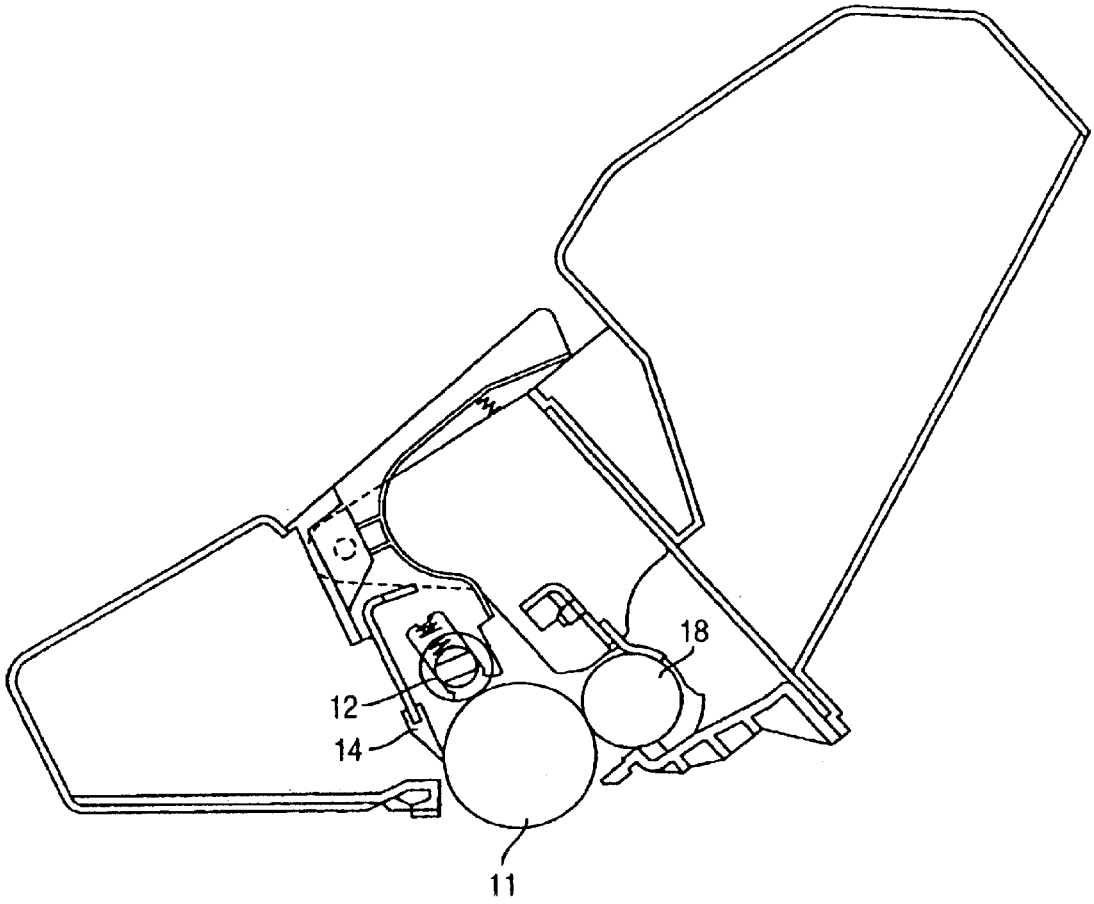
FIG. 33 is a vertical cross-sectional view of a conventional process cartridge.

The construction of the cooling air trunk will further be described with reference to FIGS. 30, 31, and 32. FIG. 31 is a perspective view of the gear 111*c*. Here, the gear 111*b* is the same as the gear 111*c* except that the direction, in which teeth are twisted, and the direction, in which the air trunk is twisted, are opposite to those of the gear 111*c*. Therefore, the following description takes the gear 111*c* as an example. FIG. 32 is a cross sectional view taken along the line XXXII—XXXII in FIG. 31, while FIG. 30 is a cross sectional view taken along the line XXX—XXX in FIG. 31.

The gear 111*c* is a helical gear. A disk-shaped hub 111*c*3 connecting a rim 111*c*2 including a teeth portion to a boss 111*c*1 is provided with slits 34*a* that pass through the hub 111*c*3. When the slits 34*a* are provided, the circumference of a circle is equally divided. A surface of the hub 111*c*3 is separated from an inside surface 19*i* of the rear end cover 19. With this construction, the air trunk 19*f* provided for the rear end cover 19, through which air enters into and exits from the rear end cover 19, communicates with the slits 34*a* through a space 46. A center hole of the boss 111*c*1 is rotatably supported by an axial portion 19G provided so as to protrude toward the inside of the rear end cover 19 in the lengthwise direction. An unillustrated locating snap ring is fitted around the axial portion 19G, thereby preventing movement in the axial direction. As to the rim 111*c*2, one side surface 111*c*4 is disposed in the vicinity of the inside face 19*i* of the rear end cover 19. Both of the side surfaces 19*i* and 111*c*4 reduce the passage of air as soon as possible. To do so, both of the side surfaces 19*i* and 111*c*4 may get into each other in a labyrinth manner.

The slits 34*a* are provided so as to overlap with the air trunk 19*f*.

As shown in FIG. 32, screw-shaped blades 34*g* exist between the slits 34*a* that are adjacent to each other. It is preferable that the adjacent slits 34*a* are formed like an axial fan so as to aerodynamically improve the air blast efficiency, although it is enough that the blades are provided in a simple slanting manner because the rotational speed of the gear 111*c* is slow. These slits 34*a* form an impeller inside of the rim 111*c*2.

The gear 111*c* rotates in a direction indicated by the arrow 34*c*, as shown in FIGS. 31 and 32. In accordance with this rotation, air flows in the axial direction indicated by the arrow 34*d* and enters into the space 46, as shown in FIG. 30. Then, the air is directed from the space 46 to the air trunk 19*f*, passes through the air trunk 19*f* of the rear end cover 19 as indicated by the arrow 34*h*, and is exhausted outside of the process cartridge.

The space 46 is brought into simultaneous communication with all of the slits 34*a* in this manner, so that all of the blades 34*g* contribute to the generation of airflow.

Also, when the direction 34*f* of the surface of each blade 34*g* is reversed, the direction of airflow is reversed even if the rotational direction is not changed. This makes it possible to send air existing outside of the image forming apparatus into the process cartridge 15. It is effective that an advantageous direction of the airflow is selected in view of the positions of parts and the whole construction of the air trunk.

It should be noted that if the direction, in which the tooth lines 34*e* of the helical gear 111*c* are twisted, is the same as the direction 34*f* of the blade 34*g*, air flows in the same axial direction. Also, in the case of resin molding, this construction is advantageous in view of the construction of a mold. Further, in the case where the tooth lines 34*e* of the gear 111*c* and the blades 34*g* are formed so that air is sent in the same axial direction, it is preferable that a space, through which air passes, is provided between the side surface of the rim 111*c*2 and the inside surface of the rear end cover 19 and a cover is provided as a casing of an air blower along the perimeter of the gear 111*c* except for its mesh portion.

As described above, an impeller is constructed by the slits 34*a* and the blades 34*g* including slanting surfaces 34*f*, with the center of the impeller being set at the center of the gear 111*c*. Because the gears 111*b* and 111*c* rotate during image formation, it becomes possible to exhaust air that resides in the charging portion and cleaning blade portion within the process cartridge 15 and is raised in temperature. During this operation, heat generated by the fixing device 10 and the like is also removed. Note that, in the main body 27 of the image forming apparatus, there are provided a natural vent hole or a ventilation means (not shown), such as a fan, to exchange air in the main body of the image forming apparatus.

(Construction of Developing Frame)

Figure 34:
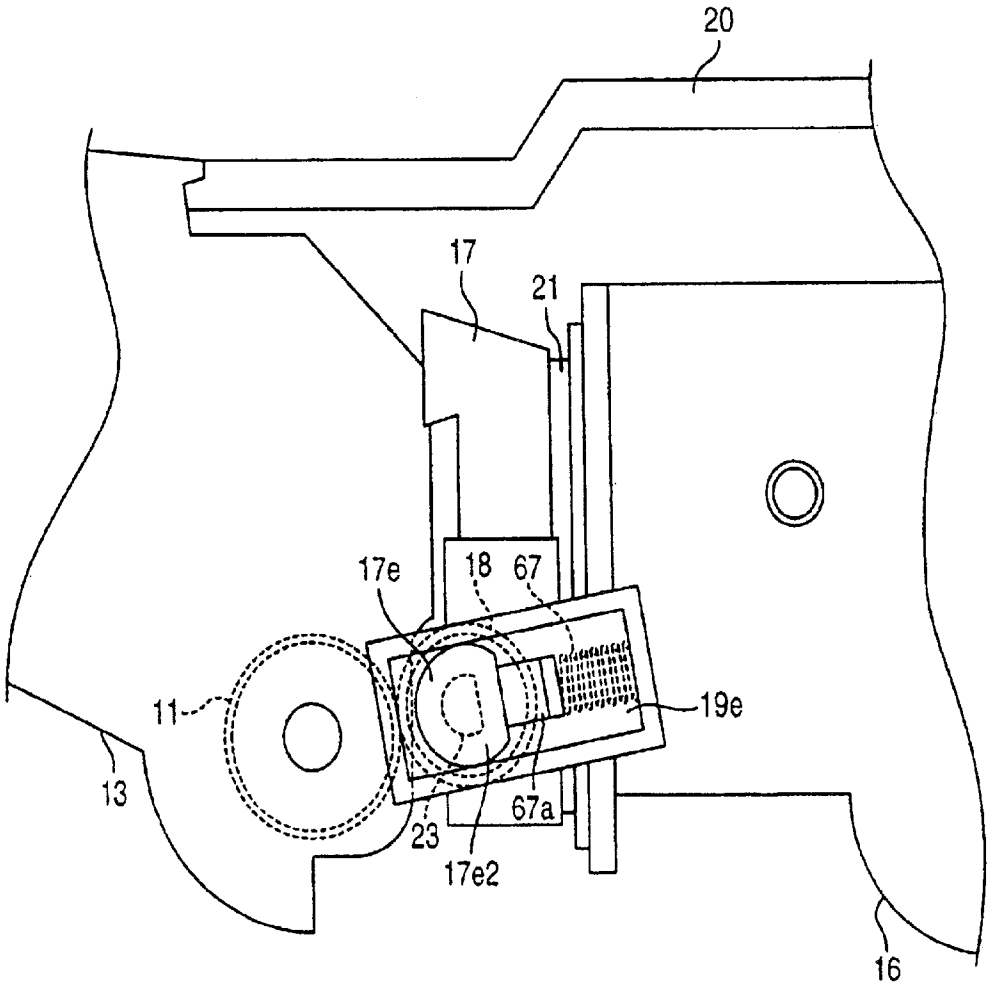
FIG. 34 is a partial side view of the process cartridge from which a side cover has been detached.
Figure 35A:
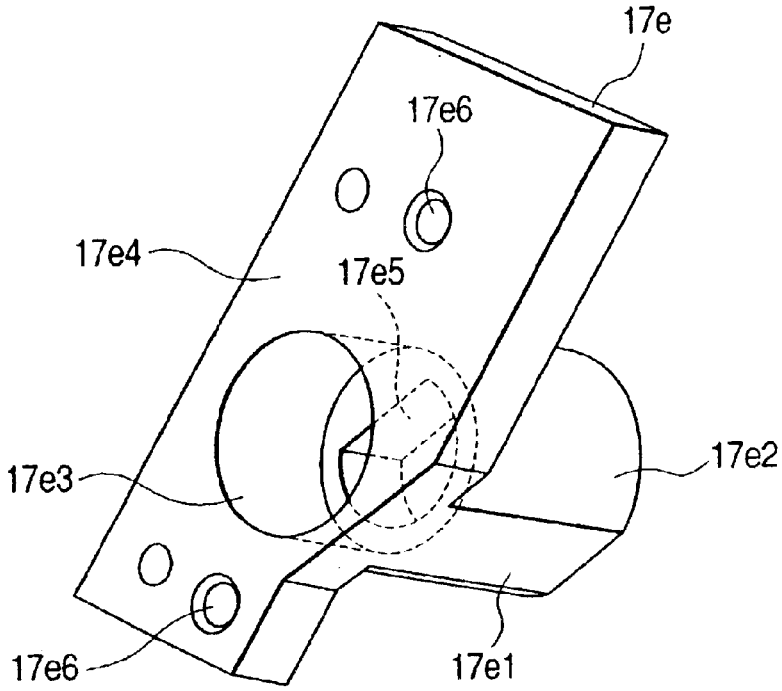
FIG. 35A is a back perspective view of a protruding member.
Figure 35B:
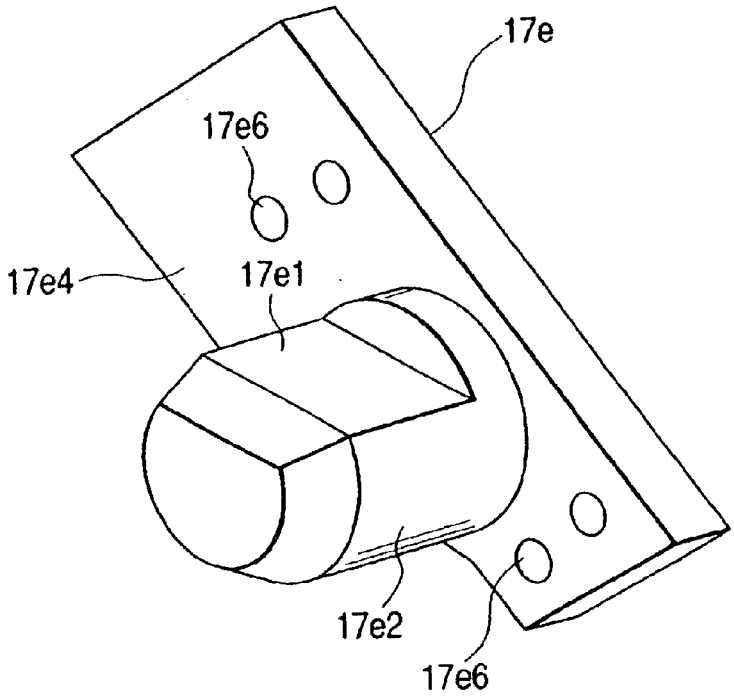
FIG. 35B is a front perspective view of the protruding member.
Figure 36:
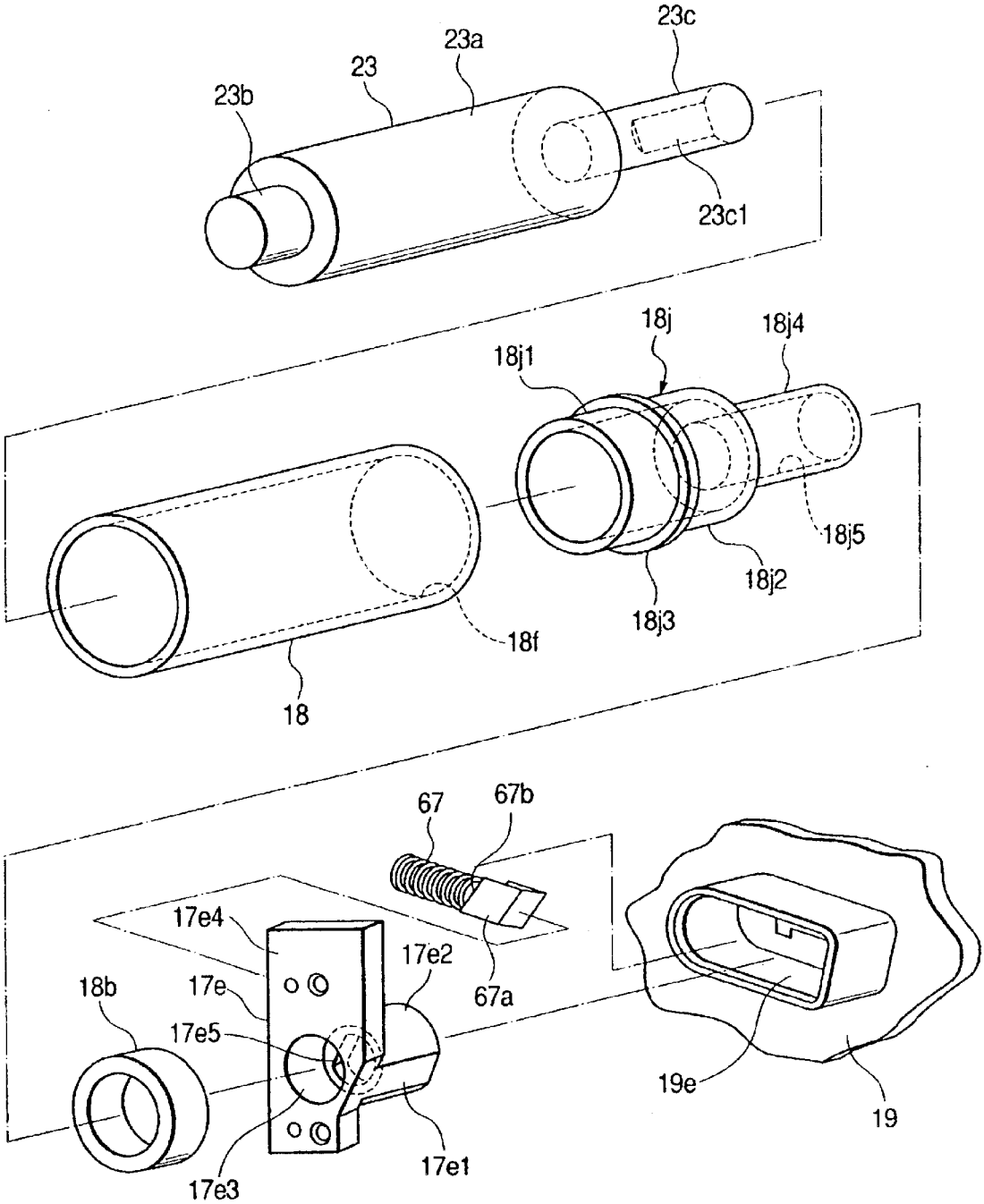
FIG. 36 is a disassembled perspective view of a developing roller of the process cartridge around a bearing thereof.

Next, the construction of the developing frame 17 will be described with reference to FIGS. 7, 9, and 34 to 38. Note that, FIG. 9 is a side view taken from one side of the process cartridge 15 under a condition where the rear end cover 19 is detached. FIG. 34 is also a side view taken from one side of the process cartridge 15 under a condition where the rear end cover 19 is detached. FIG. 36 is a disassembled perspective view showing a state where respective parts are positioned on the rear end cover 19 of the developing frame 17 on one side.

In the developing frame 17, a developing roller unit, in which the developing roller 18 contains a roller-shaped magnet 23, is rotatably supported by the engagement member 17*e* functioning as a developing bearing member, and the engagement member 17*e* is positioned on the developing frame 17 with a small screw 41. Note that, the developing blade (see FIG. 2) and an unillustrated magnetic seal are also provided for the developing frame 17.

Meanwhile, one side surface of the magnet 23 is rotatably supported by the inside diameter portion of the developing roller 18 and the other side surface thereof is unrotatably supported by the engagement member 17*e* including a developing bearing function, thereby maintaining a predetermined gap between the magnet 23 and the developing roller 18. Note that the electrical energy supply to the developing roller 18 is performed via an unillustrated electric contact provided within the developing roller 18. Also, on the developing roller 18, there is provided the spacer roller 18*b* for maintaining a constant space between the developing roller 18 and the photosensitive drum 11 (see FIG. 37).

(Construction for Supporting Developing Roller and Magnet)

Figure 37:
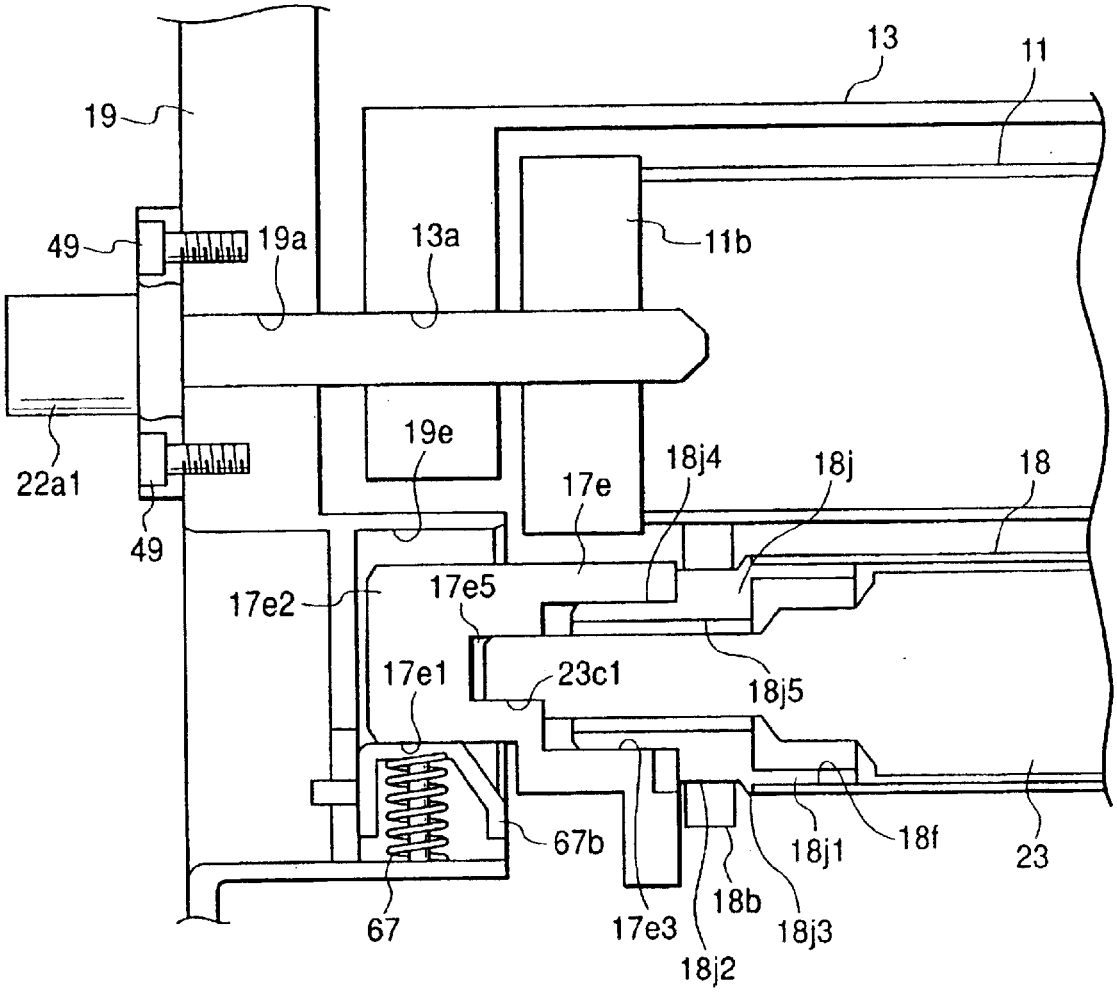
FIG. 37 is a developed cross-sectional view showing a construction for supporting one ends of the developing roller and the photosensitive drum.

Next, a construction for supporting the developing roller 18 and the magnet 23 will be described with reference to FIGS. 35A, 35B, 36, and 37. Note that FIGS. 35A and 35B are each an external perspective view of the engagement member 17*e* that is a developing bearing member, FIG. 36 is a disassembled perspective view around the engagement member 17*e* of the process cartridge 15, and FIG. 37 is a partial vertical cross-sectional view of the process cartridge 15.

The developing roller 18 is a cylindrical member made of a metallic material such as aluminum or a stainless steel. The outside diameter of the developing roller 18 is around 16 to 20 mm and the material thickness thereof is around 0.5 to 1 mm. Also, in order to increase the chargeability of toner, the surface of the developing roller 18 is subjected to carbon coating, blasting, or the like (in this embodiment, only the carbon coating is performed). Also, in the end portion on the non-driving side of the developing roller 18, there is provided a press-fit hole 18*f* in which a sleeve flange 18*j* is press-fitted and fixed.

As shown in FIG. 36, the stated sleeve flange 18*j* is a stepped hollow cylindrical member that is made of a metallic material, such as aluminum or a stainless steel, and is press-fitted and fixed to an end portion of the developing roller 18. The sleeve flange 18*j* comprises a press-fit portion 18*j*1 that is press-fitted in an end portion of the developing roller 18. By press-fitting this press-fit portion 18*j*1 in the developing roller 18, the sleeve flange 18*j* is fixed to the developing roller 18. Also, there are formed, outside of the sleeve flange 18*j* in the axial direction of the press-fit portion 18*j*1, a rib portion 18*j*3 having approximately the same diameter as the developing roller 18 and a smaller-diameter portion 18*j*2 that is coaxial with the fit-press portion 18*j*1 and has a smaller outside diameter. The spacer roller 18*b* for regulating an opposing distance between the developing roller 18 and the photosensitive drum 11 is put in this flange small-diameter portion 18*j*2. A journal 18*j*4 is formed having a smaller diameter than that of the small-diameter position 18*j*2.

Further, for the sleeve flange 18*j*, a through hole 18*j*5 is formed coaxially with the journal portion 18*j*4. An end portion of the magnet 23 is put through this through hole 18*j*5, thereby positioning the magnet 23 on the developing frame 17 through the engagement member 17*e*.

On the other hand, as shown in FIG. 36, the magnet 23 is composed of a large-diameter portion 23*a* and bearing supporting portions 23*b* and 23*c* that are provided on the end portion of the large-diameter portion 23*a*. The large-diameter portion 23*a* is contained in the developer roller 18 and a plurality of magnetic poles are polarized on its surface. In usual cases, one of the plurality of magnetic poles is disposed so as to substantially oppose the photosensitive drum 11 and other magnetic poles are also disposed at optimal positions. The magnetic poles are composed of four poles in total. Also, to stabilize the magnetic force on the developing roller 18, a constant distance is maintained between the surface of the large-diameter portion 23*a* of the magnet 23 and the surface of the developing roller 18. To maintain this constant distance, the bearing supporting portion 23*c* of the magnet 23 is supported by the engagement member 17*c*. Also, to stabilize the circumferential arrangement of the magnetic poles, a D-cut portion 23*c*1 is formed for the bearing supporting portion 23*c* of the magnet 23 and the circumferential position of the magnet 23 is regulated by this D-cut portion 23*c*1. Note that the bearing supporting portion 23*b* on the other side of the magnet 23 is supported by a magnet roller bearing (not shown) contained in the sleeve flange 18*a* (see FIGS. 7 and 18) on the other side.

Meanwhile, the engagement member 17*e* is constructed using a member made of a resin, and is composed of a flange 17*e*4 with a thickness of around 2 to 5 mm and a protrusion portion 17*e*2. The protrusion portion 17*e*2 has an outside diameter of around 8 to 15 mm and is fitted in the groove 19*e* of the rear end cover 19. Also, the perimeter of this protrusion portion 17*e*2 includes a flat portion 17*e*1 that is formed substantially perpendicular to a line connecting centers of the developing roller 18 and the photosensitive drum 11. Thus flat portion 17*e*1 is a plane receiving the pressurizing force of the elastic member 67 that is the aforementioned compression coil spring through the pressing member 67*a*. With this construction, the developing roller 18 is pressed against the photosensitive drum 11 with reliability. As a result, the developing roller 18 is pressurized with reliability without losing the spring force of the compression coil spring and the distance between the photosensitive drum 11 and the developing roller 18 remains constant at all times, thereby realizing stabilized images.

Also, within the plane on a side opposite to the plane including the protrusion portion 17*e*2 of the flange 17*e*4 of the engagement member 17*e*, there is formed the first hole 17*e*3 as a cylindrical bearing portion. This hole 17*e*3 is coaxial with the outside diameter of the protrusion portion 17*e*2 and has an inside diameter of 8 to 15 mm. Also, the journal portion 18*j*4 of the sleeve flange 18*j* is rotatably fitted in this hole 17*e*3, thereby allowing the developing roller 18 to rotatably slide. During sliding, the position of the developing roller 18 in the rotational direction with respect to the photosensitive drum 11 is determined with high precision only by the engagement member 17*e* and of the rear end cover 19. That is, the parallelism of the developing roller 18 against the photosensitive drum 11 is guaranteed. In more detail, even if the rotational center lines of the photosensitive drum 11 and the developing roller 18 are parallel to each other on the sheet plane of FIG. 37, the rotational center lines of the photosensitive drum 11 and the developing roller 18 cross each other on a plane perpendicular to the sheet plane of FIG. 37 and the space between the photosensitive drum 11 and the developing roller 18 varies. This prevents changes of the circumferential developing position in the lengthwise direction.

Further, at the back of the hole 17*e*3 of the engagement member 17*e*, the second hole 17*e*5 that is a D-cut shaped positioning hole is formed coaxially with the protrusion portion 17*e*2. The D-cut portion 23*c*1 of the magnet 23 is fitted in the second hole 17*e*5, so that positions of magnet 23 and roller 18 are determined. As a result, the positions of the magnet 23 and the developing roller 18 are determined with high precision only by the engagement member 17*e*, which means that precision is guaranteed without difficulty.

Also, one of the four magnetic poles of the magnet 23 substantially opposes the photosensitive drum 11. The position of the magnet 23 with respect to the photosensitive drum 11 is determined by the engagement member 17*e* and the rear end cover 19, which also makes it easy to guarantee precision.

Meanwhile, as shown in FIGS. 35A and 35B, screw holes 17*e*6 used for positioning are formed at two positions of the flange 17*e*4 of the engagement member 17*e*, with an enough distance being maintained therebetween. Also, as shown in FIG. 34, the engagement member 17*e* is positioned on the developing frame 17 and is securely fixed to the developing frame 17 with the small screw 41 (see FIG. 23). Thus, the relative relation is determined between (a) the developing blade 26, the magnetic seal, and the like fixed to the developing frame 17 and (b) the magnet 23 and the developing roller 18 that are positioned by the engagement member 17*e*.

The above-mentioned construction will be described again by following assembling steps with reference to FIGS. 36 and 37. The cylindrical press-fit portion 18*j*1 of the sleeve flange 18*j* is press-fitted in the press-fit hole 18*f* that is a hole in an end portion of the developing roller 18, thereby securely fixing the sleeve flange 18*j* to the developing roller 18. Next, the magnet 23 is inserted. Then, the sleeve flange 18*a* and a magnet roller bearing (not shown) on the opposite side are inserted, thereby obtaining the developing roller 18.

Next, the spacer roller 18*b* is fitted in each of the small-diameter portion 18*j*2 of the sleeve flange 18*j* and the second cylindrical portion 18*c* of the sleeve brush 18*a*, and the developing roller gear 62 (see FIGS. 7 and 18) is attached to the two-surface width portion 18*e* of the sleeve flange 18*a* in order, thereby integrally attaching these components to the developing frame 17 through the engagement member 17*e*. Following this, the elastic member 67 that is a compression coil spring to be provided in the groove 19*e* of the rear end cover 19 is fitted around a protrusion (not shown) provided on the plane 67*b* of the pressing member 67*a*, a unit obtained by integrating the elastic member 67 with the pressing member 67*a* is attached, and the protrusion portion 17*e*2 of the engagement member 17*e* attached to the developing frame 17 is inserted into the groove 19*e* of the rear end cover 19. In this manner, the pressing member 67*a* is inserted in defiance of the biasing force of the elastic member 67 (the condition shown in FIG. 37 is obtained).

As is apparent from FIG. 37, the developing roller 18 and the magnet 23 are positioned on the rear end cover 19 through the engagement member 17*e* and a plane receiving the pressurizing force is also provided on the developing frame 17 side. Also, a phase of the D-cut portion 23*c*1 of the magnet 23 with respect to the magnetic poles is determined at will. However, if the plane of this D-cut portion 23*c*1 is set as a plane perpendicular to a line connecting centers of the developing roller 18 and the photosensitive drum 11, it becomes possible to realize a concentric similar shape with respect to the protrusion portion 17*e*2 of the engagement member 17*e*, which allows parts producers to efficiently perform production.

As described above, a plurality of functions are given to a single part, so that it becomes possible to reduce the number of parts and to provide user with the process cartridge 15 at low cost. Also, the photosensitive drum 11, the developing roller 18, the magnet 23, and other important components that are significantly related to image formation are positioned with less parts. Therefore, the accuracy of relative position between these components is increased, which makes it possible to further stabilize images.

Figure 38:
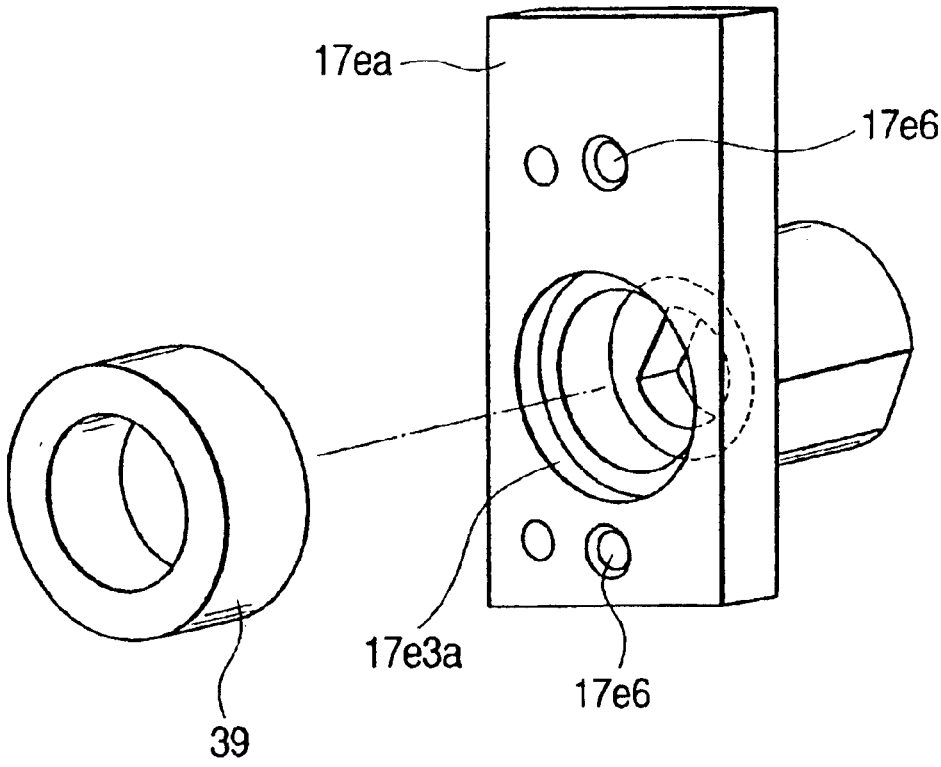
FIG. 38 is a perspective view of a protruding member according to another embodiment.
Figure 39:
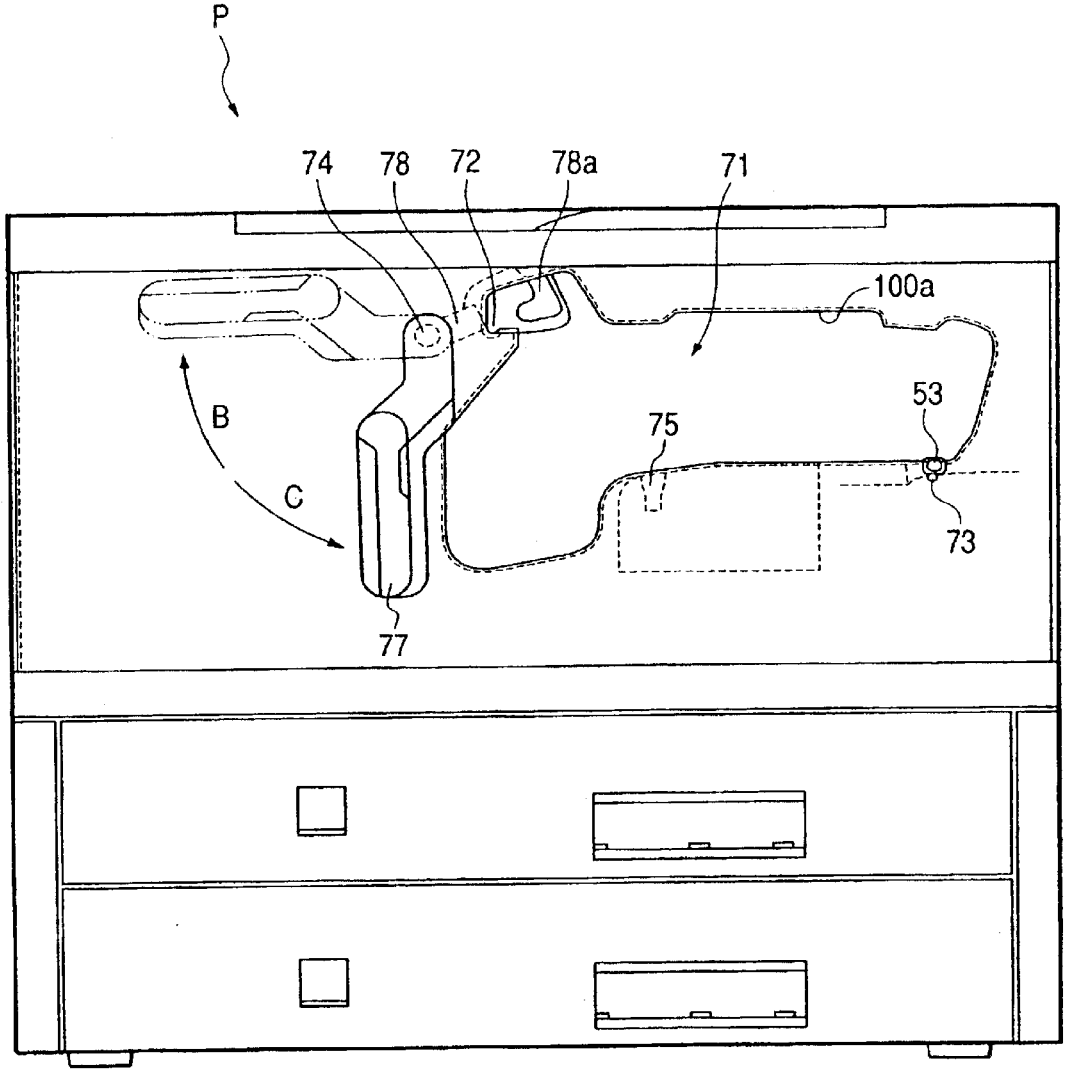
FIG. 39 is a front view showing a cartridge mounting portion of the main body of the image forming apparatus.

It should be noted that the first hole 17*e*3 that is a bearing portion of the engagement member 17*e* rotatably supports the developing roller 18. Therefore, in some cases, a relatively high-priced material is used having a superior sliding characteristic, such as a PPS base bearing material or a PA base bearing material. Therefore, as shown in FIG. 38, an independent bearing bush 39 may be produced as a bearing member, thereby separating this bearing bush 39 from the main body 17*ea* of the engagement member. In this case, the bearing bush 39 of the engagement member 17*e* is put in a hole 17*e*3*a* of the engagement member main body 17*ea*. With this construction, it becomes possible to reduce the volume of a part made of a high-priced material, to use a relative low-priced material, such as HIPS, for the engagement member main body 17*ea*. As a result, there is realized cost reduction. Also, by changing the shape of the bearing bush, it becomes possible to integrate the engagement member with the developing frame (it is enough to perform insertion in a slanting direction when assembling the developing roller and the like). With this construction, the number of parts is reduced because small screws and the like become unnecessary. Therefore, there are achieved reductions of the number of parts, the number of assembling steps, and production cost.

It should be noted that the aforementioned cartridge has a weight of around 4 kg, a length of around 460 mm, a width of around 300 mm, and a height of around 110 mm.

(Means for Mounting Process Cartridge to Apparatus Body)

Figure 40:
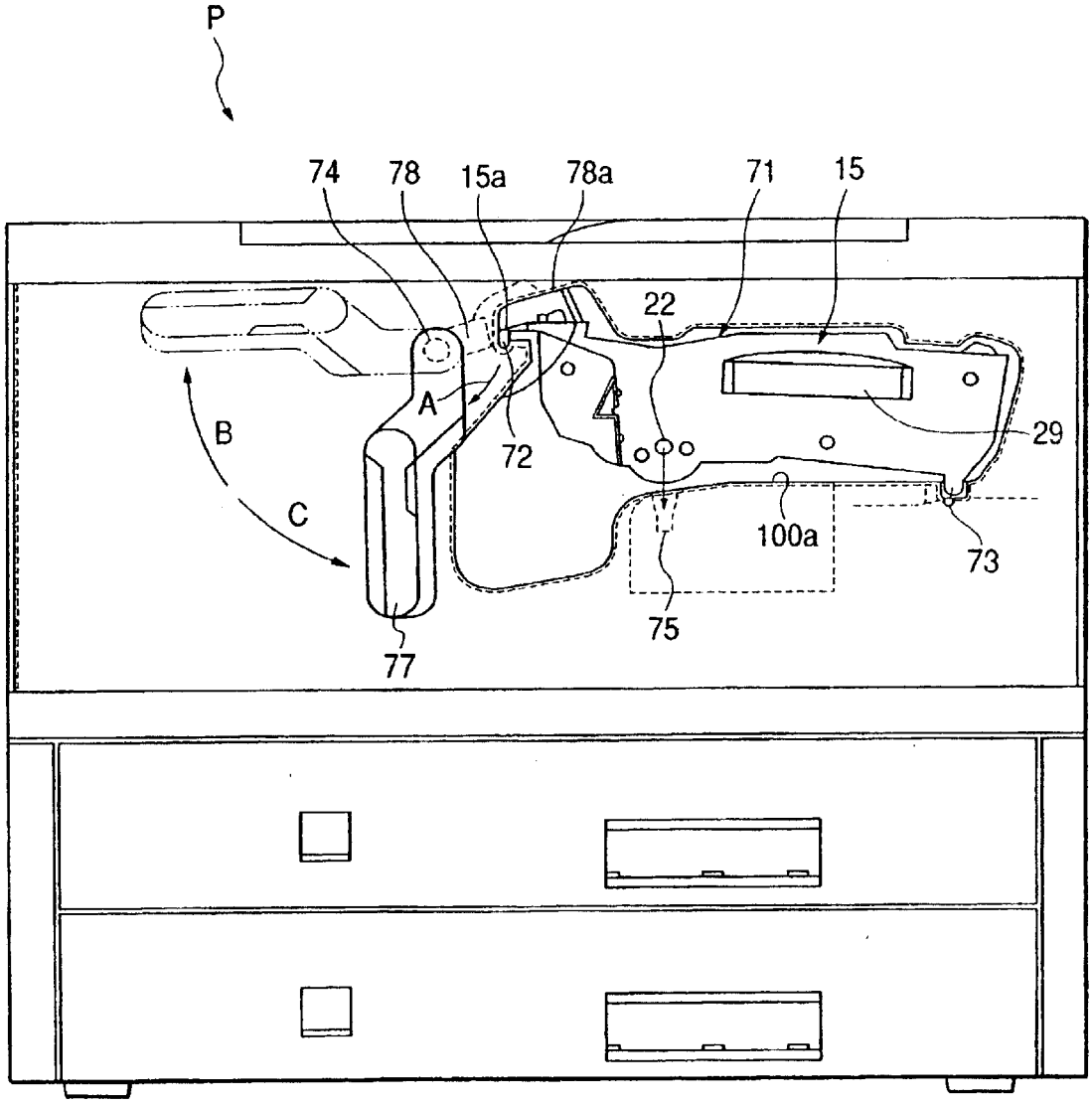
FIG. 40 is a front view showing the insertion and detachment of the process cartridge into and from the main body of the image forming apparatus.
Figure 43A:
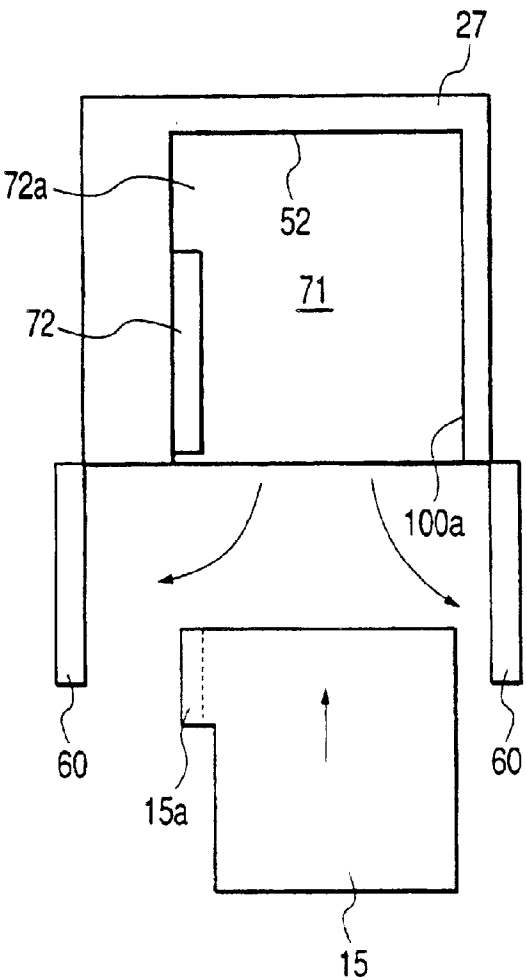
FIGS. 43A, 43B, and 43C are plan views showing how the process cartridge is inserted into the main body of the image forming apparatus.
Figure 43B:
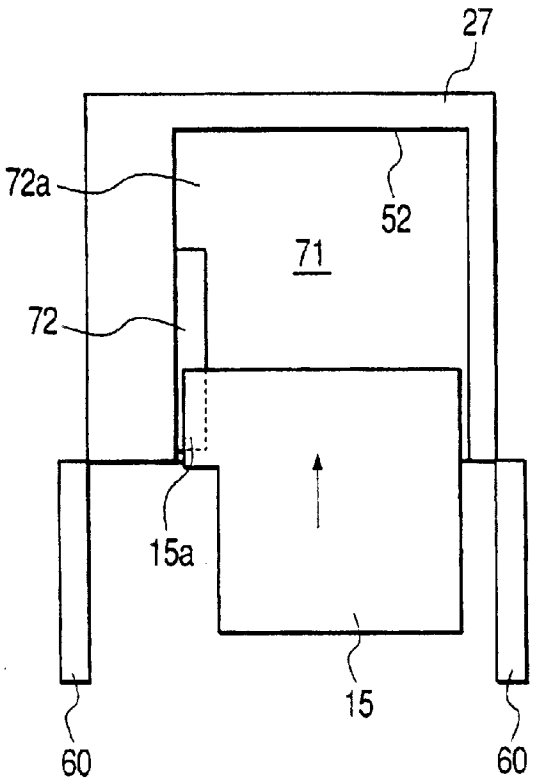
Figure 43C:
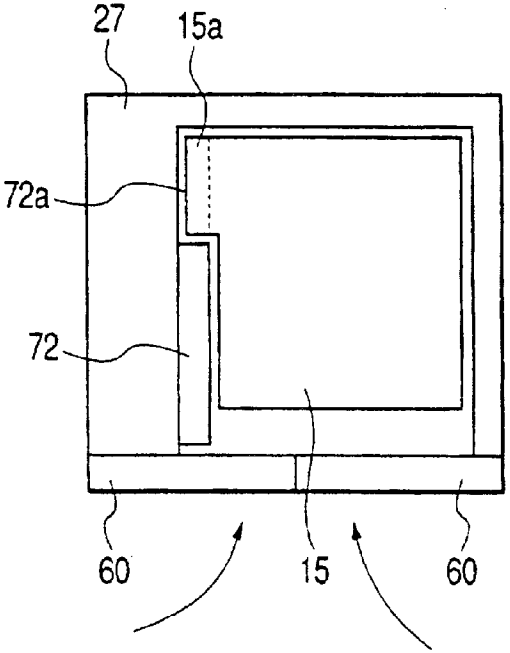

As shown in FIG. 43C, the front surface of the apparatus main body 27 is provided with a double hinged door 60. When this door 60 is opened in the manner shown in FIG. 43A, an opening 100*a* for inletting the process cartridge 15 is provided on the front surface of the apparatus main body 27, as shown in FIG. 40. It is possible to see a mounting portion 71 for the process cartridge 15 through this opening 100*a*.

Figure 42:
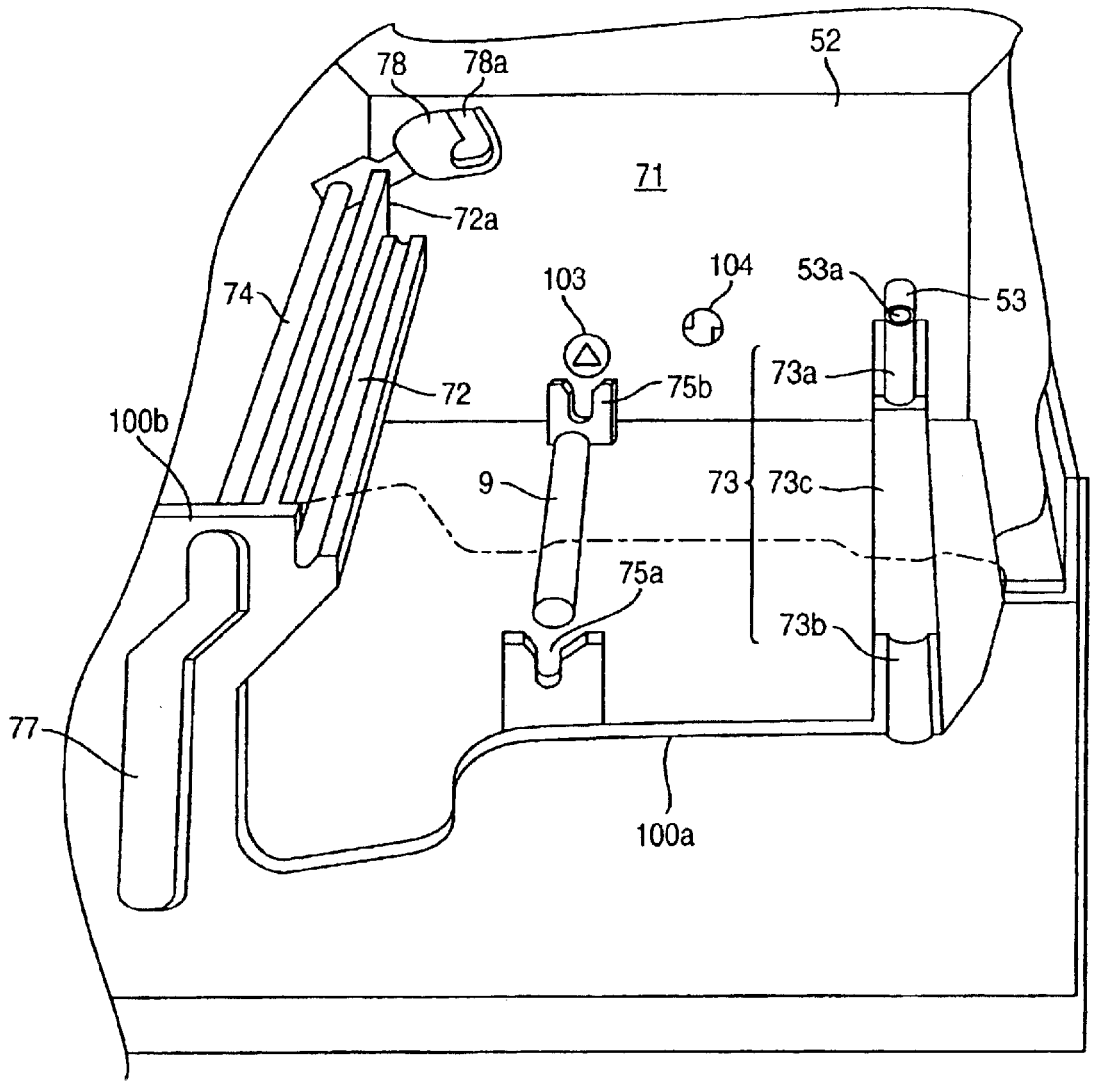
FIG. 42 is a perspective view showing the cartridge mounting portion of the main body of the image forming apparatus.

As shown in FIG. 42, as can be seen through the opening 100*a*, a main body fixation guide 72, the first guide concave portion 73*a*, the second concave portion 73*b*, and a flat guide portion 73*c* are fixed in the apparatus main body 27 in a direction from the front to the back. Here, the main body fixation guide 72, the first guide concave portion 73*a* and the second guide concave portion 73*b* each have a guide rail shape, and the components numbered 73*a* to 73*c* are hereinafter collectively referred to as the "guide 73". Also, the guide 72 is provided at the upper-left corner of the opening 100*a* and the guide 73 is provided at the lower-right corner of the opening 100*a*. This guide 72 is a line groove and extends substantially parallel to the photosensitive drum 11. This line groove is a raceway surface that has a circular section opening upward. The first and second guide concave portions 73*a* and 73*b* extend parallel to the main body fixation guide 72.

As shown in FIG. 43A, there is no back portion of the guide 72, thereby providing a dropping portion 72*a*. The guide 73 is disposed so that it extends from the opening 100*a* backward, and reaches a hole shaped member 53 provided on a cartridge mounting portion back plate 52 existing at a backmost position viewed from the opening portion 100*a*. The hole shaped member 53 includes a substantially cylindrical hole 53*a*. This hole 53*a* is substantially parallel to the photosensitive drum 11 and exists on a straight line of the guide 73 view when viewed from above. Note that, the center of the hole 53*a* of the hole shaped member 53 exists at a position that is higher than that of the circular arc of the circular raceway of the guide rail 73. This will be described in more detail later in conjunction with the description of the operations of the device.

An up-and-down lever 78 is provided as a movable member at the upper-left back corner of the cartridge mounting portion 71. The up-and-down lever 78 is rotatably provided to an end plate 100*b* on the front side of the apparatus main body 27 and a back plate 52 using an axis 74. The axis 74 passes through the end plate 100*b* and protrudes frontward. The base portion of a main body lever 77 is fixed to this protrusion portion. Note that, the axis 74 is horizontally disposed perpendicular to the transport direction of a recording medium. Accordingly, the up-and-down lever 78 is operated by the main body lever 77 so that this lever 78 slides vertically. The up-and-down lever 78 is provided with a cam groove 78*a*. This cam groove 78*a* functions as a bearing portion for an engagement member 20*n* (to be described later) of the process cartridge 15.

The main body first coupling 103 and the main body second coupling 104 are exposed in a space functioning as the cartridge mounting portion 71 from the cartridge mounting portion back plate 52 of the apparatus main body 27.

The bottom side of the cartridge mounting portion 71 is a transport path for a sheet S that is a recording medium. On the both ends of the transfer roller 9 located in this transport path, a pair of main body positioning concave portions 75 (75*a*, 75*b*) is provided for a pair of stands provided to protrude upward. The shaft 22*a*1 provided for the bearing member 22*a* supporting the photosensitive drum 11 of the process cartridge 15 is fitted in the positioning concave portion 75*a* (on the front side in the direction in which the process cartridge is to be mounted). The shaft 22*a*1 exists on the axial line of the photosensitive drum 11, thereby precisely positioning one end of the photosensitive drum 11 on the non-driving side with respect to the apparatus main body 27. The bearing member 22*b* that concentrically surrounds the first coupling 105*a* on the process cartridge side is fitted in the positioning concave portion 75*b*. This bearing member 22*b* is a circular member and functions as a positioning portion. Under this condition where the bearing member 22*b* is fitted in the positioning concave portion 75*b*, the center of the bearing member 22*b*, which is to say the center of the photosensitive drum 11, exists on substantially the same line as the center of the main body first coupling 103. Here, the difference between the centers of the main body first coupling 103 and the bearing member 22*b* is within a range of from 100 $\mu$m to 1 mm. Therefore, when the main body first coupling 103 rotates, the first coupling 105*a* on the process cartridge side is aligned. Then, the photosensitive drum 11 rotates about a rotational center that is the same as that of the main body first coupling 103. Accordingly, while the photosensitive drum 11 is rotating, the bearing member 22*b* that is a positioning portion is not securely positioned on the positioning concave portion 75*b* existing backward but is placed in a floating state. Next, a cartridge mounting means on the process cartridge side will be described.

As shown in FIGS. 5 and 6A, when viewed in a mounting direction, the first guide portion 15*a* to be guided by the main body fixation guide 72 is provided at a back upper-left corner portion of the process cartridge 15. This first guide portion 15*a* includes a tip that is directed downward in a slanting manner. This tip has a circular section and has a shape that is substantially parallel to the photosensitive drum 11. The tip of the first guide portion 15*a* is engaged with the raceway surface of the line groove of the guide 72 having a circular section. This first guide portion 15*a* exists only at the back in the process cartridge mounting direction. This first guide portion 15*a* includes a horizontal protrusion portion 15*a*-1 that is substantially parallel to the upper surface of the cartridge frame portion and a lower protrusion portion 15*a*-2 that protrudes downward from the horizontal protrusion portion 15*a*-1. The lower end of the lower protrusion portion 15*a*-2 is guided by the main body fixation guide 72.

As shown in FIG. 6A, the second guide portion 20*g* is provided at the back lower position that is farthest rightward from the aforementioned first guide portion 15*a*, when viewed in the process cartridge mounting direction. This second guide portion 20*g* includes a protrusion 20*g*1 having a round boss shape that extends substantially parallel to the photosensitive drum 11 and a supporting portion 20*g*2 that is integrated with the protrusion 20*g*1 and is connected to the front end cover 20. The protrusion 20*g*1 has a substantially cylindrical shape. The lower portions of the protrusion 20*g*1 and the supporting portion 20*g*2 are connected to each other and the cross section thereof has a circular arc shape. The diameter of the protrusion 20*g*1 is determined so that the protrusion 20*g*1 is loosely fitted in the hole 53*a* of the hole shaped member 53. The second guide portion 20*g* is integrally formed with the front end cover 20.

As shown in FIG. 5, on the back upper-left corner in a direction in which the process cartridge 15 is mounted to the apparatus main body 27, an engagement member 20*n* that has a round pin shape and protrudes in the mounting direction is integrally provided for the front end cover 20. The position of this engagement member 20*n* is slightly higher than the position of the base portion of the aforementioned first guide portion 15*a*. The engagement member 20*n* protrudes upward from the upper surface of the cartridge frame portion. The engagement member 20*n* also protrudes from the tip surface of the cartridge frame portion in a direction in which the process cartridge 15 enters the apparatus main body 27. Here, the stated tip surface is a surface that will be positioned at a tip when the process cartridge 15 is entered into the apparatus main body 27. Here, the stated upper surface is a surface facing upward when the process cartridge 15 is entered into the apparatus main body 27. Note that, the first guide portion 15*a* is connected to both of a portion integrally formed with the front end cover 20 and a portion integrated with the cleaning frame 13. Also, there is provided the second guide portion 20*g* on the back lower-right corner when viewed in the direction in which the process cartridge 15 is mounted in the apparatus main body 27. As shown in FIG. 6B, an inclined plane 20*g*3 is provided on the lower side of the protrusion 20*g*1 of this second guide portion 20*g*. Also, the third guide portion 19*g*, which includes the center of the circular arc directed downward on a line that passes through the center of the protrusion 20*g*1 of the second guide portion 20*g* in parallel to the photosensitive drum 11, is provided on the front lower-right side, when viewed in the direction in which the process cartridge 15 is mounted in the apparatus main body 27. The third guide portion 19*g* is integrally formed with the rear end cover 19.

The process cartridge 15 is inserted into the main body 27 of the image forming apparatus in the manner described below. First, as shown in FIG. 43A, an operator opens the door 60 provided on the front side of the main body 27 of the image forming apparatus (on the non-driving side in the axial direction of the photosensitive drum). Next, the operator grasps the first handle 30 provided on the upper surface of the process cartridge 15 with one hand, lifts up the process cartridge 15, grasps the frontward second handle 29 with the other hand, and pushes the process cartridge 15 into the opening 100*a* toward the cartridge mounting portion 71. As shown in FIG. 40, the first guide portion 15*a* of the process cartridge 15 is mounted on the main body fixation guide 72, while the second guide portion 20*g* is mounted on the second guide concave portion 73*b*. Then, from the lengthwise direction of the photosensitive drum 11, the operator inserts the process cartridge 15 into the main body of the image forming apparatus in a straight line (backward on the sheet plane of FIG. 40, in the arrow directions in FIGS. 43A and 43B).

Figure 44A:
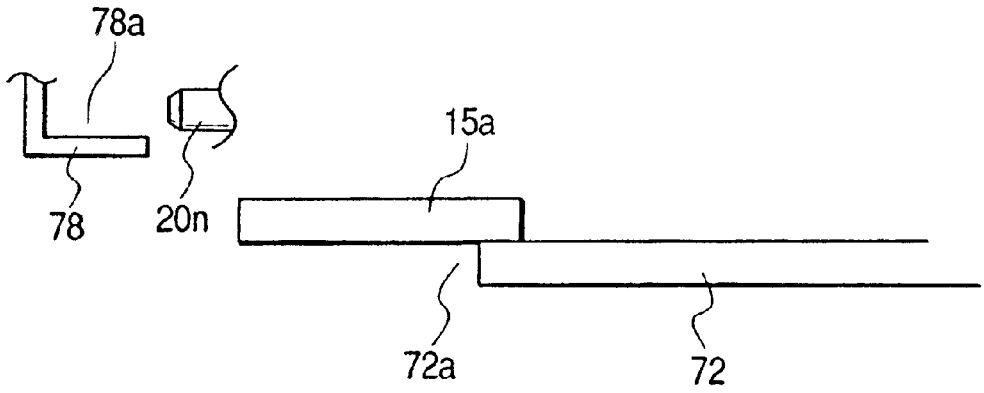
FIGS. 44A, 44B, and 44C are side cross-sectional views showing relations among an up-and-down lever and a guide portion of the process cartridge and a guide rail of the main body of the image forming apparatus.
Figure 44B:
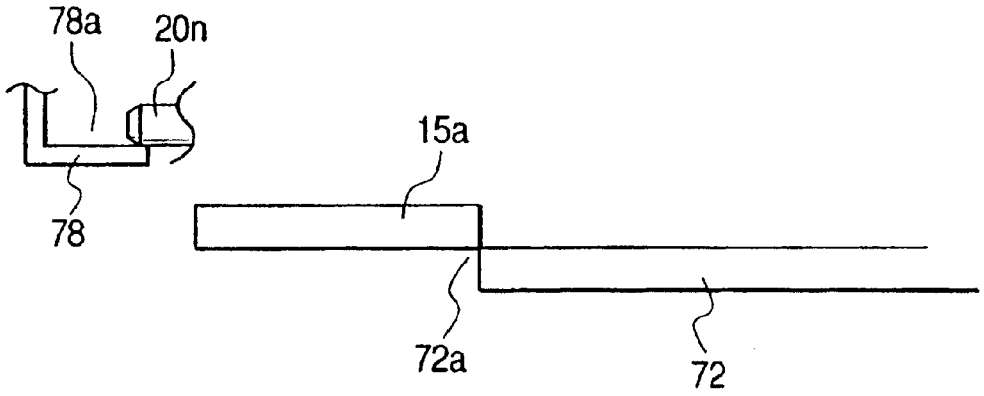
Figure 44C:
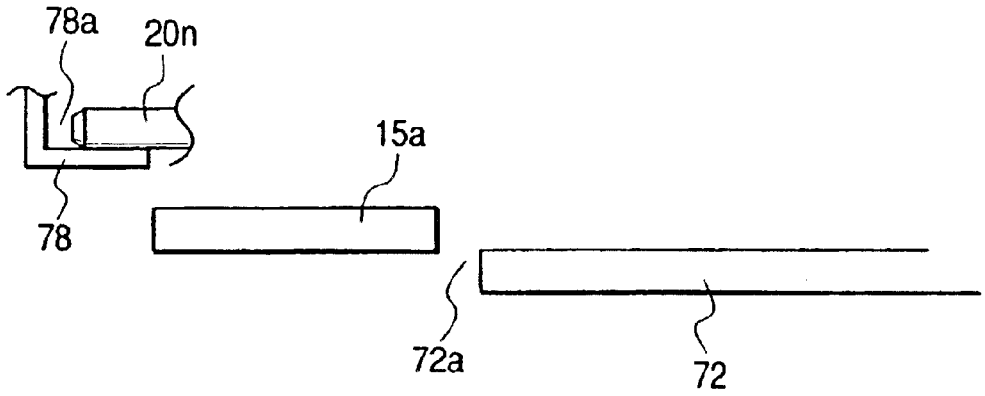

Here, the main body fixation guide 72, which allows the first guide portion 15*a* to move within the main body of the image forming apparatus in the axial direction of the electrophotographic photosensitive drum, is divided in the photosensitive drum axial direction, thereby obtaining the dropping portion 72*a* in which there does not exist the main body fixation guide 72. Here, as shown in FIG. 44A, the first guide portion 15*a* slides on the main body fixation guide 72 and comes near the dropping portion 72*a*. Then, as shown in FIG. 44B, the engagement member 20*n* existing back in the process cartridge insertion direction engages with the cam groove 78*a* of the up-and-down lever 78. Following this, as can be seen from FIGS. 44B to 44C, the first guide portion 15*a* is detached from the main body fixation guide 72 and the engagement portion 20*n* is supported by the up-and-down lever 78. As a result, a part of the process cartridge 15 is supported.

On the other hand, after the first guide portion 15*a* of the process cartridge 15 is first mounted on the main body fixation guide 72 and the second guide portion 20*g* on the back lower-right corner of the process cartridge 15 is simultaneously mounted on the guide 73, the operator pushes the process cartridge 15 backward. Consequently, the second guide portion 20*g* moves backward by sliding on the guide 73. Then, before the protrusion 20*g*1 of the second portion 20*g* reaches the hole-shaped member 53, the third guide portion 19*g* existing at the front lower-right corner in the insertion direction of the process cartridge 15 engages with the second guide concave portion 73*b*. Note that as shown in FIG. 6A, the third guide portion 19*g* includes an inclined plane 19*g*1 at the front end thereof in the insertion direction of the process cartridge 15, so that the third guide portion 19*g* smoothly enters into the second guide concave portion 73*b*. In this manner, the lower-right corner of the process cartridge 15 in its insertion direction is supported by the second guide concave portion 73*b* in the cartridge mounting portion 71. Also, under this condition, the first guide portion 15*a* at the back upper-left corner in the insertion direction is supported by the main body fixation guide 72. When the process cartridge 15 is further inserted, the protrusion 20*g*1 at the back lower-right corner of the process cartridge 15 is inserted into the hole 53*a* of the hole-shaped member 53 at the timing when the aforementioned engagement member 20*n* engages with the cam groove 78*a* of the up-and-down lever 78. During this operation, the back right corner of the process cartridge 15 is lifted up because the center of the hole 53*a* of the hole-shaped member 53 exists at a position higher than the center of the protrusion 20*g*1 under a condition where this protrusion is guided by the first guide concave portion 73*a*.

Under a condition where the protrusion 20*g*1 is fitted into the hole 53*a* of the hole shaped portion 53 and the engagement member 20*n* engages with the cam groove 78*a* of the up-and-down lever 78, the first guide portion 15*a* has reached the dropping portion 72*a* and the third guide portion 19*g* is placed on the second guide concave portion 73*b*. This means that the process cartridge 15 is supported at three points in total.

Figure 46:
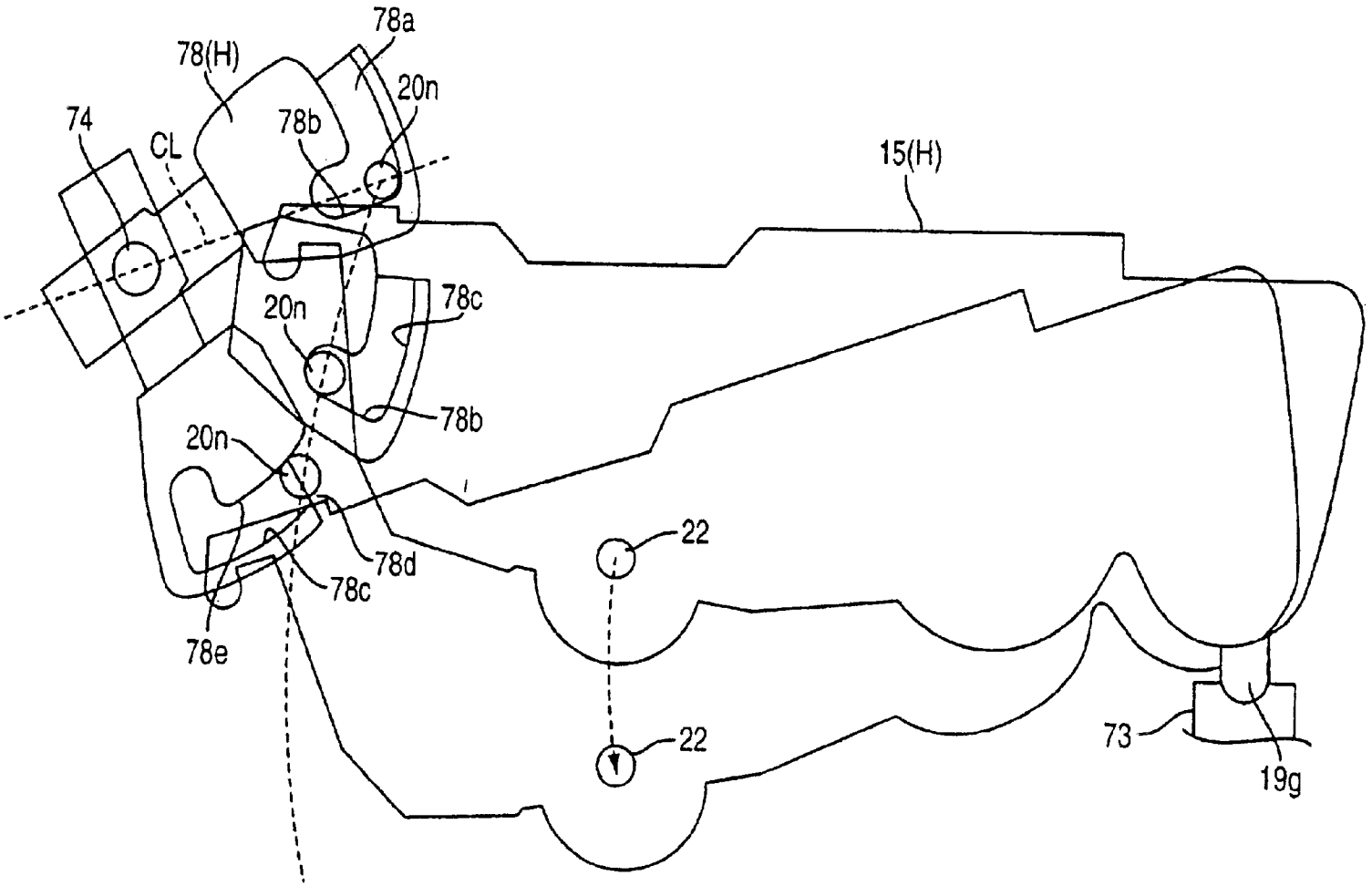
FIG. 46 is a side view showing a path traced by the process cartridge in the cartridge mounting portion.

The main body lever 77 is held by an unillustrated notch when the lever is at a position indicated by a solid line in FIG. 40. When the main body lever 77 is rotated in the direction indicated by the arrow B in this drawing, the axis 74 is also rotated and the up-and-down lever 78 is rotated in a direction for moving the cam groove 78*a* downward. As a result, as shown in FIG. 46, the process cartridge 15 moves downward by rotating about the protrusion 20*g*1 being fitted in the hole 53*a* of the hole shaped portion 53 and the third guide portion 19*g* being supported by the second guide concave portion 73*b*. During this, the process cartridge 15 is supported by the cam groove 78*a* on which the engagement member 20*n* is mounted. Then, the bearing members 22*a* and 22*b* that are positioning portions are respectively fitted in the positioning concave portions 75*a* and 75*b* of the apparatus main body 27. Then, when the main body lever 77 is rotated to a position at which it is held horizontally, the mounting of the process cartridge 15 to the apparatus main body 27 (see FIG. 41) is finished. Note that the main body lever 77 is separated from the engagement member 20*n*, further moves downward, and stops.

Here, how the process cartridge 15 is moved downward by means of the up-and-down lever 78 will be described with reference to FIG. 46.

In FIG. 46, under a condition where the process cartridge 15 is inserted into the back of the cartridge mounting portion 71 through the opening 100*a*, the process cartridge 15 is at a high position (H) (a symbol "H" is added to the reference numeral representing the process cartridge). At this position (H), the process cartridge 15(H) is held in a condition where the engagement portion 20*n* is supported by the up-and-down lever 78, the protrusion 20*g*1 is supported to the hole 53*a* of the hole-shaped portion 53, and the third guide portion 19*g* is supported by the second guide concave portion 73*b*.

When the cam groove 78*a* side of the up-and-down lever 78 moves downward, the engagement member 20*n* also moves downward. During this movement, a center line connecting the center of the protrusion 20*g*1 and the center of the third guide portion 19*g* serves as a rotational center for the mounting operation of the process cartridge 15. The engagement member 20*n* moves toward the axis 74 on a bottom surface 78*b* of the cam groove 78*a*, so that the process cartridge 15 drops due to its own weight. At a position where the process cartridge 15 drops to a midway point and the engagement member 20*n* comes to coincide with a straight line connecting the circular arc center of the third guide portion 19*g* and the center of the axis 74, the engagement member 20*n* comes closest to the axis 74. A cam curve at the bottom of the cam groove 78*a* is selected such that, while the up-and-down lever 78 moves downward from the position 78(H) (a symbol is added to the reference numeral 78), the engagement member 20*n* moves on a center line CL connecting the center of the engagement member 20*n* and the center of the axis 74 at the position 78(H). When the cam groove 78*a* side of the up-and-down lever 78 further moves downward, the engagement member 20*n* moves while sliding on the bottom surface 78*b* of the cam groove 78 in a direction in which it moves apart from the axis 74. Then, after the process cartridge 15 is fitted in the positioning concave portions 75 under a condition whore the engagement member 20*n* does not reach a circular arc portion outer wall 78*c* of the cam groove 78*a* continuous with the right end of the bottom surface 78*b*, the engagement member 20*n* is placed in a non-movable condition. Then, the circular arc groove portion outer wall 78*c* of the cam groove 78*a* moves under a condition where this circular arc groove portion outer wall 78*c* is separated from the engagement member 20*n*, and an opening portion 78*d* of the cam groove 78*a* comes to a position where with the engagement member 20*n* exists. Note that the circular arc groove portion outer wall 78*c* and an inner wall 78*e* are each a circular arc whose center is the axis 74, and the distance between the groove portion external wall 78*c* and the internal wall 78*c* is larger than the width of the engagement member 20*n*. A space between the outer wall 78*c* and the inner wall 78*e* is opened upward to form the opening 78*d*.

During the insertion of the process cartridge 15 backward, the main body first coupling 103 and the main body second coupling 104 that are both driving force transmission members engage with the first coupling 105*a* and the second coupling 106*a*, respectively, which are both driving force receiving members on the process cartridge side. Note that there are cases where engagement between the paired couplings is not established. However, when the couplings on the main body side are driven, these couplings on the main body side being biased by a spring force move forward and engagement between the couplings is instantaneously established.

When an unillustrated driving source of the apparatus main body 27 is driven and the main body first coupling 103 and the coupling 105*a* on the process cartridge side are rotated, these couplings are aligned and their center lines coincide with each other. As a result, the photosensitive drum 11 is aligned with the first coupling 103 on the apparatus main body side. The alignment amount in this case is around 100 microns to one millimeter from a position at which the bearing member 22*b* of the process cartridge 15 is fit in the main body positioning concave portion 75*b*. During driving, the process cartridge 15 is supported by the positioning concave portion 75*a* placed frontward in the insertion direction, the hole shaped portion 53, and the fitting of the first coupling 105*a* on the process cartridge side in the main body first coupling 103. Also, as described above, driving force transmission is performed unhindered even if the center line of the main body second coupling 104 and the center line of the second coupling 106*a* on the process cartridge side do not coincide with each other.

It should be noted here that when the process cartridge 15 moves downward and is placed at the mounting position, this process cartridge 15 is supported by the positioning concave portion 75*a*, the hole 53*a* of the hole-shaped member 53, and the main body positioning concave portion 75*b*.

That is, the cartridge 15 is mounted at the mounting position under a condition where the positioning member (shaft 22*a*1) is fitted in the main body positioning concave portion 75*a*, the positioning member (bearing member 22*b*) is fitted in the main body positioning concave portion 75*b*, and the protrusion 20*g*1 is fitted in the hole 53*a*.

Figure 41:
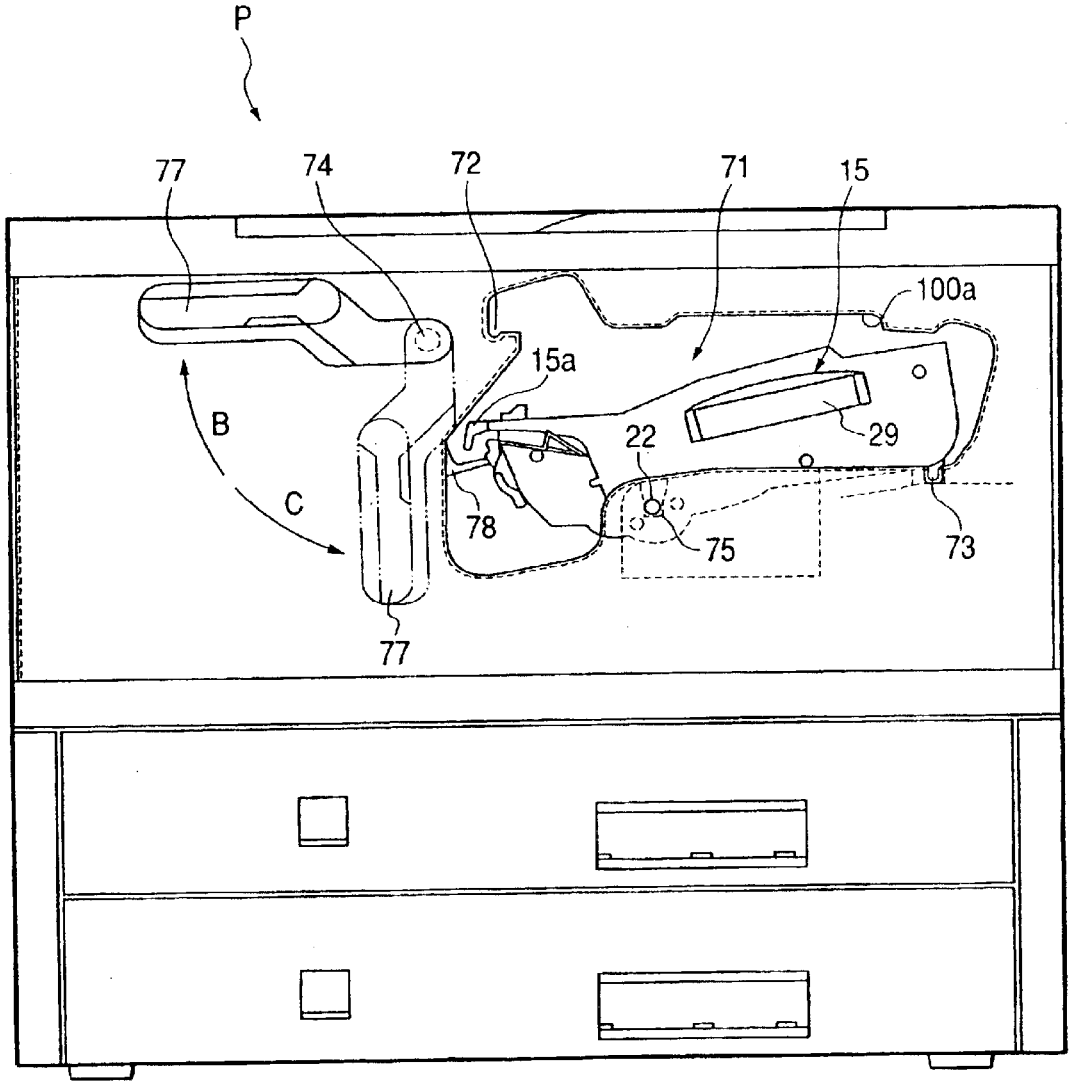
FIG. 41 is a front view showing the mounting of the process cartridge to the main body of the image forming apparatus.

When the main body lever 77 is rotated from the condition shown in FIG. 41 in the direction indicated by the arrow C in this drawing, the axis 74 is rotated in the same direction and the up-and-down lever 78 moves upward. Then, the engagement member 20*n*, which exists at the back upper-left corner when viewed in the insertion direction of the process cartridge 15, is lifted up by the cam groove 78*a*. Consequently, the protrusion 20*g*1, which is placed at the back lower-right corner when viewed in the insertion direction of the process cartridge 15, rotates within the hole-shaped member 53 of the apparatus main body 27, the left portion of the process cartridge 15 when viewed in the insertion direction is lifted up, the shaft 22*a* 1 is moved slightly upward to be separated from the positioning concave portion 75*a*, the bearing member 22*b* is moved slightly upward to be separated from the positioning concave portion 75*b*, and the third guide portion 19*g*, which is positioned at the front lower-right corner when viewed in the insertion direction of the process cartridge 15, moves downward and is supported by the second guide concave portion 73*b*. As a result, the process cartridge 15 is placed in a condition where the protrusion 20*g*1 is supported by the hole-shaped portion 53 and the third guide portion 19*g* is supported by the third guide concave portion 73*b*. At this time, the engagement member 20*n* moves upward and the process cartridge 15 is placed in the state shown in FIG. 40 by taking the protrusion 20*g*1 and the lower circular arc portion of the third guide portion 19*g* as a rotational center. During this movement, the first guide portion 15*a* at the back upper-left corner of the process cartridge 15 passes through the dropping portion 72*a* and is thus placed at a position at which this first guide portion 15*a* is able to enter into the main body fixation guide 72 when viewed from the front of the apparatus main body 27. Here, when the operator grasps the second handle 29 and pulls it frontward in the state shown in FIG. 40, the engagement member 20*n* at the back upper-left corner of the process cartridge 15 lightly engages with the cam groove 78*a* that is a receiving portion for this member and the protrusion 20*g*1 at the back lower-right corner in the insertion direction of the process cartridge 15 also moves in a direction in which the protrusion 20*g*1 moves apart from the hole-shaped potion 53. Following this, since the first guide portion 15*a* at the back upper-left corner in the insertion direction of the process cartridge 15 has moved to the dropping portion 72*a*, when the process cartridge 15 is pulled frontward, the first guide portion 15*a* becomes mounted on the main body fixation guide 72 and thereafter the pin-like engagement member 20*n* at the back upper-left corner in the insertion direction of the process cartridge 15 is detached from the cam groove 78*a*. Also, at almost the same time, the protrusion 20*g*1 at the back lower-right corner in the insertion direction of the process cartridge 15 is detached from the hole shaped portion 53 and the right side of this cartridge when viewed from the front of the apparatus main body 27 is placed in a condition where the second and third guide portions 20*g* and 19*g*, respectively, become mounted on the second and first guide convave portions 73*b* and 73*a*, respectively. When the process cartridge 15 is pulled out, the first guide portion 15*a* slides on the main body fixation guide 72, the second and third guide portions 20*g* and 19*g*, respectively, slide on the guide 73, and the third guide portion 19*g* first passes through the opening 100*a* to the outside and is detached from the guide 73. Following this, when the operator pulls the process cartridge 15 frontward while supporting the process cartridge 15 using the second handle 29, the first guide portion 15*a* moves to the front end of the main body fixation guide 72 and the second guide portion 20*g* moves to the front end of the main body fixation guide 73*b*. Here, when the operator further pulls the process cartridge 15 toward the outside of the opening 100*a* by grasping the first handle 30, the first guide portion 15*a* is detached frontward from the front end of the main body fixation guide 72 and the second guide portion 20*g* is detached frontward from the front end of the second guide 73*b*.

Figure 45C:
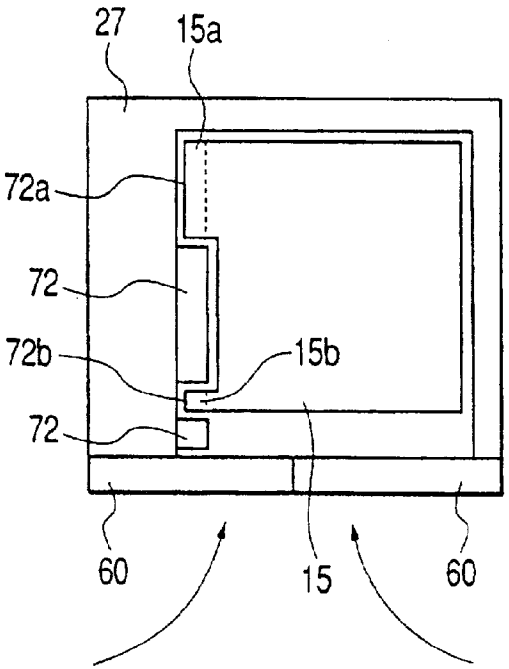
FIGS. 45A, 45B, and 45C are plan views showing how the process cartridge is inserted into the main body of the image forming apparatus according to another embodiment.
Figure 45B:
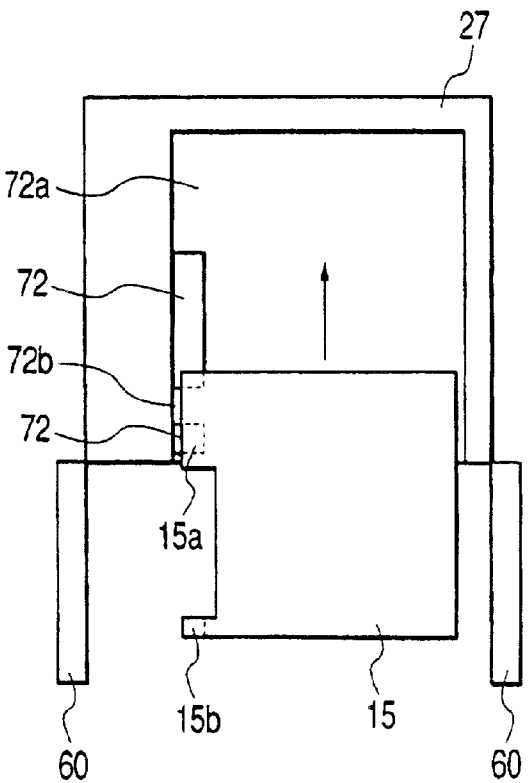
Figure 45A:
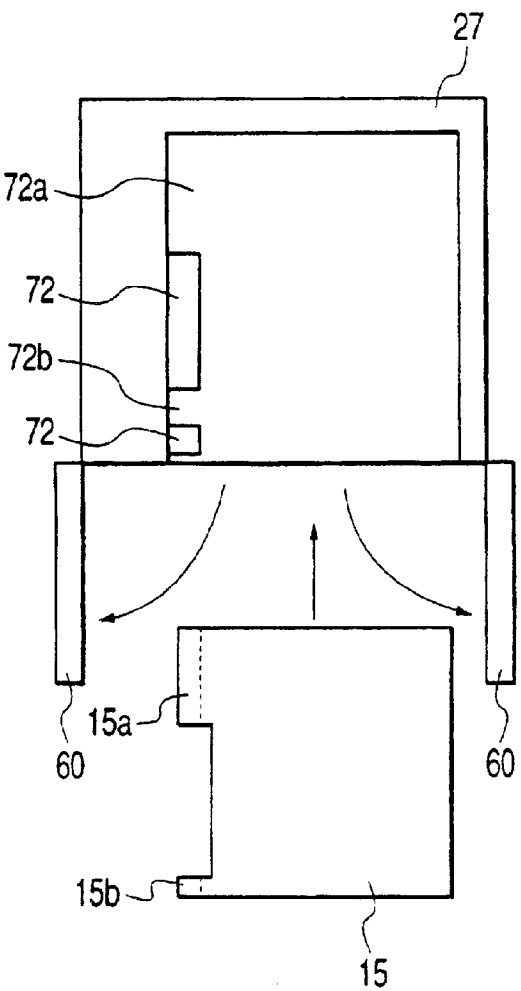

As to the guides of the apparatus main body 27 and the guide portions of the process cartridge 15, there may be provided a plurality of dropping portions and a plurality of guide portions. For instance, FIGS. 45A, 45B, and 45C are each a plan view showing the insertion of a process cartridge according to another embodiment into the apparatus main body. In FIGS. 45A to 45C, there is obtained a construction in which a dropping portion 72*b* is added to a position midway through the main body fixation guide 72. In this case, when the first guide portion 15*a* overlaps with the dropping portion 72*a*, a guide portion 15*b* existing on the front side in the insertion direction overlaps with the dropping portion 72*b*.

There is obtained a construction in which the mounting and detachment of the process cartridge 15 is performed in the manner described above, so that when a sheet that is a recording medium is passed into the image forming apparatus, that is to say, when a rotation force and a driving force are applied to the photosensitive drum 11 in a clockwise direction, the protrusion 20*g*1 is fitted in the hole shaped portion 53 of the image forming apparatus and the rotation of the process cartridge 15 is stopped. As a result, the posture of the process cartridge 15 is maintained. That is, the rocking center, about which the process cartridge 15 rocks when it is mounted to or detached from the apparatus main body 27, functions as a rotation stopper during the sheet passing. Further, the stability of a pivot during the rocking can be enhanced.

Even if the process cartridge increases in weight and size in accordance with the upsizing of the image forming apparatus, it is possible to mount the process cartridge to the image forming apparatus merely by horizontally pushing the process cartridge and performing a lever operation to place a lever at a predetermined position. That is, the operation that an operator is required to perform by directly carrying the process cartridge is only the insertion thereof in a straight line. As a result, the handling of the process cartridge becomes easy.

Also, the process cartridge is positioned with reliability only by the lever operation, so that operability is enhanced and the accuracy of positioning of the process cartridge is improved.

Also, it is possible to inversely detach the process cartridge from the image forming apparatus merely by pulling the process cartridge frontward after a lever operation, so that superior operability is realized even in the case of a large-sized process cartridge.

Also, the first and second guide concave portions supporting the process cartridge from the lower side are provided on the lower side of an end portion of the developer frame so that enough distance is maintained between these guide concave portions and the photosensitive drum. As a result, the center of the photosensitive drum traces a circular arc path that extends in a nearly vertical direction. Also, the up-and-down lever is provided with a cam groove and the pin-like engagement member of the process cartridge is inserted into this cam groove, which simplifies the construction of the up-and-down means of the process cartridge. Further, the weight of the process cartridge placed on the up-and-down means is directly applied to an operation lever (main body lever 77) not through a link mechanism. Therefore, the operation feeling communicated to the user is acute and it becomes possible for the operator to move upward and downward the process cartridge at an appropriate speed.

In accordance with the embodiment described above, there is obtained an effect that cost reduction is achieved by reducing the number of parts and images with higher stability are formed by improving the accuracy of attachment of important parts related to image formation.

Also, in accordance with the embodiment, it becomes possible to provide the engagement member (groove 17*e*) that rotatably supports the developing roller in the vicinity of an end portion in the axial line direction of the developing roller and to regulate relative positions of the magnet roller and the developing roller using the engagement member. Also, a substantially cylindrical protruding portion that is coaxial with the developing roller is provided for the engagement member so as to protrude to the outside, and this protruding portion is provided with a positioning portion for regulating relative positions of the developer roller and the photosensitive drum and a receiving plane for pressurizing the developing roller against the electrophotographic photosensitive member. As a result, it becomes possible to achieve cost reduction by reducing the number of parts and to form images with higher stability by improving the accuracy of attachment of important parts related to image formation.

According to the present invention, a predetermined pressurizing force is generated between the developing roller and the electrophotographic photosensitive drum and therefore a constant space is maintained between these members. As a result, it becomes possible to obtain stable images. Also, cost reduction and space saving are achieved by reducing the number of parts.

While the invention has been described with respect to the structure disclosed herein, it is not confined to the details set forth and this application is intended to cover such modifications or changes as may come within the purposes of the improvement or the scope of the following claims.

What is claimed is:

1. A process cartridge detachably mountable to a main body of an electrophotographic image forming apparatus, said process cartridge comprising:

an electrophotographic photosensitive drum;

a developing roller configured and positioned to develop an electrostatic latent image formed on said electrophotographic photosensitive drum;

a developing blade configured and positioned to regulate the amount of developer on a peripheral surface of said developing roller, said developing blade having a regulating portion configured and positioned to regulate the amount of developer on the peripheral surface of said developing roller and a supporting portion configured and positioned to support said regulating portion;

a developing frame that rotatably supports said developing roller, wherein said supporting portion of said developing blade is attached to said developing frame;

a drum frame that rotatably supports said electrophotographic photosensitive drum and that is connected to said developing frame, wherein said drum frame and said developing frame are connected rockably to each other; and a biasing member configured and positioned to bias said developing roller toward said electrophotographic photosensitive drum, wherein one end of said biasing member is attached to at least one end of said supporting portion in the longitudinal direction of said developing roller.

2. A process cartridge according to claim 1, wherein the other end of said biasing member is attached to said drum frame.

3. A process cartridge according to claim 1, wherein each of said biasing member and said supporting portion is made of a conductive material.

4. A process cartridge according to claim 3, further comprising a detection member configured and positioned to detect a capacitance caused by a residual quantity of developer in said process cartridge by applying a voltage to said developing roller, wherein said voltage is applied to said supporting portion through said biasing member.

5. A process cartridge according to claim 4, further comprising a developing contact portion which, when said process cartridge is mounted to the main body, contacts a main-body-side developing contact portion of the main body that is configured and positioned to apply a voltage to said developing roller, wherein the other end of said biasing member is in contact with said developing contact portion.

6. A process cartridge according to claim 5, wherein said biasing member is an extension coil spring, and said biasing member has a straight line portion extending from and substantially perpendicular to said coil spring, said straight line portion being in contact with said developing contact portion.

7. A process cartridge according to claim 5, further comprising:

a developer container configured and positioned to contain developer to be supplied to said developing roller; and an end cover provided at one end side in the longitudinal direction of said electrophotographic photosensitive drum and configured and positioned to position said drum frame and said developer container, wherein said developing contact portion is provided on said end cover.

8. A process cartridge according to claim 1, wherein said one end of said supporting portion protrudes from one end of said developing frame in the longitudinal direction of said developing roller.

9. A process cartridge according to claim 1, wherein said supporting portion has a shape extending in the longitudinal direction of said developing roller.

10. A process cartridge according to claim 1 or 9, wherein said supporting portion is attached to said developing frame by a screw.

11. An electrophotographic image forming apparatus to which a process cartridge is detachably mountable for forming an image on a recording medium, said electrophotographic image forming apparatus comprising:

(i) mounting means for detachably mounting the process cartridge, the process cartridge comprising:

an electrophotographic photosensitive drum;

a developing roller configured and positioned to develop an electrostatic latent image formed on the electrophotographic photosensitive drum;

a developing blade configured and positioned to regulate the amount of developer on a peripheral surface of the developing roller, the developing blade having a regulating portion configured and positioned to regulate the amount of developer on the peripheral surface of the developing roller and a supporting portion configured and positioned to support the regulating portion;

a developing frame that rotatably supports the developing roller, wherein the supporting portion of the developing blade is attached to the developing frame;

a drum frame that rotatably supports the electrophotographic photosensitive drum and that is connected to the developing frame, wherein the drum frame and the developing frame are connected rockably to each other; and a biasing member configured and positioned to bias the developing roller toward the electrophotographic photosensitive drum, wherein one end of the biasing member is attached to at least one end of the supporting portion in the longitudinal direction of the developing roller; and (ii) transporting means for transporting the recording medium.

12. A developing blade for use in a process cartridge, the process cartridge comprising an electrophotographic photosensitive drum, a developing roller configured and positioned to develop an electrostatic latent image formed on the electrophotographic photosensitive drum, a developing frame that rotatably supports the developing roller, a drum frame that rotatably supports the electrophotographic photosensitive drum and that is connected to the developing frame, wherein the drum frame and the developing frame are connected rockably to each other, and a biasing member configured and positioned to bias the developing roller toward the electrophotographic photosensitive drum, said developing blade comprising:

a regulating portion configured and positioned to regulate the amount of developer on a peripheral surface of the developing roller; and a supporting portion configured and positioned to support said regulating portion, said supporting portion being attached to the developing frame and having an attaching portion to which one end of the biasing member is attached.

* * * * *

UNITED STATES PATENT AND TRADEMARK OFFICE

CERTIFICATE OF CORRECTION

PATENT NO. : 6,836,629 B2
DATED : December 28, 2004
INVENTOR(S) : Miyabe et al.

It is certified that error appears in the above-identified patent and that said Letters Patent is hereby corrected as shown below:

Column 4,
Lines 41 and 45, “frame,” should read -- frame; --.

Column 5,
Lines 7 and 10, “cross sectional” should read -- cross-sectional --.
Line 25, “ends” should read -- end --.

Column 12,
Line 7, “seat” should read -- seal --.

Coumn 17,
Line 25, “18aof” should read -- 18a of --.

Coumn 20,
Line 36, “17c” should read -- 17e --.

Column 25,
Line 22, “cross sectional” should read -- cross-sectional --.
Line 23, “cross” should read -- cross- --.

Column 34,
Line 42, “whore” should read -- where --.

Column 35,
Line 13, “fit” should read -- fitted --.

Signed and Sealed this

Seventeenth Day of May, 2005

JON W. DUDAS
*Director of the United States Patent and Trademark Office*